US006897001B2

(12) United States Patent
Mizoe et al.

(10) Patent No.: US 6,897,001 B2
(45) Date of Patent: May 24, 2005

(54) TONER AND IMAGE FORMING METHOD

(75) Inventors: Kiyoshi Mizoe, Numazu (JP); Tsuyoshi Takiguchi, Shizuoka-ken (JP); Fumihiro Arahira, Shizuoka-ken (JP); Masanori Ito, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/254,519

(22) Filed: Sep. 26, 2002

(65) Prior Publication Data

US 2003/0152856 A1 Aug. 14, 2003

(30) Foreign Application Priority Data

Sep. 28, 2001 (JP) ..... 2001-299292
Sep. 28, 2001 (JP) ..... 2001-299293
Jan. 18, 2002 (JP) ..... 2002-009816

(51) Int. Cl.[7] ..... G03G 9/08
(52) U.S. Cl. ..... 430/108.6; 430/108.1; 430/108.7
(58) Field of Search ..... 430/108.1, 108.6, 430/108.7, 125, 126, 902

(56) References Cited

U.S. PATENT DOCUMENTS

| | | | | |
|---|---|---|---|---|
| 4,664,504 | A | 5/1987 | Oda et al. | |
| 4,727,395 | A | 2/1988 | Oda et al. | |
| 4,769,676 | A | 9/1988 | Mukai et al. | |
| 4,843,424 | A | 6/1989 | Oda et al. | |
| 4,965,162 | A | 10/1990 | Aonuma et al. | |
| 5,282,007 | A | 1/1994 | Oshiumi | |
| 5,290,650 | A * | 3/1994 | Shintaku et al. | 430/108.6 |
| 5,432,037 | A | 7/1995 | Nishikiori et al. | 430/126 |
| RE35,581 | E | 8/1997 | Nakamura et al. | 361/255 |
| 5,700,616 | A * | 12/1997 | Kasuya et al. | 430/108.23 |
| 5,948,584 | A * | 9/1999 | Hashimoto et al. | 430/109.3 |
| 5,976,755 | A | 11/1999 | Yoshida et al. | 430/126 |
| 6,081,681 | A | 6/2000 | Nagase et al. | 399/174 |
| 6,104,903 | A * | 8/2000 | Hara et al. | 399/265 |
| 6,128,456 | A | 10/2000 | Chigono et al. | 399/176 |
| 6,171,747 | B1 | 1/2001 | Sugizaki et al. | 430/126 |
| 6,465,144 | B1 * | 10/2002 | Hashimoto et al. | 430/106.1 |
| 6,596,452 | B1 * | 7/2003 | Magome et al. | 430/106.2 |
| 2003/0148203 | A1 * | 8/2003 | Suzuki et al. | 430/110.3 |

FOREIGN PATENT DOCUMENTS

| | | | |
|---|---|---|---|
| EP | 0586003 | | 8/1993 |
| EP | 1128224 | | 8/2001 |
| EP | 1128225 | A2 * | 8/2001 |
| JP | 59-133573 | | 7/1984 |
| JP | 62-203182 | | 9/1987 |
| JP | 63-36268 | | 2/1988 |
| JP | 63-133179 | | 6/1988 |
| JP | 63-149699 | | 6/1988 |
| JP | 1-20587 | | 1/1989 |
| JP | 2-302772 | | 12/1990 |
| JP | 3-103878 | | 4/1991 |
| JP | 5-2289 | | 1/1993 |
| JP | 5-17622 | | 1/1993 |
| JP | 5-53482 | | 3/1993 |
| JP | 5-61383 | | 3/1993 |
| JP | 5-150539 | | 6/1993 |
| JP | 6-118693 | | 4/1994 |
| JP | 6-175392 | | 6/1994 |
| JP | 6-183733 | | 7/1994 |
| JP | 6-192592 | | 7/1994 |
| JP | 8-109341 | | 4/1996 |
| JP | 9-278445 | | 10/1997 |
| JP | 10-307421 | | 11/1998 |
| JP | 10-307455 | | 11/1998 |
| JP | 10-307456 | | 11/1998 |
| JP | 10-307457 | | 11/1998 |
| JP | 10-307458 | | 11/1998 |
| JP | 11-15206 | | 1/1999 |
| JP | 2002-179948 | * | 6/2002 |

OTHER PUBLICATIONS

Japanese Patent Office Machine–Assisted Translation of JP 2002–179948, pub Jun. 2002.*
Japanese Patent Office Machine–Assisted Translation of JP 09–278445, pub Oct. 1997.*
Grant, R. et al., *Grant & Hackh's Chemical Dictionary,* fifth edition, McGraw–Hill Book Company, NY (1987), p. 531.*
Patent Abstracts of Japan, vol. 13, No. 066 (P–828) of JP63–254465 (1989).

* cited by examiner

*Primary Examiner*—Janis L. Dote
(74) *Attorney, Agent, or Firm*—Fitzpatrick, Cella, Harper & Scinto

(57) ABSTRACT

A toner suitable for use in an image forming method including a contact charging step is provided. The toner includes: toner particles comprising at least a binder resin and a colorant, and fine particles. The fine particles comprise: (i) a tungsten-containing tin oxide, or (ii) base particles, and a tungsten-containing tin compound coating the base particles, the fine particles contain tin (Sn) in a weight ratio (Sn/b) of 0.01 to 2.0 with respect to the base particles (B). In the fine particles, tungsten (W) is contained in a mol ratio (W/Sn) of 0.001 to 0.3 with respect to the tin (Sn).

19 Claims, 4 Drawing Sheets

TONER AND IMAGE FORMING METHOD

FIELD OF THE INVENTION AND RELATED ART

The present invention relates to a toner used in image forming methods, such as electrophotography, electrostatic recording, magnetic recording and toner jetting; and an image forming method using the toner.

Hitherto, image forming methods, such as electrophotography, electrostatic recording, magnetic recording, and toner jetting have been known. In the electrophotography, for example, an electrical latent image is formed on a latent image-bearing member which is generally a photosensitive member comprising a photoconductor material by various means, the electrostatic image is developed with a toner to form a visible toner image, and the toner image is, after being transferred onto a recording medium, such as paper, as desired, followed by fixing of the toner image onto the recording medium under application of heat, pressure or heat and pressure to form a fixed image.

In the conventional image forming methods, the residual portion of the toner remaining on the image-bearing member after the transfer is generally recovered by various means into a waste vessel in a cleaning step, and the above-mentioned steps are repeated for a subsequent image forming cycle.

In contrast thereto, a so-called development and simultaneous cleaning system (developing-cleaning system) or cleanerless system has been proposed as a system free from generation of waste toner. Such a system has been developed principally for obviating image defects, such as positive memory and negative memory due to residual toner. This system has not been satisfactory for various recording media which are expected to receive transferred toner images in view of wide application of electrophotography in recent years.

Cleanerless systems have been disclosed in, e.g., JP-A 59-133573, JP-A 62-203182, JP-A 63-133179, JP-A 64-20587, JP-A 2-302772, JP-A 5-2289, JP-A 5-53482 and JP-A 5-61383. These systems have not been described with respect to desirable image forming methods or toner compositions.

Among various known developing methods, as a developing method suitably applicable to a system essentially free from a cleaning device, a cleanerless system or a development and simultaneous cleaning system, it has been considered essential to rub the electrostatic latent image-bearing member surface with a toner and a toner-carrying member, so that contact developing methods wherein the toner or developer is caused to contact the latent image-bearing member have been principally considered. This is because the mode of rubbing the latent image-bearing member with the toner or developer has been considered advantageous for recovery of the transfer residual toner particles by developing means. However, such a development and simultaneous cleaning system or a cleanerless system is liable to cause toner deterioration, and the deterioration or wearing of the toner-carrying member surface or photosensitive member surface, so that a sufficient solution has not been given to the durability problem. Accordingly, a simultaneous development and cleaning system according to a non-contact developing scheme is desired.

On the other hand, as image forming methods applied to electrophotographic apparatus and electrostatic recording apparatus, various methods are also known as methods of forming latent images on image bearing members, such as an electrophotographic photosensitive member and an electrostatic recording dielectric member.

In recent years, a contact charging device has been proposed and commercialized as a charging device for a member to be charged such as a latent image-bearing member because of advantages, such as low ozone-generating characteristic and a lower power consumption, than the corona charging device.

The charging mechanism (or principle) during the contact charging may include (1) discharge (charging) mechanism and (2) direct injection charging mechanism, and may be classified depending on which of these mechanism is predominant.

(1) Discharge Charging Mechanism

This is a mechanism wherein a member is charged by a discharge phenomenon occurring at a minute gap between the member and a contact charging member. As a certain discharge threshold is present, it is necessary to apply to the contact charging member a voltage which is larger than a prescribed potential to be provided to the member-to-be-charged. Some discharge product occurs wile the amount thereof is remarkably less than in a corona charger, and active ions, such as ozone, occur though the amount thereof is small.

(2) Direct Injection Charging Mechanism

This is a mechanism wherein a member surface is charged with a charge which is directly injected into the member from a contact charging member. This mechanism may also be called direct charging, injection charging or charge-injection charging. More specifically, a charging member of a medium resistivity is caused to contact a member-to-be-charged to directly inject charges to the member-to-be-charged basically without relying on a discharge phenomenon. Accordingly, a member can be charged to a potential corresponding to an applied voltage to the charging member even if the applied voltage is below a discharge threshold. This mechanism is not accompanied with occurrence of active ions, such as ozone, so that difficulties caused by discharge products can be obviated. However, based on the direct injection charging mechanism, the charging performance is affected by the contactivity of the contact charging member onto the member-to-be-charged. Accordingly, it is preferred that the charging member is provided with a relative moving speed difference from the member-to-be-charged so as to provide a more frequent contact and more dense points of contact with the member-to-be-charged.

As a contact charging device, a roller charging scheme using an electroconductive roller as a contact charging member is preferred because of the stability of charging performance and is widely used.

During the contact charging according to the conventional roller charging scheme, the above-mentioned discharge charging mechanism (1) is predominant. More specifically, a charging roller has been formed of a conductive or medium-resistivity rubber or foam material optionally disposed in lamination to provide desired characteristics. Such a charging roller is provided with elasticity so as to ensure a certain contact with a member-to-be-charged, thus causing a large frictional resistance. The charging roller is moved following the movement of the member-to-be-charged or with a small speed difference with the latter. Accordingly, even if the direct injection charging is intended, the lowering in charging performance, and charging irregularities due to insufficient contact, contact irregularity due to the roller shape and attachment onto the member-to-be-charged, are liable to be caused.

FIG. 7 is a graph illustrating examples of charging efficiencies for charging photosensitive members by several contact charging members. The abscissa represents a bias voltage applied to the contact charging member, and the ordinate represents a resultant charged potential provided to the photosensitive member. The charging performance in the case of roller charging is represented by a line A. Thus, the surface potential of the photosensitive member starts to increase at an applied voltage exceeding a discharge threshold of ca. −500 volts. Accordingly, in order to charge the photosensitive member to a charged potential of −500 volts, for example, it is a general practice to apply a DC voltage of −1000 volts, or a DC voltage of −500 volts in superposition of an AC voltage at a peak-to-peak voltage of, e.g., 1200 volts, so as to keep a potential difference exceeding the discharge threshold, thereby causing the charged photosensitive member potential to be converged to a prescribed charged potential.

To describe based on a specific example, in a case where a charging roller is abutted against an OPC photosensitive member having a 25 $\mu$m-thick photosensitive layer, the surface potential of the photosensitive member starts to increase in response to an applied voltage of ca. 640 volts or higher and thereafter increases linearly at a slope of 1. The threshold voltage may be defined as a discharge inclination voltage Vth.

Thus, in order to obtain a photosensitive member surface potential Vd required for electrophotography, it is necessary to apply a DC voltage of Vd+Vth exceeding the required potential to the charging roller. Such a charging scheme of applying only a DC voltage to a contact charging member may be termed a "DC charging scheme".

In the DC charging scheme, however, it has been difficult to charge the photosensitive member to a desired potential, since the resistivity of the contact charging member is liable to change in response to a change in environmental condition, and because of a change in Vth due to a surface layer thickness change caused by abrasion of the photosensitive member.

For this reason, in order to achieve a more uniform charging, it has been proposed to adopt an "AC charging scheme" wherein a voltage formed by superposing a DC voltage corresponding to a desired Vd with an AC voltage having a peak-to-peak voltage in excess of 2×Vth is applied to a contact charging member as described in JP-A 63-149669. According to this scheme, the charged potential of the photosensitive member is converged to Vd which is a central value of the superposed AC voltage due to the potential smoothing effect of the AC voltage, whereby the charged potential is not affected by the environmental change. In the above-described contact charging scheme, the charging mechanism essentially relies on discharge from the contact charging member to the photosensitive member, so that a voltage exceeding a desired photosensitive member surface potential has to be applied to the contact charging member and a certain amount of ozone is generated.

Further, in the AC-charging scheme for uniform charging, ozone generation is liable to be promoted, a vibration noise (AC charging noise) between the contact charging member and the photosensitive member due to AC voltage electric field is liable to be caused, and the photosensitive member surface is liable to be deteriorated due to the discharge, thus posing a new problem.

Fur brush charging is a charging scheme, wherein a member (fur brush charger) comprising a brush of electroconductive fiber is used as a contact charging member, and the conductive fiber brush in contact with the photosensitive member is supplied with a prescribed charging bias voltage to charge the photosensitive member surface to prescribed polarity and potential. In the fur brush charging scheme, the above-mentioned discharge charging mechanism (1) may be predominant. An example of the charging performance according to the fur brush charging scheme under DC voltage application is represented by a line B in FIG. 7. Accordingly, in the cases of fur brush charging using any of the fixed-type charger and the roller-type charger, a high charging bias voltage is applied to cause a discharge phenomenon to effect the charging.

In contrast to the above-mentioned charging schemes, in a magnetic brush scheme, a charging member (magnet brush charger) obtained by constraining electroconductive magnetic particles in the form of a magnetic brush under a magnetic field exerted by a magnet roll is used as a contact charging member, and the magnetic brush in contact with a photosensitive member is supplied with a prescribed charging bias voltage to charge the photosensitive member surface to prescribed polarity and potential.

In the magnetic brush charging scheme, the above-mentioned direct injection charging scheme (2) is predominant. Uniform direct injection charging becomes possible, e.g., by using magnetic particles of 5–50 $\mu$m in particle size and providing a sufficient speed difference with the photosensitive member. An example of the charging performance according to the magnetic brush scheme under DC voltage application is represented by a line C in FIG. 7, thus allowing a charged potential almost proportional to the applied bias voltage. The magnetic brush charging scheme is however accompanied with difficulties that the device structure is liable to be complicated, and the magnetic particles constituting the magnetic brush are liable to be liberated from the magnetic brush to be attached to the photosensitive member.

Now, the application of such a contact charging scheme to a development and simultaneous cleaning method or a cleanerless image forming method as described, is considered.

The development and simultaneous cleaning method or the cleanerless image forming method does not use a cleaning member, so that the transfer residual toner particles remaining on the photosensitive member are caused to contact the contact charging system wherein the discharge charging mechanism is predominant. If an insulating toner is attached to or mixed into the contact charging member, the charging performance of the charging member is liable to be lowered.

In the charging scheme wherein the discharge charging mechanism is predominant, the lowering in charging performance is caused remarkably from a time when the toner layer attached to the contact charging member surface provides a level of resistance obstructing a discharge voltage.

On the other hand, in the charging scheme wherein the direct injection charging mechanism is predominant, the lowering in charging performance is caused as a lowering in chargeability of the member-to-be-charged due to a lowering in opportunity of contact between the contact charging member surface and the member-to-be-charged due to the attachment or mixing of the transfer residual toner particles into the contact charging member. The lowering in uniform chargeability of the photosensitive member (member-to-be-charged) results in a lowering in contrast and uniformity of latent image after imagewise exposure, and a lowering in image density and increased fog in the resultant images.

Further, in the development and simultaneous cleaning method or the cleanerless image forming method, it is important to control the charging polarity and charge of the transfer residual toner particles on the photosensitive member and stably recover the transfer residual toner particles in the developing step, thereby preventing the recovered toner from obstructing the developing performance. For this purpose, the control of the charging polarity and the charge of the transfer residual toner particles are effected by the charging member.

This is more specifically described with respect to an ordinary laser beam printer as an example.

In the case of a reversal development system using a charging member supplied with a negative voltage, a photosensitive member having a negative chargeability and a negatively charged toner, the toner image is transferred onto a recording medium in the transfer step by means of a transfer member applying a positive voltage. In this case, the transfer residual toner particles are caused to have various charges ranging from a positive polarity to a negative polarity depending on the properties (thickness, resistivity, dielectric constant, etc.) of the recording medium and the image area thereon. However, even if the transfer residual toner is caused to have a positive charge in the transfer step, the charge thereof can be uniformized to a negative polarity by the negatively charged charging member for negatively charging the photosensitive member.

As a result, in the case of a reversal development scheme, the negatively charged residual toner particles are allowed to remain on the light-part potential where the toner is to be attached, and some irregularly charged toner attached to the dark-part potential is attracted to the toner carrying member due to a developing electric field relationship during the reversal development so that the transfer residual toner at the dark-part potential is not allowed to remain thereat but can be recovered. Thus, by controlling the charging polarity of the transfer residual toner simultaneously with charging of the photosensitive member by means of the charging member, the development and simultaneous cleaning or cleanerless image forming method can be realized.

However, if the transfer residual toner particles are attached to or mixed to the contact charging member in an amount exceeding the toner charge polarity-controlling capacity of the contact charging member, the charging polarity of the transfer residual toner particles cannot be uniformized so that it becomes difficult to recover the toner particles in the developing step. Further, even if the transfer residual toner particles are recovered by a mechanical force of rubbing, they adversely affect the triboelectric chargeability of the toner on the toner-carrying member if the charge of the recovered transfer residual toner particles has not been uniformized.

Thus, in the development and simultaneous cleaning or cleanerless image forming method, the continuous image-forming performance and resultant image quality are closely associated with the charge-controllability and attachment-mixing characteristic of the transfer residual toner particles at the time of passing by the charging member.

Further, JP-A 3-103878 discloses to apply powder on a surface of a contact charging member contacting the member-to-be-charged so as to prevent charging irregularity and stabilize the uniform charging performance. This system however adopts an organization of moving a contact charging member (charging roller) following the movement of the member-to-be-charged (photosensitive member) wherein the charging principle generally relies on the discharge charging mechanism simultaneously as in the above-mentioned cases of using a charging roller while the amount of ozone adduct has been remarkably reduced than in the case of using a corona charger, such as scorotron. Particularly, as an AC-superposed DC voltage is used for accomplishing a stable charging uniformity, the amount of ozone adducts is increased thereby. As a result, in the case of a continuous use of the apparatus for a long period, the defect of image flow due to the ozone products is liable to occur. Further, in case where the above organization is adopted in the cleanerless image forming apparatus, the attachment of the powder onto the charging member is obstructed by mixing with transfer-residual toner particles, thus reducing the uniform charging effect.

Further, JP-A 5-150539 has disclosed an image forming method using a contact charging scheme wherein a developer comprising at least toner particles and electroconductive particles having an average particle size smaller than that of the toner particles is used, in order to prevent the charging obstruction due to accumulation and attachment onto the charging member surface of toner particles and silica fine particles which have not been fully removed by the action of a cleaning blade on continuation of image formation for a long period. The contact charging or proximity charging scheme used in the proposal is one relying on the discharge charging mechanism and not based on the direct injection charging mechanism so that the above problem accompanying the discharge mechanism accrues. Further, in case where the above organization is applied to a cleanerless image forming apparatus, larger amounts of electroconductive particles and toner particles are caused to pass through the charging step and have to be recovered in the developing step. No consideration on these matters or influence of such particles when such particles are recovered on the developing performance of the developer has been paid in the proposal. Further, in a case where a contact charging scheme relying on the direct injection charging scheme is adopted, the electroconductive fine particles are not supplied in a sufficient quantity to the contact charging member, so that the charging failure is liable to occur due to the influence of the transfer residual toner particles.

Further, in the proximity charging scheme, it is difficult to uniformly charge the photosensitive member in the presence of large amounts of electroconductive fine particles and transfer residual toner particles, thus failing to achieve the effect of removing the pattern of transfer residual toner particles. As a result, the transfer residual toner particles interrupt the imagewise exposure pattern light to cause a toner particle pattern ghost. Further, in the case of instantaneous power failure or paper clogging during image formation, the interior of the image forming apparatus can be remarkably soiled by the developer.

In order to improve the charge control performance when the transfer residual toner particles are passed by the charging member in the development and simultaneous cleaning method, JP-A 11-15206 has proposed to use a toner comprising toner particles containing specific carbon black and a specific azo iron compound in mixture with inorganic fine powder. Further, it has been also proposed to use a toner having a specified shape factor and an improved transferability to reduce the amount of transfer residual toner particles, thereby improving the performance of the development and simultaneous cleaning image forming method. This image forming method however relies on a contact charging scheme based on the discharge charging scheme and not on the direct injection charging scheme, so that the system is not free from the above-mentioned problems involved in the discharge charging mechanism. Further, these proposals may be effective for suppressing the charging performance of the contact charging member due to transfer residual toner particles but cannot be expected to positively enhance the charging performance.

Further, among commercially available electrophotographic printers, there is a type of development and simultaneous cleaning image forming apparatus including a roller member abutted against the photosensitive member at a position between the transfer step and the charging step so as to supplement or control the performance of recovering transfer residual toner particles in the development step. Such an image forming apparatus may exhibit a good development and simultaneous cleaning performance and remarkably reduce the waste toner amount, but liable to result in an increased production cost and a difficulty against the size reduction.

JP-A 10-307456 has disclosed an image forming apparatus adapted to a development and simultaneous cleaning image forming method based on a direct injection charging mechanism and using a developer comprising toner particles and electroconductive charging promoter particles having particle sizes smaller than ½ of the toner particle size. According to this proposal, it becomes possible to provide a development and simultaneous cleaning image forming apparatus which is free from generation of discharge product, can remarkably reduce the amount of waste toner and is advantageous for producing inexpensively a small size apparatus. By using the apparatus, it is possible to provide good images free from defects accompanying charging failure, and interruption or scattering of imagewise exposure light. However, a further improvement is desired.

Further, JP-A 10-307421 has disclosed an image forming apparatus adapted to a development and simultaneous cleaning method, based on the direct injection charging mechanism and using a developer containing electroconductive particles having sizes in a range of 1/50–½ of the toner particle size so as to improve the transfer performance.

JP-A 10-307455 discloses the use of electroconductive fine particles having a particle size of 10 nm–50 $\mu$m so as to reduce the particle size to below one pixel size and obtain a better charging uniformity. JP-A 10-307457 describes the use of electroconductive particles of at most about 5 $\mu$m, preferably 20 nm–5 $\mu$m, so as to bring a part of charging failure to a visually less recognizable state in view of visual characteristic of human eyes.

JP-A 10-307458 describes the use of electro-conductive fine powder having a particle size smaller than the toner particle size so as to prevent the obstruction of toner development and the leakage of the developing bias voltage via the electroconductive fine powder, thereby removing image defects. It is also disclosed that by setting the particle size of the electroconductive fine powder to be larger than 0.1 $\mu$m, the interruption of exposure light by the electroconductive fine powder embedded at the surface of the image-bearing member is prevented to realize excellent image formation by a development and simultaneous cleaning method based on the direct injection charging scheme. However, a further improvement is desired.

JP-A 10-307456 has disclosed a development and simultaneous cleaning image forming apparatus capable of forming without causing charging failure or interruption of imagewise exposure light, wherein electroconductive fine powder is externally added to a toner so that the electroconductive powder is attached to the image-bearing member during the developing step and allowed to remain on the image-bearing member even after the transfer step to be present at a part of contact between a flexible contact charging member and the image-bearing member.

According to these proposals, it has actually become possible to accomplish a development and simultaneous cleaning image forming method, thus allowing a cleanerless image forming system.

It is to be noted, however, that the above-proposed systems use highly electroconductive fine particles as charging promoter particles, and such a cleanerless system is realized on a precondition that the photosensitive member surface has a uniform resistivity in a specific range. However, ordinary photosensitive member surfaces generally have non-uniform resistivities to some extent and inevitably retain low-resistivity minute spots, so-called pinholes. If such a photosensitive member having surface pinholes and electroconductive fine particles are combined to achieve a contact charging scheme, an excessive current flows at the pinholes to result in image defects, which may for example appear as black spots at a relatively minor level, or result in developed toner images even at non-image parts contacting the charging member due to a charging failure on the photosensitive member because of a concentration of current for uniformly charging the photosensitive member at the pinholes in a serious case.

In contact thereto, even in the image forming system including a cleaning step after a transfer step, some portion of fine particles are inevitably caused to slip by the cleaning member to remain on the photosensitive member and be brought to an abutting position between the photosensitive member and the contact charging member, thus inevitably resulting in the above-mentioned problem. The problem is liable to be noticeably encountered particularly in a high humidity environment, but such a practical problem has not been considered in the prior art systems.

There has been also known a technique of adding metal oxide fine particles to a toner in order to suppress a change in triboelectric chargeability in the case of environmental change or the case of continuous image formation for a long period.

For example, JP-A 6-175392 has disclosed the addition of a known metal oxide (such as alumina, zinc oxide, tin oxide, etc.) having a volume resistivity of $1\times10^5$–$1\times10^8$ ohm.cm in a binder resin constituting toner particles. It has been also disclosed to externally add low-resistivity particles of a reduced product of metal oxide (JP-B 7-113781), antimony-containing tin oxide (JP-A 6-118693), or carbon black powder, or metal particles, to toner particles.

Known metal oxides, such as alumina, zinc oxide or tin oxide frequently exhibit a resistivity on the order of $1\times10^6$–$1\times10^7$ ohm.cm in a normal temperature/normal humidity environment due to superficial hydroxyl groups. However, their resistivity is liable to always change depending on environmental-humidity, so that the resultant toner is liable to have non-stable properties in some cases.

The antimony-containing tin oxide is caused to readily develop an electroconductivity through calcination in the atmospheric environment, which is free from moisture-dependent resistivity change, but the calcined product exhibits a color of blue or dark blue. As a result, if it is contained as an external additive in a toner, the tin oxide is liable to cause a lower image quality due to its color when it is separated from the toner particles and transferred to a transfer paper during the image forming step. Further, the addition thereof to a color toner is liable to cause a lowering in color reproducibility.

The reduced product of a metal oxide, such as tin oxide or titanium oxide, formed by calcining the metal oxide in a reducing atmosphere containing, e.g., hydrogen gas, so as to partially reduce the metal and develope electroconductivity, is caused to show a blakkish tint as a result of the reducive calcination treatment. Such a reduced metal oxide as well as carbon black results in a toner causing a lowering in color reproducibility or image quality similarly as the above-mentioned antimony-containing tin oxide.

Further, a low-resistivity substance, such as metal particles, is liable to cause a charge leakage in a developing step requiring a high electric field, thus lacking a stability in long-term operation.

Further, the above-mentioned fine particles have a simple or homogeneous particle structure and is liable to have a high agglomeratability and a broad particle size distribution. As a result, in order to attain objective particle size and its distribution, it becomes necessary to require not only a sophisticated particle forming and control technique but also time-consuming post-steps, such as mechanical pulverization, disintegration and classification steps. Depending on an objective particle size, it becomes difficult to achieve such a particle size by exercising a particle forming and controlling technique, and the production of small-size particles is liable to lower the efficiency of pulverization and classification in some cases due to agglomeratability of the particles, so that a limitation in improving the agglomeratability by known production processes has been noted. A toner containing such particles is liable to have a non-uniform flowability, thus posing a problem of causing a density change and image fog at the time of image formation.

Further, JP-A 8-109341, JP-A 6-192592 and JP-A 5-17622 have disclosed electroconductive pigments or fillers comprising core materials having thereon a coating layer of tin oxide doped with phosphorus, fluorine and antimony, respectively, but any of these references do not refer at all to the addition of them to a developer.

As for tungsten as an additive element, JP-A 9-278445 has disclosed tin oxide doped with tungsten, and the dispersion thereof in a binder is described to provide a paint giving an electroconductive coating film which exhibits an excellent stability of resistivity with time. No reference is made, however, to the effect of presence of fine particles comprising such tungsten-doped tin oxide on the toner particle surfaces.

SUMMARY OF THE INVENTION

An object of the present invention is to provide a toner capable of providing high-quality image regardless of environmental changes.

Another object of the present invention is to provide a toner capable of stably producing high-quality images in continuous image formation.

Another object of the present invention is to provide an image forming method capable of exhibiting an excellent image reproducibility even in a long period of operation, by including a contact charging scheme which exhibits a stable charging performance even in a high humidity environment while suppressing an excessive current at pinholes.

Another object of the present invention is to provide an image forming method wherein a transfer residual toner is well recovered to allow an efficient developing and simultaneous cleaning step.

Another object of the present invention is to provide an image forming method allowing a cleanerless image forming scheme by combining excellent charging performance and developing-and-simultaneous cleaning performance.

Still another object of the present invention is to provide a cleanerless image forming method capable of stably producing good images even in the case of using smaller-size toner particles for providing an enhanced resolution.

A further object of the present invention is to provide a cleanerless image forming method capable of stably providing good images for a long period even in a high humidity environment.

According to the present invention, there is provided a toner comprising: toner particles comprising at least a binder resin and a colorant, and fine particles; wherein the fine particles comprise a tungsten-containing tin compound coating the base particles; the fine particles contain tin (Sn) in a weight ratio (Sn/B) of 0.01 to 2.0 with respect to the base particles, and tungsten (W) is contained in a mole ratio (W/Sn) of 0.001 to 0.3 with respect to the tin (Sn).

The present invention further provides a toner comprising: toner particles comprising at least a binder resin and a colorant, and fine particles; wherein the fine particles comprise a tungsten-containing tin oxide, and tungsten (W) is contained in a mole ratio (W/Sn) of 0.001 to 0.3 with respect to the tin (Sn).

According to the present invention, there is further provided an image forming method, comprising at least:

a charging step of causing a charging member supplied with a voltage to contact an image-bearing member, thereby charging the image-bearing member;

a latent image-forming step of forming an electrostatic latent image on the charged image-bearing member;

a developing step of transferring the above-mentioned toner carried on a toner-carrying member onto the electrostatic latent image on the image-bearing member to form a toner image; and a transfer step of electrostatically transferring the toner image formed on the image bearing member onto a transfer-receiving material.

These and other objects, features and advantages of the present invention will become more apparent upon a consideration of the following description of the preferred embodiments of the present invention taken in conjunction with the accompanying drawings.

DETAILED DESCRIPTION OF THE INVENTION

Figure 1:
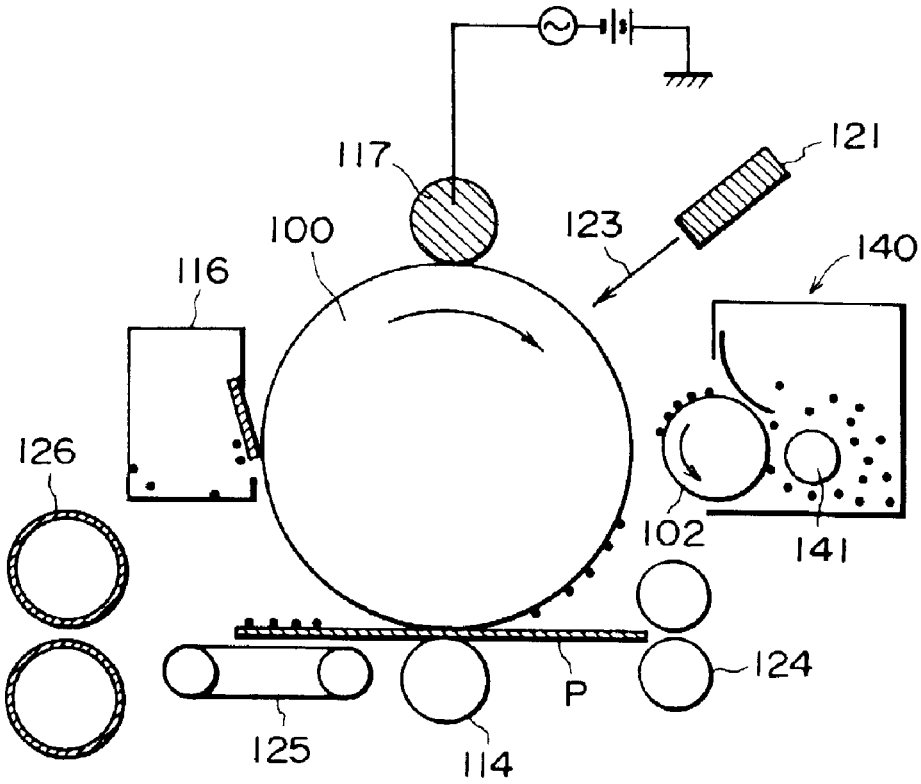
FIGS. 1, 5 and 6 respectively illustrate an image forming apparatus for practicing an embodiment of the image forming method according to the invention.

The fine particles used in the present invention include a first type and a second type.

<1> First-type Fine Particles

The first-type fine particles contained in the toner of the present invention comprise base particles and a tungsten-containing tin compound coating the base particles, the fine particles contain tin (Sn) in a weight ratio (Sn/B) of 0.01 to 2.0 with respect to the base particles, and tungsten (W) is contained in a mole ratio (W/Sn) of 0.001 to 0.3 with respect to the tin (Sn). The fine particles are white in color or have a color hue close to white. The toner of the present invention containing the fine particles is provided with a uniform triboelectric chargeability for a long period, thus providing good images. Particularly, it is possible to prevent an excessive charge due to an abnormal triboelectric charging in a low humidity environment, and prevent a lowering in triboelectric chargeability in a high humidity environment, thus providing a stable triboelectric chargeability. Within an extent of not impairing the triboelectric chargeability stability, another element can also be incorporated.

The first-type fine particles have a two-layer structure comprising base particles coated with a tungsten-containing tin compound, preferably tin oxide, and the toner of the present invention containing the fine particles can be uniformly prepared to have an excellent flowability, so that the toner can acquire a stable charge quickly in response to an abrupt environmental change or after standing for a long period, thus continually providing high image quality.

The first-type fine particles comprise a tin compound, preferably tin oxide, well carried on the mother or base particles, thus showing little change in particle property since the coating is less liable to peel off even in a long term of use.

The first-type fine particles are provided with a moderate electroconductivity because of the tin compound contained in a proportion providing a weight ratio (Sn/B) of 0.01 to 2.0 between tin (Sn, as element) and the base particles (B). By the presence of the fine particles between the charging member and the image-bearing member, a current flows via the tin compound at the time of voltage application in the charging step. As the amount of the tin compound is specified relative to the base particles, a large current is less liable to flow, and an excellent current flow can be suppressed even at surface pinholes on the image-bearing member, thus suppressing the occurrence of image defects. Further, because of the tin compound content, the fine particles have a relatively low resistivity, and the toner charge uniformity can be remarkably improved in the case of a charging step using an ordinary range of current.

In case where the ratio Sn/B is below 0.01, the triboelectric chargeability of the toner is liable to change in response to environmental changes. For the easiness of production, an Sn/B ratio of at most 2.0 is preferred, and an Sn/B ratio exceeding 2.0 is liable to lower the flowability-improving effect.

Further, by controlling the mole ratio W/Sn within the range of 0.001 to 0.3 between tungsten (W, as element) and tin (Sn, as element), a large current is less liable flow to provide a better excessive current suppression effect. If the W/Sn mole ratio is below 0.001, the triboelectric chargeability can fluctuate in response to environmental changes, and in excess of 0.3, the mechanical strength of the tin compound is lowered to fail in providing sufficient durability in some cases.

The content of tin and tungsten in the fine particles can be analyzed and measured by ICP (inductively coupled plasma) emission spectroscopy or ESCA (electron spectroscopy for chemical analysis).

More specifically, the fine particles comprising the tungsten-containing tin compound-coated base particles may be analyzed in the following manner.

a) In Case where the Base Particles are Insoluble in Both Acid and Alkali:

First, the fine particles are subjected to ESCA analysis to determine a ratio between tin (Sn) and tungsten (W) in the coating layer. Next, some fine particles are weighed and then subjected to successive treatment with an acid and then with an alkali to remove the coating layer to weigh the base particles alone. Thus, the weight of the coating layer is determined as a difference between the weights of the fine particles before and after the acid and alkali treatment. From the weight of the coating layer and the above-mentioned (W/Sn) mole ratio according to the ESCA analysis, the weight of Sn and a weight ratio (Sn/B) of tin (Sn) to the base particles (B) are calculated.

b) In Case where the Base Particles are Soluble in Acid or Alkali:

First, the fine particles are subjected to ESCA analysis to determine a ratio (W/Sn) between tungsten (W) and tin (Sn) in the coating layer. Then, while using a solution having a controlled pH, the base particles are dissolved together with Sn or W, and the resultant solution is subjected to an ICP-AES (ICP-analytical emission spectrometer) to measure mol-basis contents of the Sn or W and other elements in the base particles to determine the mole ratios among these elements. From these mole ratios, the weight ratio (Sn/B) between the tin (Sn) and the base particles (B) is determined.

Further, by ESCA analysis of the fine particles, the contents of tin, tungsten and other elements contained in the base particles can be measured at varying etching times, whereby it is possible to confirm the co-presence of W and Sn and selective presence of W and Sn at the surface of the base particles.

On the other hand, in the case of the fine particles comprising the tungsten-containing tin oxide particles (the second-type fine particles described hereinafter), a solution of the fine particles is subjected to the ICP-AES analysis to measure the amounts of the respective components, from which a ratio (W/Sn) can be determined.

The tin compound may preferably be tin oxide in order to provide a low resistivity to the fine particles. The tungsten (element) may preferably be contained in the tin compound so as to control the current flow through the low-resistivity tin compound.

By surface-coating the base particles with the tin compound, it becomes possible to develop an electroconductivity and a uniform chargeability at a relatively small amount of the tin compound. Further, the current flow only through the surface of the particles allows easy suppression of excessive current flow and the occurrence of image defects due to the pinholes.

The fine particles coated with the tungsten-containing tin compound may be produced through a wet process, e.g., in the following manner.

For example, a tin (salt) compound solution and a tungsten (salt) compound are added to a dispersion liquid of base particles and hydrolyzed, followed by calcination of the product. Alternatively, a tin compound alone may carried on the base particles in the above-described manner, followed by calcination, and the calcined product is again impregnated with a tungsten component through a wet process, followed by calcination. The calcined product may then be disintegrated and classified to provide the fine particles.

Examples of the tin(-containing or -source) compound for providing the fine particles may include: tin (II, IV) chloride, tin oxychloride, stannic acid, potassium stannate, and organic tin compounds, such as tin alkoxides.

Examples of the tungsten (-containing or -source) compound for providing the fine particles may include: tungsten chloride, tungsten oxychloride, tungstic acid, sodium tungstate, potassium tungstate, calcium tungstate, and organic tungsten compounds.

The calcination may be effected by using, e.g., a tunnel kiln, a rotary kiln, an electric furnace, a muffle furnace, and a reduced pressure drier. The calcination atmosphere may include: the atmosphere, and also an oxidizing atmosphere of which the oxygen partial pressure is controlled as desired, a reducing atmosphere containing, e.g., hydrogen, and an inert atmosphere containing an inert gas.

The base particles carrying the tin compound may comprise known particles, inclusive of organic particles formed of resins, and inorganic particles formed of metals or metal oxides. Among these, inorganic particles are preferred, and oxygen-containing metal compounds, such as metal oxides, are further preferred, in view of strength against a stress at an abutting position between the charging member and the image-bearing member, and an adherence of the tin compound at the base particle surfaces. Specific examples thereof may include: silicon oxide, titanium oxide, alumina, aluminum silicate, magnesium oxide, barium sulfate, and titanate compounds.

<2> Second-type Fine Particles

The second-type fine particles contained in the toner of the present invention comprise tungsten-containing tin oxide fine particles. The tin oxide fine particles are white in color or have a color hue close to white, thus being little liable to obstruct the toner color hue or lower the image quality. Further, the fine particles have a high resistance to moisture absorption and can suppress the resistivity change in response to environmental humidity changes. As a result, the fine particles can exhibit stable resistivity and triboelectric charge-imparting ability even at environmental changes. Owing to these functions of the tungsten-containing tin oxide fine particles, the toner of the present invention can be provided with a sharp and uniform triboelectric charge distribution for a long period. Particularly, it is possible to prevent an excessive charge due to an abnormal triboelectric charging in a low humidity environment, and prevent a lowering in triboelectric chargeability in a high humidity environment, thus providing a stable triboelectric chargeability. Within an extent of not impairing the triboelectric chargeability stability, another element can also be incorporated.

The tin oxide fine particles contain tungsten (W, as element) in a mole ratio (W/Sn) of 0.001 to 0.3 with respect to tin (Sn, as element). If the mole ratio (W/Sn) is below 0.001, the triboelectric charge-imparting ability is liable to be lowered at the time of an abrupt environmental change. In excess of 0.3, the mechanical strength of the tin oxide particles is lowered to fail in providing sufficient durability in some cases.

The contents of tin and tungsten in the fine particles can be measured in the same manner as in the first-type fine particles.

The tungsten-containing tin oxide fine particles may be produced through, e.g., a process wherein a tin (salt) compound solution and a tungsten (salt) compound solution are blended and hydrolyzed, followed by calcination; or a process wherein a tungsten (salt) compound solution is added to an aqueous slurry of tin oxide, and the mixture is aged while hydrolyzing the tungsten (salt) compound, followed by calcination of the product. The calcined product may then be disintegrated and classified to provide tungsten-containing tin oxide fine particles.

Examples of the tin(-containing or -source) compound for providing the tungsten-containing tin oxide fine particles may include: tin (II, IV) chloride, tin oxychloride, stannic acid, potassium stannate, and organic tin compounds, such as tin alkoxides.

Examples of the tungsten (-containing or -source) compound for providing the tungsten-containing tin oxide fine particles may include: tungsten chloride, tungsten oxychloride, tungstic acid, sodium tungstate, potassium tungstate, calcium tungstate, and organic tungsten compounds.

The calcination may be effected by using, e.g., a tunnel kiln, a rotary kiln, an electric furnace, a muffle furnace, and a reduced pressure drier. The calcination atmosphere may include: the atmosphere, and also an oxidizing atmosphere of which the oxygen partial pressure is controlled as desired, a reducing atmosphere containing, e.g., hydrogen, and an inert atmosphere containing an inert gas.

Some common features of the first-type and the second-type fine particles are supplemented below.

The fine particles may preferably have a resistivity of at most $1\times10^9$ ohm.cm. If the fine particles have a resistivity exceeding $1\times10^9$ ohm.cm, when used in an image forming method including a developing-cleaning step, the effect of promoting the uniform chargeability of the image-bearing member becomes small, even if the fine particles are present at the contact position between the charging member and the image-bearing member or in the charging region in the vicinity thereof so as to retain an intimate contact via the fine particles between the contact charging member and the image-bearing member. In order to sufficiently attain the effect of promoting the chargeability of the image-bearing member owing to the fine particles, thereby stably accomplishing good uniform chargeability of the image-bearing member, it is preferred that the fine particles have a resistivity lower than the resistivity at the surface or at contact part with the image-bearing member of the contact charging member. At a resistivity above $1\times10^9$ ohm.cm, the resistivity change in response to a humidity change is liable to increase. It is further preferred that the fine particles have a resistivity of $1\times10^2$ to $1\times10^9$ ohm.cm, more preferably $1\times10^2$ to $1\times10^7$ ohm.cm. Fine particles having a resistivity below $1\times10^2$ ohm.cm is liable to have inferior whiteness in color through the production.

For the resistivity control within the above range, tungsten is selected in the present invention as a penta-valent element, i.e., an element having a valence of 5 different from a valence of 4 of tin oxide which is a tetra-valent metal oxide, and used in an appropriate amount.

The resistivity of the fine particles may be measured in the following manner. That is, ca. 0.5 g of sample fine particles are placed in a cylinder and sandwiched in a thickness of M (cm) between an upper and a lower electrode each having an area S of, e.g., 2.26 $cm^2$ under a load of 7 $kg.f/cm^2$. In this state, a voltage of 50 volts is applied between the electrodes to measure a current I (A) flowing at that time. The resistivity Rv (ohm.cm) of the sample fine particles may be calculated according to the following formula:

$$Rv\ (\text{ohm.cm})=V\times S/I/M.$$

The fine particles may preferably have a volume-average particle size of at least 0.05 $\mu$m. Below 0.05 $\mu$m, the content of the fine particles in the entire toner has to be reduced in order to prevent a lowering in developing performance. This makes it difficult to ensure a sufficient amount of the fine particles in a charging section formed at a contact position between the charging member and the image-bearing member and proximity thereto for overcoming the charging obstruction by the transfer residual toner attached to or mixed with the contact charging member to improve the chargeability of the image-bearing member, thus being liable to cause charging failure.

On the other hand, if the fine particles have too large a volume-average particle size, the fine particles are liable to fall off the charging member and the number of particles thereof per unit weight is reduced, and further reduced by falling from the charging member, so that a larger amount of fine particles has to be contained in the toner so as to continually supply the fine particles to the charging section for maintaining intimate contact via the fine particles between the contact charging member and the image-bearing member. However, if the content of the fine particles is increased, the chargeability of the entire toner is liable to be lowered, particularly in a high humidity environment, thus being liable to cause image density lowering and toner scattering due to a lower developing performance. From these viewpoints, it is preferred that the fine particles have a volume-average particle size of at most 5 μm, more preferably 0.1–5 μm, further preferably 0.5–3 μm and has a particle size distribution such that particles of 5 μm or larger occupy at most 3% by number.

It is preferred that the fine particles have a volume-average particle size S (μm) giving a ratio (S/T) of at most 0.5, more preferably 0.01 to 0.3, with respect to the weight-average particle size T (μm) of toner particles. If the ratio (S/T) is above 0.5, the fine particles in mixture with the toner particles are liable to be present in isolation from the toner particles, so that the supply of the toner particles from the developer vessel to the image-bearing member in the developing step is liable to be insufficient, to fail in providing a sufficient charging performance. Further, a portion of the fine particles falling off the charging member is liable to obstruct or diffuse exposure light for writing in an electrostatic latent image, thus resulting in latent image defects and lower image quality.

Incidentally, in the above, unit of volume-average particle size (S) is used for the fine particles as different from the weight-average particle size (T) of the toner particles, because of a smaller particle size of the fine particles, but a ratio (S/T) can still provide a measure of relative particle sizes of the fine particles and the toner particles.

The particle size of the fine particles described herein are based on values measured in the following manner. A laser diffraction-type particle size distribution measurement apparatus ("Model LS-230", available from Coulter Electronics Inc.) is equipped with a liquid module, and the measurement is performed in a particle size range of 0.04–2000 μm to obtain a volume-basis particle size distribution. For the measurement, a minor amount of surfactant is added to 10 cc of pure water and 10 mg of sample fine particles are added thereto, followed by 10 min. of dispersion by means of an ultrasonic disperser (ultrasonic homogenizer) to obtain a sample dispersion liquid, which is subjected to a single time of measurement for 90 sec.

It is preferred that the fine particle are partly isolated from the toner particles so as to show an isolation percentage of 10.0–95.0%, more preferably 20.0–95.0%. An isolation percentage of below 10.0% results in a shortage of supply of the fine particles to the image-bearing member, thus failing to provide a sufficient charging performance. Above 95.0%, the amount of fine particles recovered in the developing-cleaning step is increased to result in accumulation of the fine particle in the developing device, thus lowering the triboelectric chargeability and developing performance of the toner.

The isolation percentage of fine particles isolated from toner particles described herein is based on values measured by using a particle image analyzer ("PT1000", made by Yokogawa Denki K.K.) according to a principle described in "Japan Hardcopy '97 Paper Collection", pp. 65–68. More specifically, in the apparatus, fine particles like toner particles are introduced into plasma, particle by particle, to cause luminescence, thereby determining an element, a number and a diameter of luminescent particles from their luminescence spectrum.

The isolation percentage is determined according to the following formula based on the simultaneity of luminescence of carbon atom (C) constituting the toner binder resin and luminescence of tin atom (Sn).

Isolation percentage of fine particles (%)=100×(number of luminescences of Sn alone)/(number of luminescences of Sn simultaneous with luminescence of C+number of luminescences of Sn alone) In this instance, the luminescence of Sn within 2.6 msec from the luminescence of C is regarded as simultaneous luminescence as that of C, and the luminescence of Sn thereafter is regarded as the luminescence of Sn alone.

More specifically, for the measurement, a sample toner left standing overnight in an environment of 23° C. and 60% RH is subjected to measurement together with 0.1% $O_2$-containing helium gas in the above environment. For spectrum separation, Channel 1 detector is used for carbon atom and Channel 2 detector is used for tin atom (with recommended values of wavelengths and K factors). Sampling is performed at a rate of one scan for covering 1000–1400 times of luminescence of carbon atom, and the sampling is repeated until the luminescences of carbon atom reaches at least 10,000 times. By integrating the luminescences, a particle size distribution curve is drawn with the number of luminescences taken on the ordinate and with the cube root of voltage representing a particle size on the abscissa. In order to ensure the accuracy of measurement, it is important to effect the sampling and measurement so that the particle size distribution curve exhibits a single peak and no valley. The noise cut level during the measurement is taken at 1.50 volts, and the isolation percentage (%) of fine particles is calculated according to the above formula.

It is also preferred that the fine particles are transparent, white or only pale-colored, so that they are not noticeable as fog even when transferred onto the transfer material. This is also preferred so as to prevent the obstruction of exposure light in the latent image-step. It is preferred that the the fine particles show a transmittance of at least 30%, with respect to imagewise exposure light used for latent image formation, as measured in the following manner.

A sample of fine particles is attached onto an adhesive layer of a one-side adhesive plastic film to form a mono-particle densest layer. Light flux for measurement is incident vertically to the particle layer, and light transmitted through to the backside is condensed to measure the transmitted quantity. A ratio of the transmitted light to a transmitted light quantity through an adhesive plastic film alone is measured as a net transmittance. The light quantity measurement may be performed by using a transmission-type densitometer (e.g., "310T", available from X-Rite K.K.).

In the present invention, the fine particles may be incorporated in the toner by way of internal addition or external addition. For quickly and effectively achieving the intended function of the present invention, the fine particles may preferably be present at the toner particle surfaces. For providing the surface attachment state, the external addition allowing an easy control is preferred, but it is also possible to effect the internal addition, followed by pulverization or abrasion to mechanically expose the fine particles at the resultant toner particle surfaces.

The fine particles may preferably be present at the toner particle surface at a rate of at least 0.3 particle, more preferably 1.0 to 50 particles, particularly preferably 1.0 to 10 particles, per one toner particle. Below 0.3 particle, the flowability-improving effect is liable to be lowered.

The presence or absence, and the rate of presence of fine particles on the toner particle surfaces may be confirmed by direct observation of toner particle surfaces. More specifically, a toner sample containing fine particles is observed through a scanning electron microscope (SEM) to capture 10 groups each containing 10 toner particles, and the number of fine particles present on the toner particle surfaces is counted for each group while identifying tin elements by mapping by means of an elementary analyzer attached to the SEM. The counting is performed for the 10 toner particle groups (containing totally 100 toner particles) to calculate a rate of fine particles present at one toner particle surface.

Incidentally, as mentioned above, JP-A 9-278445 has disclosed electroconductive tin oxide containing tungsten as a dopant together with its production process and use in an electroconductive paint or as an antistatic agent while noting its electroconductivity. However, the reference fails to teach or suggest the use thereof together with other toner ingredients as a contact charger operating while suppressing an excessive current flow as in the present invention.

Further, JP-A 6-183733 has disclosed an antimony-containing electroconductive tin oxide powder also containing tungsten (W), but the tin content therein is different from that in the fine particles of the present invention. Moreover, the suppression of excessive current flow intended by the present invention is difficult to achieve by using such tin oxide particles containing antimony (Sb) as an essential component.

<3> Toner (Particles)

The toner particles constituting the toner of the present invention may preferably have a weight-average particle size of 3–10 μm, for faithful development of more minute latent image dots to provide a higher image quality. A toner having a weight-average particle size of below 3 μm shows a lower transferability and is thus liable to result in an increased amount of transfer-residual toner, so that it is liable to soil the charging member when used in the contact charging step. Such minute toner particles are also liable to obstruct the charging promoter effect of the fine particles at the contact position between the charging member and the image-bearing member. Further, as the surface of the entire toner is increased, the toner is caused to have a lower flowability and powder mixability, so that it becomes difficult to uniformly triboelectrically charge the individual toner particles, thus resulting in increased fog and inferior transferability. On the other hand, if the toner particles have a weight-average particle size in excess of 10 μm, the resultant character or line images are liable to be accompanied with scattering, so that it is difficult to obtain a high resolution. For a higher resolution apparatus, such a toner can result in an inferior dot reproducibility and is liable to agglomerate in a low humidity environment.

The weight-average and number-average particle sizes of toner particles may be measured by using, e.g., COULTER COUNTER Model TA-II or COULTER MULTICIZER (respectively available from Coulter Electronics, Inc.). Herein, these values are determined based on values measured by using COULTER MULTICIZER connected to an interface (made by Nikkaki K.K.) and a personal computer ("PC9801", made by NEC K.K.) for providing a number-basis distribution and a volume-basis distribution in the following manner. A 1%-aqueous solution is prepared as an electrolytic solution by sing a reagent-grade sodium chloride (it is also possible to use ISOTON R-II (available from Coulter Scientific Japan K.K.)). For the measurement, 0.1 to 5 ml of a surfactant, preferably a solution of an alkylbenzenesulfonic acid salt, is added as dispersant into 100 to 150 ml of the electrolytic solution, and 2–20 mg of a sample toner is added thereto. The resultant dispersion of the sample in the electrolytic solution is subjected to a dispersion treatment for ca. 1–3 minutes by means of an ultrasonic disperser, and then subjected to measurement of particle size distribution in the range of 2.00–40.30 μm divided into 13 channels by using the above-mentioned COULTER COUNTER with a 100 μm-aperture to obtain a volume-basis distribution and a number-basis distribution. From the volume-basis distribution, a weight-average particle size (D4) is calculated by using a central value as a representative value channel. From the number-basis distribution, a number-average particle size (D1) is calculated.

The particle size range of 2.00–40.30 μm is divided into 13 channels of 2.00–2.52 μm; 2.52–3.17 μm; 3.17–4.00 μm; 4.00–5.04 μm; 5.04–6.35 μm; 6.35–8.00 μm; 8.00–10.08 μm; 10.08–12.70 μm; 12.70–16.00 μm; 16.00–20.20 μm; 20.20–25.40 μm; 25.40–32.00 μm and 32.00–40.30 μm (each channel not including the upper limit).

The toner of the present invention may preferably contain inorganic fine powder as described below in addition to the above-mentioned toner particles.

More specifically, the toner of the present invention may preferably contain inorganic fine powder having an average primary particle size of 4–80 μm as a flowability-improving agent and also as a transfer aid. The inorganic fine powder is added for improving the flowability, the uniform triboelectric chargeability, the uniform triboelectric chargeability and the transferability of the toner. It is also preferred to adjust the triboelectric chargeability and improve the environmental stability as by a hydrophobization treatment of the inorganic fine powder.

In a case where the inorganic fine powder has an average primary particle size exceeding 80 nm or such inorganic fine powder of 80 nm or smaller is not added, the transfer residual toner is increased, so that it becomes difficult to stably attain good charging performance. Further, good toner flowability cannot be attained to result in non-uniformly charged toner particles, so that it becomes difficult to obviate the problems of increased fog, image density lowering and toner scattering. Inorganic fine powder having an average primary particle size of below 4 nm exhibits an enhanced agglomeratability, thus being liable to behave not as primary particles but as agglomerates which cannot be easily disintegrated and exhibits a broad particle size distribution, and resulting in image defects due to development with the agglomerates, and damages of the image-bearing member and the toner-carrying member. In order to provide a more uniform triboelectric charge distribution of toner particles, it is further preferred that the inorganic fine powder has an average primary particle size of 6–70 nm.

The average primary particle size of such inorganic fine powder may be determined based on enlarged photographs taken through a scanning electron microscope (SEM) of toner particles in parallel with photographs of the toner particles mapped with elements contained in the inorganic fine powder by means of an elementary analyzer such as an X-ray microanalyzer (XMA). By measuring the particle sizes of at least 10 primary particles of the inorganic fine powder attached onto or isolated from the toner particle surfaces, it is possible to obtain a number-average primary particle size of the inorganic fine powder.

The inorganic fine powder may for example comprise silica, titanium oxide, alumina or a complex oxide of these. For example, it is preferred to contain silica fine powder.

As the silica or silicic acid fine powder, it is possible to use both the dry-process silica (or fumed silica) formed by vapor phase oxidation of a silicon halide and the wet-process silica formed from water glass. It is however preferred to use the dry-process silica in view of less superficial or internal silanol groups and less production residue. As for a complex metal oxide, another metal halide, such as aluminum chloride or titanium chloride, may be used in combination with a silicon-halide in the dry-process silica production to obtain complex powder of silica and another metal oxide.

Such inorganic fine powder having an average primary particle size of 4–80 nm may preferably be added in 0.01–8 wt. parts, more preferably 0.1–3.0 wt. parts, per 100 wt. parts of the toner particles. Below 0.01 wt. part, the addition effect is insufficient, and in excess of 8.0 wt. parts, the resultant toner is liable to have inferior fixability.

It is preferred that the inorganic fine powder has been hydrophobized so as to exhibit a hydrophobicity in a range of 30–80 as measured by the methanol titration test in view of performances in a high temperature/high humidity environment. If the inorganic fine powder blended with toner particles absorbs moisture, the triboelectric chargeability of the toner is remarkably lowered, thus being liable to cause toner scattering.

Examples of such hydrophobization treating agents may include: silicone varnish, various modified silicone varnish, silicone oil, various modified silicone oil, silane compounds, silane coupling agents, and further other organosilicon compounds and organotitanium compounds.

Specific examples of the treating agent may include: hexamethyldisilazane, trimethylsilane, trimethylchlorosilane, trimethylethoxysilane, dimethyldichlorosilane, methyltrichlorosilane, allyldimethylchlorosilane, allylphenyldichlorosilane, benzyldimethylchlorosilane, bromomethyldimethylchlorosilane, α-chloroethyltrichlorosilane, β-chloroethyltrichlorosilane, chloromethyldimethylchlorosilane, triorganosilylmercaptans such as trimethylsilylmercaptan, triorganosilyl acrylates, vinyldimethylacetoxysilane, dimethylethoxysilane, dimethyldimethoxysilane, diphenyldiethoxysilane, hexamethyldisiloxane, 1,3-divinyltetramethyldisiloxane, 1,3-diphenyltetramethyldisiloxane, and dimethylpolysiloxanes having 2 to 12 siloxane units per molecule and containing each one hydroxyl group bonded to Si at the terminal units; dimethylsilicone oil, methylphenylsilicone oil, α-methylstyrene-modified silicone oil, chlorophenylsilicone oil, and fluorine-containing silicone oil. These agents may be used singly or in combination of two or more species.

Among the above, the treatment with silicone oil is preferred. It is particularly preferred to hydrophobize inorganic fine powder with silicone oil simultaneously with or after treatment with a silane compound, etc., so as to retain a high toner chargeability and prevent toner scattering even in a high humidity environment.

More specifically, in such a combined treatment, the inorganic fine powder is first silylated a silane compound, etc. to remove the silanol groups and then coated with a thin hydrophobic film of silicone oil.

Silicone oil used for the above purpose may preferably have a viscosity at 25° C. of 10–200,000 $mm^2/s$, more preferably 3,000–80,000 $mm^2/s$. Below 10 $mm^2/s$, the treated inorganic fine powder is liable to lack stability and result in a toner providing inferior image quality when subjected to a thermal or mechanical stress. Above 200,000 $mm^2/s$, a uniform treatment with the silicone oil is liable to be difficult.

Treatment with silicone oil may be performed by, e.g., direct blending with silicone oil of inorganic fine powder already treated with a silane compound by a blender, such as a HENSCHEL MIXER; spraying silicone oil onto inorganic fine powder or blending of inorganic fine powder with silicone oil dissolved or disposed in an appropriate solvent, followed by removal of the solvent. The use of a sprayer is preferred in view of formation of relatively less agglomerates of the inorganic fine powder.

The inorganic fine powder may preferably be treated with 1–23 wt. parts, more preferably 5–20 wt. parts, of silicone oil per 100 wt. parts thereof. Too small an silicone oil amount is liable to fail in providing a sufficient hydrophobicity, and excessive silicone oil is liable to result in a toner causing fog.

The inorganic fine powder used in the present invention may preferably have a specific surface area ($S_{BET}$) of at least 30 $m^2/g$, more preferably at least 50 $m^2/g$, further preferably 50–250 $m^2/g$, as measured by nitrogen adsorption according to the BET multi-point by means of a specific surface area meter (e.g., "AUTOSORB 1", made by Yuasa Ionics K.K.).

The toner particles constituting the toner of the present invention may be either magnetic or nonmagnetic. In the case of a magnetic toner, it is preferred that the toner particles have an average circularity (Cav) of at least 0.970 and the toner has a magnetization of 10–50 $Am^2/kg$ (emu/g) as measured at a magnetic field of 79.6 kA/m (1000 oersted), so as to reduce the transfer residual toner and fog and retain a good chargeability.

In the case of using magnetic toner particles in the image forming method of the present invention, the fine particles may preferably be nonmagnetic since the fine particles are expected to fly onto the image-bearing member together with the toner particles. If the fine particles are magnetic, they cannot be readily transferred by flying from the toner-carrying member used in the magnetic mono-component developing method.

The average circularity (Cav) is used as a quantitative measure for evaluating particle shapes and based on values measured by using a flow-type particle image analyzer ("FPIA-1000", mfd. by Toa Iyou Denshi K.K.). A circularity (Ci) of each individual particle (having a circle equivalent diameter ($D_{CE}$) of at least 3.0 μm) is determined according to an equation (1) below, and the circularity values (Ci) are totaled and divided by the number of total particles (m) to determine an average circularity (Cav) as shown in an equation (2) below:

$$\text{Circularity } Ci = L_0/L, \tag{1}$$

wherein L denotes a circumferential length of a particle projection image, and $L_0$ denotes a circumferential length of a circle having an area identical to that of the particle projection image.

$$\text{Average circularity(Cav)} = \sum_{i=1}^{m} Ci/m \tag{2}$$

Incidentally, for actual calculation of an average circularity (Cav), the measured circularity values (Ci) of the individual particles were divided into 61 classes in the circularity range of 0.40–1.00, i.e., from 0.400–0.410, 0.410–0.420, . . . , 0.990–1.000 (for each range, the upper limit is not included) and 1.000, and a central value of circularity of each class was multiplied with the frequency of particles of the class to provide a product, which was then summed up to provide an average circularity. It has been confirmed that the thus-calculated average circularity (Cav) is substantially identical to an average circularity value obtained (according to Equation (2) above) as an arithmetic mean of circularity values (Ci) directly measured for individual particles without the above-mentioned classification adopted for the convenience of data processing, e.g., for shortening the calculation time.

More specifically, the above-mentioned FPIA measurement is performed in the following manner. Into 10 ml of water containing ca. 0.1 mg of surfactant, ca. 5 mg of magnetic toner sample is dispersed and subjected to 5 min. of dispersion by application of ultrasonic wave (20 kHz, 50 W), to form a sample dispersion liquid containing 5,000–20,000 particles/$\mu$l. The sample dispersion liquid is subjected to the FPIA analysis for measurement of the average circularity (Cav) with respect to particles having $D_{CE} \geqq 3.0$ $\mu$m.

The average circularity (Cav) used herein is a measure of roundness, a circularity of 1.00 means that the magnetic toner particles have a shape of a perfect sphere, and a lower circularity represents a complex particle shape of the toner.

In the above FPIA measurement, only the particles having a circle-equivalent diameter ($D_{CE}$) of at least 3.0 $\mu$m are subjected to the circularity measurement. This is because the particles having $D_{CE}<3$ $\mu$m may include a substantial proportion of external additive particles such as the tungsten-containing tin oxide fine particles and the inorganic fine powder in addition to the toner particles, which can disturb the measurement of toner particle circularity. The magnetization values described herein are based on values measured by using an oscillation-type magnetometer ("VSMP-1–10", made by Toei Kogyo K.K.) under an external field of 79.6 kA/m at room temperature (25° C.).

The toner of the present invention may be produced through the pulverization process or the polymerization process.

First, the production through the pulverization process is described.

Toner ingredients, inclusive of a binder resin, a colorant (which can be a magnetic material), and optionally, a release agent, a charge control agent and other additives (possibly including the above-mentioned fine particles, are sufficiently blended by means of a blender, such as a HENSCHEL MIXER or a ball mill, and melt-kneaded by a hot kneading machine, such as hot rollers, a kneader or an extruder. After being cooled, the melt-kneaded product is pulverized, classified and optionally surface-treated to provide toner particles. The resultant toner particles may be blended with the above-mentioned fine particles, inorganic fine powder, etc., to obtain a toner. The classification and the surface treatment may be performed in this order or in a reverse order. In the classification step, it is preferred to use a multi-division classifier in view of the production efficiency. The pulverization may be performed by a known pulverizer of the mechanical impact-type, the jetting-type, etc.

Examples of the binder resin used for producing toner particles through the pulverization process may include: homopolymers of styrene and its substitution derivatives, such as polystyrene, poly-p-chlorostyrene and polyvinyltoluene; styrene copolymers, such as styrene-p-chlorostyrene copolymer, styrene-vinyltoluene copolymer, styrene-vinylnaphthalene copolymer, styrene-acrylate copolymer, styrene-methacrylate copolymer, styrene-$\alpha$-chloromethacrylate copolymer, styrene-acrylonitrile copolymer, styrene-vinyl methyl ether copolymer, styrene-vinyl ethyl ether copolymer, styrene-vinyl methyl ketone copolymer, styrene-butadiene copolymer, styrene-isoprene copolymer, and styrene-acrylonitrile-indene copolymer; polyvinyl chloride, phenolic resin, natural resin-modified phenolic resin, acrylic resin, methacrylate resin, polyvinyl acetate, silicone resin, polyester resin, polyurethane, polyamide resin, furan resin, epoxy resin, xylene resin, polyvinyl butyral, terpen resin, coumaron-indene resin, and petroleum resin.

In the case of using a styrene copolymer as a binder resin, the styrene copolymer can include a crosslinking structure obtained by using a crosslinking monomer, examples of which are enumerated hereinbelow. Aromatic divinyl compounds, such as divinylbenzene and divinylnaphthalene; diacrylate compounds connected with an alkyl chain, such as ethylene glycol diacrylate, 1,3-butylene glycol diacrylate, 1,4-butanediol diacrylate, 1,5-pentanediol diacrylate, 1,6-hexanediol diacrylate, and neopentyl glycol diacrylate, and compounds obtained by substituting methacrylate groups for the acrylate groups in the above compounds; diacrylate compounds connected with an alkyl chain including an ether bond, such as diethylene glycol diacrylate, triethylene glycol diacrylate, tetraethylene glycol diacrylate, polyethylene glycol #400 diacrylate, polyethylene glycol #600 diacrylate, dipropylene glycol diacrylate and compounds obtained by substituting methacrylate groups for the acrylate groups in the above compounds; diacrylate compounds connected with a chain including an aromatic group and an ether bond, such as polyoxyethylene (2)-2,2-bis(4-hydroxyphenyl)propanediacrylate, polyoxyethylene(4)-2,2-bis(4-hydroxyphenyl)-propanediacrylate, and compounds obtained by substituting methacrylate groups for the acrylate groups in the above compounds; and polyester-type diacrylate compounds, such as one known by a trade name of MANDA (available from Nihon Kayaku K.K.). Polyfunctional crosslinking agents, such as pentaerythritol triacrylate, trimethylolethane triacrylate, trimethylolpropane triacrylate, tetramethylolmethane tetracrylate, oligoester acrylate, and compounds obtained by substituting methacrylate groups for the acrylate groups in the above compounds; triallyl cyanurate and triallyl trimellitate.

Such a crosslinking agent may be used in an amount of 0.01–10 wt. parts, preferably 0.03–5 wt. parts, of the other monomers for constituting the vinyl resin or vinyl polymer unit.

Among the crosslinking monomers, aromatic divinyl compounds, particularly divinylbenzene, and diacrylate compounds bonded by a chain including an aromatic group and an ether bond, are particularly preferred in order to provide the resultant polymer with good fixability and anti-offset performances.

Styrene copolymers may be synthesized by, e.g., bulk pulverization, solution polymerization, suspension polymerization or emulsion polymerization.

In the case of using a polyester resin as a binder resin, the polyester resin may preferably comprise 45–55 mol. % of alcohol component and 55–45 mol. % of acid component.

Examples of the alcohol component may include: ethylene glycol, propylene glycol, 1,3-butanediol, 1,4-butanediol, 2,3-butanediol, diethylene glycol, triethylene glycol, 1,5-pentanediol, 1,6-hexanediol, neopentyl glycol, 2-ethyl-1,3-hexanediol, hydrogenated bisphenol A, bisphenol derivatives, and polyhydric alcohols, such as glycerin, sorbit and sorbitane.

Examples of dibasic carboxylic acid occupying at least 50 mol. % of the total acid component may include: benzenedicarboxylic acids and anhydrides thereof, such as phthalic acid, terephthalic acid, isophthalic acid and phthalic anhydride; alkyldicarboxylic acids, such as succinic acid, adipic acid, sebacic acid and azelaic acid, and their anhydrides; $C_6$–$C_{18}$ alkyl or alkenyl-substituted succinic acids, and their anhydrides; and unsaturated dicarboxylic acids, such as fumaric acid, maleic acid, citraconic acid and itaconic acid, and their anhydrides. Further, carboxylic acids having 3 or more carboxylic groups may include: trimellitic acid, pyromellitic acid, benzophenonetetracarboxylic acid and their anhydrides.

An especially preferred class of alcohol components constituting the polyester resin is a bisphenol derivative, and preferred examples of acid components may include dicarboxylic acids inclusive of phthalic acid, terephthalic acid, isophthalic acid and their anhydrides; succinic acid, n-dodecenylsuccinic acid, and their anhydrides, fumaric acid, maleic acid, and maleic anhydride; and tricarboxylic acids, such as trimellitic acid and its anhydride.

Next, the production of the toner particles through the polymerization process will be described, with reference to, e.g., suspension polymerization process.

A polymerizable monomer providing a binder resin, a colorant (or a magnetic material), and optionally a polymerization initiator, a crosslinking agent, a charge control agent, a release agent, a plasticizer, and other additives, if any, are subjected to ununiform dissolution and/or dispersion by means of a dispersing machine, such as a homogenizer, a ball mill, a colloid mill or an ultrasonic dispersion machine to form a monomer composition, which is then suspended or formed into droplets in an aqueous medium containing a dispersion stabilizer. The polymerization initiator may be added to the polymerizable monomer simultaneously with the other additives, or immediately before the suspension into the aqueous medium. It is further possible to add a solution of such a polymerization initiator in a polymerizable monomer or a solvent to the polymerization system after the droplet formation and before the initiation of the polymerization.

In the polymerization step, the polymerization temperature may be set to at least 40° C., generally in the range of 50–90° C. By polymerization in this temperature range, the release agent or wax to be enclosed inside the toner particles may be precipitated by phase separation to allow a more complete enclosure. In order to consume a remaining portion of the polymerizable monomer, the reaction temperature may possibly be raised up to 90–150° C. in the final stage of polymerization. After the polymerization reaction, the suspension liquid is cooled, and the polymerizate is recovered therefrom by filtration, washing with water and dried to recover toner particles, which are then blended with external additives, such as the above-mentioned fine particles and inorganic fine powder to obtain a toner according to the present invention.

Examples of the polymerizable monomer include: styrene monomers, such as styrene, o-methylstyrene, m-methylstyrene, p-methylstyrene, p-methoxystyrene and p-ethylstyrene; acrylate esters, such as methyl acrylate, ethyl acrylate, n-butyl acrylate, isobutyl acrylate, n-propyl acrylate, n-octyl acrylate, dodecyl acrylate, 2-ethylhexyl acrylate, stearyl acrylate, 2-chloroethyl acrylate and phenyl acrylate; methacrylate esters, such as methyl methacrylate, ethyl methacrylate, n-propyl methacrylate, n-butyl methacrylate, isobutyl methacrylate, n-octyl methacrylate, dodecyl methacrylate, 2-ethylhexyl methacrylate, stearyl methacrylate, phenyl methacrylate, dimethylaminoethyl methacrylate, and diethylaminoethyl methacrylate; acrylonitrile, methacrylonitrile and acrylamide. These monomers may be used singly or in mixture. Among these, styrene or a styrene derivative may preferably be used singly or in mixture with another monomer so as to provide a toner with good developing performances and continuous image forming performances.

It is possible to incorporate a resin in the monomer mixture. For example, in order to introduce a polymer having a hydrophillic functional group, such as amino, carboxyl, hydroxyl, sulfonic acid, glicidyl or nitrile, of which the monomer is unsuitable to be used in an aqueous suspension system because of its water-solubility resulting in emulsion polymerization, such a polymer unit may be incorporated in the monomer mixture in the form of a copolymer (random, block or graft-copolymer) of the monomer with another vinyl monomer, such as styrene or ethylene; or a polycondensate, such as polyester or polyamide; or polyaddition-type polymer, such as polyether or polyimine. If a polymer having such a polar functional group is included in the monomer mixture to be incorporated in the product toner particles, the phase separation of the wax is promoted to enhance the encapsulation of the wax, thus providing a toner with better anti-offset property, anti-blocking property, and low-temperature fixability. Such a polar polymer may preferably be used in 1–20 wt. parts per 100 wt. parts of the polymerizable monomer. Below 1 wt. part, the addition effect is scarce, and above 20 wt. parts, the physical property designing of the resultant polymerization toner becomes difficult. The polymer having such a polar functional group may preferably have an average molecular weight of at least 5000. Below 5000, particularly below 4000, the polymer is excessively concentrated at the surface of the product toner particles to adversely affect the developing performance and anti-blocking property of the toner. As the polar resin, a polyester resin is particularly preferred.

Further, for the purpose of dispersion of the ingredients, improving the image forming performance, etc., it is also possible to incorporate a resin other than the above. Examples of such a resin may include: homopolymers of styrene and its substitutions derivatives, such as polystyrene and polyvinyltoluene; styrene copolymers, such as styrene-propylene copolymer, styrene-vinyltoluene copolymer, styrene-vinylnaphthalene copolymer, styrene-methylacrylate copolymer, styrene-ethyl acrylate copolymer, styrene-butyl acrylate copolymer, styrene-octyl acrylate copolymer, styrene-dimethylaminoethyl acrylate copolymer, styrene-methylmethacrylate copolymer, styrene-ethyl methacrylate copolymer, styrene-butyl methacrylate copolymer, styrene-dimethylaminoethyl methacrylate copolymer, styrene-vinyl methyl ether copolymer, styrene-vinyl ethyl ether copolymer, styrene-vinyl methyl ketone copolymer, styrene-butadiene copolymer, styrene-isoprene copolymer, styrene-maleic acid copolymer, and styrene-maleic acid ester copolymer; polymethyl methacrylate, polybutyl methacrylate, polyvinyl acetate, polyethylene, polypropylene, polyvinyl butyral silicone resin, polyester resin, polyamide resin, epoxy resin, polyacrylic acid resin, rosin, modified rosin terpene resin, phenolic resin, aliphatic and alicyclic hydrocarbon resin, and petroleum resin. These resins may be used singly or in mixture. The resin may preferably be added in 1–20 wt. parts per 100 wt. parts of the polymerizable monomer. Below 1 wt. part, the addition effect is scarce, and in excess of 20 wt. parts, the designing of various physical properties of the resultant polymerization toner is liable to be difficult.

Examples of the polymerization initiator may include: azo- or diazo-type polymerization initiators, such as 2,2'- azobis-(2,4-dimethylvaleronitrile), 2,2'-azobisisobutyronitrile, 1,1'-azobis(cyclohexane-2-carbonitrile), 2,2'-azobis-4-methoxy-2,4-dimethylvaleronitrile, azobisisobutyronitrile; and peroxide-type polymerization initiators such as benzoyl peroxide, methyl ethyl ketone peroxide, diisopropyl peroxycarbonate, cumene hydroperoxide, 2,4-dichlorobenzoyl peroxide, and lauroyl peroxide.

The polymerizable monomer mixture can further contain a crosslinking agent in a proportion of preferably 0.001–15 wt. % of the polymerizable monomer. The crosslinking agent may preferably comprise a compound having at least two polymerizable double bonds, and examples thereof may include: aromatic divinyl compounds, such as divinylbenzene, and divinylnaphthalene; carboxylic acid esters having two double bonds, such as ethylene glycol diacrylate, ethylene glycol dimethacrylate and 1,3-butanediol dimethacrylate; divinyl compounds, such as divinylaniline, divinyl ether, divinyl sulfide and divinylsulfone, and compounds having 3 or more vinyl groups. These may be used singly or in mixture.

In the suspension polymerization process, a known surfactant, or organic or inorganic dispersant, may be used as the dispersion stabilizer. Among these, an inorganic dispersant may preferably be used in view of dispersion stability. Examples of the inorganic dispersant may include: polyvalent metal phosphates, such as calcium phosphate, magnesium phosphate, aluminum phosphate and zinc phosphate; carbonates, such as calcium carbonate and magnesium carbonate; inorganic salts, such as calcium metasilicate, calcium sulfate and barium sulfate; and inorganic oxides, such as calcium hydroxide, magnesium hydroxide, aluminum hydroxide, silica, bentonite and alumina. These inorganic dispersant may be used singly or in combination of two or more species in 0.2–20 wt. parts per 100 wt. parts of the polymerizable monomer. In order to obtain toner particles having a further small average size, it is also possible to use 0.001–0.1 wt. part of a surfactant in combination. Examples of the surfactant may include: sodium dodecylbenzene sulfate, sodium tetradecyl sulfate, sodium pentadecyl sulfate, sodium octyl sulfate, sodium oleate, sodium laurate, sodium stearate, and potassium stearate.

The toner of the present invention may preferably contain a charge control agent within the toner particles (internal addition). By using a charge control agent, it becomes possible to realize an optimum charge control depending on the developing system. Particularly, in the present invention, it becomes possible to provide a further stable balance between the particle size distribution and the chargeability.

Examples of positive charge control agents may include: nigrosine and modified products thereof with aliphatic acid metal salts; quaternary ammonium salts, such as tributylbenzylammonium-1-hydroxy-4-naphthosulfonate, tetrabutylammonium tetrafluoroborate; and imidazole compounds, which may be used singly or in combination of two or more species. Among the above, nigrosine compounds and quaternary ammonium salts are particularly preferred. It is also possible to use a homopolymer of a dialkylaminoethyl (meth)acrylate or a copolymer thereof with another polymerizable monomer such as styrene or (meth)acrylate, which can also be used as a (whole or parts of) binder resin.

A magnetic charge control agent may effectively be an organometal complex or chelate compound, and examples thereof may include: monoazo-metal complexes, acetylacetone-metal complexes, and metal complexes of aromatic hydroxycarboxylic acid and aromatic dicarboxylic acids. Other examples may include: metal salts, anhydride and esters of aromatic hydroxycarboxylic acids and aromatic mono- or poly-carboxylic acids, and phenol derivatives such as bisphenol.

The above-mentioned charge control agents (not functioning as a binder resin) may preferably be used in fine particles having a number-average particle size of at most 4 $\mu$m, more preferably at most 3 $\mu$m. In the case of the internal addition, such a charge control agent may preferably be used in a proportion of 0.1–20 wt. parts, more preferably 0.1–10 wt. parts, further preferably 0.1–5 wt. parts, per 100 wt. parts of the binder resin.

When constituted as a magnetic toner, the toner is caused to contain a magnetic material, examples of which may include: iron oxides, such as magnetic and maghemite; iron oxides containing another metal oxide; metals, such as Fe, Co and Ni, and alloys of these metals with other metals, such as Al, Co, Cu, Pb, Mg, Ni, Sn, Zn, Sb, Be, Bi, Cd, Ca, Mn, Se, Ti, W and V; and mixtures of the above.

Specific examples of the magnetic material may include: triiron tetroxide ($Fe_3O_4$), diiron trioxide (gamma-$Fe_2O_3$), iron zinc oxide ($ZnFe_2O_4$), iron yttrium oxide ($Y_3Fe_5O_{12}$), iron cadmium oxide ($CdFe_2O_4$), iron gadolinium oxide ($Gd_3Fe_5O_{12}$), iron copper oxide ($CuFe_2O_4$), iron lead oxide ($PbFe_{12}O_{19}$), iron nickel oxide ($NiFe_2O_4$), iron neodymium oxide ($NdFe_2O_4$), iron barium oxide ($BaFe_{12}O_{19}$), iron magnesium oxide ($MgFe_2O_4$), iron manganese oxide ($MnFe_2O_4$), lanthanum iron oxide ($LaFeO_3$), iron powder (Fe), cobalt powder (Co) and nickel powder (Ni). These magnetic materials may be used singly or in combination of two or more species. Particularly suitable magnetic materials may include: powdery triiron tetroxide and gamma-diiron trioxide. The magnetic material may be contained in 10–200 wt. parts, preferably 20–150 wt. parts, per 10 wt. parts of the binder resin.

The toner of the present invention contains a colorant which may also be a dye and/or a pigment known heretofore. Examples of such a known colorant may include: carbon black, Phthalocyanine Blue, Peacock Blue, Permanent Red, Lake Red, Rhodamine Lake, HANSA Yellow, Permanent Yellow and Benzidine Yellow. Such a non-magnetic colorant may be used in 0.1–20 wt. parts, preferably 0.5–20 wt. parts, per 100 wt. parts of the binder resin. Further, in order to provide an OHP film carrying a fixed toner image and showing a good transparence, it is preferred to use 12 wt. parts or less, more preferably 0.5–9 wt. parts, of such a colorant per 100 wt. parts of the binder resin.

It also preferred to incorporate a release agent in the toner particles, as desired.

Examples of such a release agent may

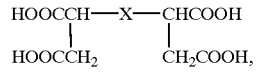

wherein X denotes an alkylene group or alkenylene group having 5–30 carbon atoms and having at least one side chain having at least 3 carbon atoms.

The polyester resin may preferably comprise 40–60 mol. %, more preferably 45–55 mol. %, of alcohol, and 60–40 mol. %, more preferably 55–45 mol. % of acid. It is preferred to include the polyhydric alcohol and/or polybasic carboxylic acid having at least 3 functional groups in a proportion of 5–60 mol. % of the total alcohol and acid components.

The polyester resin may be produced through ordinary polycondensation.

The magnetic toner of the present invention may further contain a wax, examples of which may include: aliphatic hydrocarbon waxes, such as Fischer-Tropsche wax, low-molecular weight polyethylene, low-molecular weight polypropylene, polyolefin copolymers, polyolefin wax, microcrystalline wax, and paraffin wax; oxides of aliphatic hydrocarbon waxes, such as oxidized polyethylene wax, and block copolymers of these; waxes principally comprising aliphatic acid esters, such as carnauba wax, SASOL WAX and montaic acid ester wax; partially or wholly de-acidified aliphatic acid esters, such as deacidified carnauba wax. Further examples may include: saturated linear aliphatic acids, such as palmitic acid, stearic acid and montaic acid; unsaturated aliphatic acids, such as brassidic acid, eleostearic acid and valinaric acid; saturated alcohols, such as stearyl alcohol, eicosy alcohol, behenyl alcohol, carnaubyl alcohol, ceryl alcohol and melissyl alcohol; long-chain alkyl alcohols; polyhydric alcohols, such as sorbitol, aliphatic acid amides, such as linoleic acid amide, oleic acid amide, and lauric acid amide; saturated aliphatic acid bisamides, such as methylene-bisstearic acid amide, ethylene-biscopric acid amide, ethylene-bislauric acid amide, and hexamethylene-bisstearic acid amide; unsaturated aliphatic acid amides, such as ethylene-bisoleic acid amide, hexamethylene-bisoleic acid amide, N,N'-dioleyladipic acid amide, and N,N-dioleylsebacic acid amide; aromatic bisamides, such as m-xylene-bisstearic acid amide, and N,N'-distearylisophthalic acid amide; aliphatic acid metal soaps (generally called metallic soaps), such as calcium stearate, calcium stearate, zinc stearate and magnesium stearate; waxes obtained by grafting vinyl monomers such as styrene and acrylic acid onto aliphatic hydrocarbon waxes; partially esterified products between aliphatic acid and polyhydric alcohols, such as behenic acid monoglyceride; and methyl ester compounds having hydroxyl groups obtained by hydrogenating vegetable oil and fat. Such a release agent may preferably be used in 0.1–20 wt. parts, more preferably 0.5–10 wt. parts, per 100 wt. parts of the binder resin.

The wax contained in the toner of the present invention may preferably show a thermal behavior as to provide a heat-absorption main peak temperature in a range of 60–140° C., more preferably 60–120° C., on a DSC curve as measured by differential scanning calorimetry (DSC) on temperature increase, and also a heat-evolution main peak temperature in a range of 60–150° C., more preferably 60–130° C., on a DSC curve on temperature decrease.

The toner of the present invention may preferably exhibit a glass transition temperature of 45–80° C., more preferably 50–70° C. Similarly as the wax mentioned above, the toner may preferably exhibit a heat-absorption main peak temperature in a range of 60–140° C., more preferably 60–120° C., on a DSC curve as measured by differential scanning calorimetry (DSC) on temperature increase, and also a heat-evolution main peak temperature in a range of 60–150° C., more preferably 60–130° C., on a DSC curve on temperature decrease. The toner may preferably exhibit a molecular weight distribution as to show a number-average molecular weight (Mn) of 1000–50,000, and a weight-average molecular weight (Mw) of $6\times10^3$–$1\times10^6$ as measured by GPC (gel permeation chromatography). Also, the toner may preferably show an acid value of at most 90 mgKOH/g, more preferably at most 50 mgKOH/g.

The DSC values described herein are based on values measured by using a differential scanning calorimeter ("DSC-7", made by Perkin-Elmer Corp.) under the following conditions.

Sample: 5–20 mg, preferably 10 mg

Temp. Cycle.

Heating I (20° C.→180° C., a rate of 10° C./min.)

Cooling I (180° C.→10° C., a rage of −10° C./min.)

Heating II (10° C.→180° C., a rate of 10° C./min.)

For the measurement, a sample is placed on an aluminum pan and subjected to the above-mentioned temperature cycle together with a blank aluminum pan as a reference. For the Tg-measurement, a DSC curve in the above Heating II is used. An intermediate line is drawn at equal distances from two base lines before and after a heat-absorption peak, and a temperature at an intersection of the intermediate line and the DSC curve is taken as the glass transition temperature (Tg).

<4> Image Forming Method

The image forming method of the present invention is characterized by the use of a contact charger in combination with the above-mentioned toner. In a preferred embodiment, the image forming method of the present invention includes a development and simultaneous cleaning step (or developing-cleaning step) wherein a transfer residual toner (i.e., a portion of toner remaining on the image-bearing member after the transfer step) is recovered by a toner-carrying member.

By adopting the contact charging step wherein a charging member contacting the image bearing member while forming a contact nip or an abutting portion with the image bearing member is supplied with a voltage to charge the image bearing member, various advantages inclusive of low-ozone forming characteristic and low-power consumption, can be accomplished.

By using the toner of the present invention containing the above-mentioned tungsten-containing tin oxide or compound fine particles, the fine particles in the toner are transferred from the toner-carrying member to the image-bearing member in the developing step, and are caused to remain on the image-bearing member even after the transfer step to reach and be present at the contact nip to promote a uniform charging of the image-bearing member with the charging member, thereby providing good images. This advantage can be attained regardless of the presence or absence of a cleaning step.

A preferred mode of the image forming method according to the present invention, i.e., a developing and simultaneous cleaning image forming method (or cleanerless image forming method), includes a charging step of charging an electrostatic image-bearing member, an electrostatic latent image forming step of writing image data on the charged surface of the image-bearing member to form an electrostatic latent image, a developing step of visualizing the electrostatic latent image with a toner carried on a toner-carrying member to form a toner image on the image-bearing member, and a transfer step of transferring the toner image onto a transfer(-receiving) material; wherein the above-mentioned developing step also functions as a cleaning step for recovering a transfer residual toner remaining on the image bearing member after the transfer step. The above steps are repeated to form a toner image on the transfer material. In the charging step, the charging member contacting the image bearing member while forming a contact nip is supplied with a voltage to charge the image bearing member, and the above-mentioned fine particles contained in the toner are present at least at the contact nip or proximity thereto through attachment to the image bearing member in the developing step and remaining on the image bearing member after the transfer step. The developing step is a step of developing the electrostatic latent image on the image bearing member with the toner.

First, the behavior of the toner and the electroconductive fine particles in such a development-and-simultaneous cleaning process will be described.

An appropriate amount of the fine particles contained in the toner are transferred together with the toner onto the image-bearing member side at the time of developing an electrostatic latent image on the image-bearing member in the developing step. The toner image formed on the image-bearing member is transferred onto the transfer material side in the transfer step. A portion of the fine particles are also attached onto the transfer material side but the remainder is attached and held to remain on the image-bearing member. In the case where the transfer is effected under the application of a transfer bias voltage of a polarity opposite to that of the toner, the toner is positively transferred onto the transfer material side by electrostatic attraction, but the fine particles on the image-bearing member are not positively transferred to the transfer material side because of their conductivity, whereby a portion thereof can be attached to the transfer material but the remainder remains held and attached on the image-bearing member.

In the image forming system using no cleaner, the transfer residual toner and the above-mentioned remaining fine particles on the image-bearing member after the transfer are brought as they are along with the rotation of the image-bearing member to be attached and commingled with the contact charging member at the contact position between the image-bearing member and the contact charging member. As a result, the contact charging of the image-bearing member is effected in the presence of the fine particles at the contact position or nip between the image-bearing member and the contact charging member.

Due to the presence of the fine particles, an intimate contact and a low level of contact resistance are retained between the contact charging member and the image-bearing member, so that the image-bearing member is well charged by the contact charging member.

The transfer residual toner attached and commingled with the contact charging member is charge-uniformized to a polarity identical to that of the charging bias voltage and gradually discharged from the contact charging member onto the image-bearing member to reach the developing position together with the movement of the image-bearing member and the recovered in the developing and cleaning step.

On further repetition of the image forming cycles, the fine particles contained in the toner and transferred to the image-bearing member in the developing step are brought via the transfer position to the charging section as a continual supply. Accordingly, even if the fine particles are decreased as by falling or deteriorated, the lowering in charging performance is prevented to stably retain a good charging performance.

However, in case where such a toner containing fine particles is applied to the development and cleaning image forming method, the localization of the fine particles is liable to occur to remarkably affect the image quality. As mentioned above, after an appropriate amount of fine particles contained in the toner are transferred to the image-bearing member side in the developing step, a portion of the fine particles are attached to the transfer material side but the remainder thereof remains held and attached on the image-bearing member. In the case of transfer under application of a transfer bias voltage, the toner particles are positively attracted and transferred onto the transfer material side, whereas the electroconductive fine particles are not positively transferred onto the transfer material side but remain on the image-bearing member while a portion thereof is attached to the transfer material side.

In the image forming system using no cleaning mechanism, the transfer residual toner and the above-mentioned remaining fine particles are attached to and commingled with the contact charging member. In this instance, the amount ratio of the fine particles to the transfer residual toner attached and commingled with the contact charging member is substantially increased relative to that in the original toner due to the difference in transferability between the fine particle and the toner particles. The fine particles attached to and commingled with the contact charging member in this state is gradually discharged together with the transfer residual toner to the image-bearing member and moved together with the movement of the image-bearing member surface to reach and be recovered (for development and cleaning) at the developing position. Thus, in the development and cleaning step, the toner containing a remarkably increased proportion of the fine particles is recovered to promote the localization of the fine particles, thus being liable to result in a remarkable lowering in triboelectric chargeability in a high humidity environment, leading to lower image qualities, such as a remarkable image density lowering.

If the above problem is tried to be solved by firmly attaching the fine particles to the toner particles for reducing the localization similarly as in a conventional image forming apparatus equipped with a cleaning mechanism, the fine particles are caused to move and be transferred together with the toner particles onto the transfer material side, so that the fine particles cannot be present in a sufficient amount together with the contact charging member in the charging step, thus failing to retain an intimate contact with the image-bearing member and a sufficient charging performance of the contact charging member, and resulting in fog and image soiling. These difficulties are peculiar to the use of a toner containing fine particles in the developing and cleaning image forming method using a contact charging member.

In contrast thereto, we have found it possible to remarkably reduce the localization of fine particles, retain a good charging performance and suppress the image quality lowering, such as an image density lowering, to a level of practically no problem in such a cleanerless image forming method using a contact charging member capable of reducing the ozone generation and free from the occurrence of waste toner, by the toner of the present invention containing tungsten- and tin-containing fine particles. This is presumably because, due to specific resistivity characteristic and/or triboelectric chargeability of the fine particles, an appropriate amount of the fine particles are transferred together with the toner to the transfer material side, thus resulting in an appropriate level of the fine particles in the transfer residual toner, whereby the localization of the fine particles in the developing apparatus is remarkably improved even if the fine particles are recovered in the transfer and cleaning step.

Next, some embodiments of the image forming method of the present invention will be described in further detail while referring to drawing. FIG. 1 is a schematic illustration of an image forming apparatus capable of practicing an image forming method according to the present invention.

Referring to FIG. 1, surrounding a photosensitive member (drum) 100 as an image-bearing member, a charging roller 117 (contact charging member), a developing device 140 (developing means), a transfer roller 114 (transfer means), a cleaner 116, paper supply rollers 124, etc., are disposed. The photosensitive member 100 is charged to, e.g., −700 volts by the charging roller 117 supplied with an AC voltage of peak-to-peak 2.0 kV superposed with DC −700 volts and is exposed to imagewise laser light 123 from a laser beam scanner 121 to form an electrostatic latent image thereon, which is then developed with a toner supplied by a toner-supply roller 141 and carried on a toner-carrying member 102 equipped to the developing device 140 to form a toner image. The toner image on the photosensitive member 100 is then transferred onto a transfer(-receiving) material P by means of the transfer roller 114 abutted against the photosensitive member 100 via the transfer material P. The transfer material P carrying the toner image is then conveyed by a conveyer belt 125, etc., to a fixing device 126, where the toner image is fixed onto the transfer material P.

A portion of the toner P remaining on the photosensitive member 100 is removed by the cleaner 116 (cleaning means). Incidentally, such a cleaner 116 is not necessary in a case, as mentioned above, wherein the developing step also function as a cleaning step of recovering a transfer residual toner remaining on the image-bearing member. In this case, a magnetic toner is also preferably used because of easiness of recovery of the transfer residual toner by a magnetic force exerted by a magnet roller contained in the toner-carrying member 102.

Figure 2:
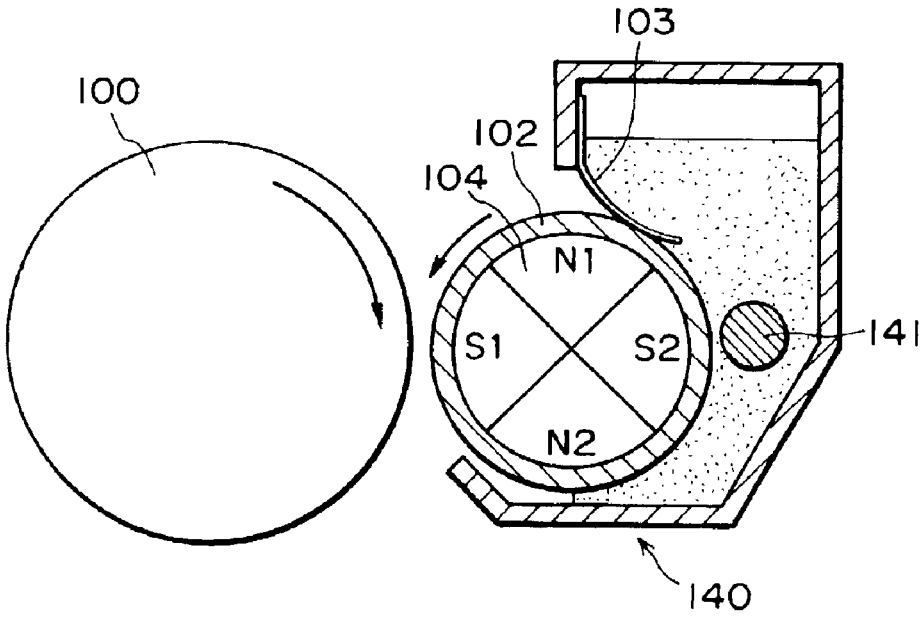
FIG. 2 illustrates an organization of a mono-component-type developing device for practicing an image forming method of the invention.

FIG. 2 is a schematic illustration of a developing device using such a magnetic toner.

Referring to FIG. 2, the developing device 140 includes a cylindrical toner-carrying member (hereinafter called a "developing sleeve") 102 formed of a non-magnetic metal, such a aluminum or stainless steel, and disposed in proximity to the photosensitive member 100, and a toner vessel containing the toner. The gap between the photosensitive member 100 and the developing sleeve 102 is set at ca. 300 μm by a sleeve/photosensitive member gap-retaining member (not shown), etc. The gap can be varied as desired. Within the developing sleeve 102, a magnet roller 104 is disposed fixedly and concentrically with the developing sleeve 102, while allowing the rotation of the developing sleeve 102. The magnet roller 104 is provided with a plurality of magnetic poles as shown, including a pole S1 associated with developing, a pole N1 associated with regulation of a toner coating amount, a pole S2 associated with toner take-in and conveyance, and a pole N2 associated with prevention of toner blowing-out. Within the toner reservoir, a stirring member 141 is disposed to stir the toner therein.

The developing device 140 is further equipped with an elastic blade 103 as a toner layer thickness-regulating member for regulating the amount of toner conveyed while being carried on the developing sleeve 2, by adjusting an abutting pressure at which the elastic blade 103 is abutted against the photosensitive member 102. In the developing region, a developing bias voltage comprising a DC voltage and/or an AC voltage is applied between the photosensitive member and the developing sleeve 102, so that the toner on the developing sleeve 102 is caused to jump onto the photosensitive member 100 to form toner image corresponding to an electrostatic latent image formed thereon.

The charging step in the image forming method of the present invention is described in further detail below.

In the charging step, an image-bearing member is charged by applying a voltage to a charging member contacting the image-bearing member so as to form a contact nip.

In the image forming method of the present invention, the fine particles are caused to be present at such a contact nip or position between the image-bearing member and the charging member. Accordingly, the charging member may preferably have a resilience and also be electroconductive so as to charge the image-bearing member while being supplied with a voltage. For this reason, the charging member may preferably comprise an elastic electroconductive roller member, a magnetic brush contact charging member comprising a magnetic brush formed of magnetically constrained magnetic particles, or an electroconductive brush member comprising electroconductive fiber.

Also for the purpose of temporarily recovering the transfer residual toner on the image-bearing member and carrying the fine particles so as to advantageously performing the direct injection charging, it is preferred to use an elastic electroconductive roller member or a rotatable charging brush roller that is a resilient member as a contact charging member.

The contact charging member may preferably have a flexibility so as to increase the opportunity of the electroconductive fine powder contacting the image-bearing member at the contact part between the contact charging member and the image-bearing member, thereby improving the direct injection charging performance. By having the contact charging member intimately contact the image-bearing member via the electroconductive fine powder and having the electroconductive fine powder densely rub the image bearing member surface, the image-bearing member can be charged not based on the discharge phenomenon but predominantly based on the stable and safe direct injection charging mechanism via the electroconductive fine powder. As a result, it becomes possible to attain a high charging efficiency not achieved by the conventional roller charging based on the discharge charging mechanism, and provide a potential almost equal to the voltage applied to the contact charging member to the image-bearing member.

It is preferred to provide a relative surface speed difference between the contact charging member and the image-bearing member. As a result, the opportunity of the electroconductive fine powder contacting the image-bearing member at the contact part between the contact charging member and the image-bearing member is remarkably increased, thereby further promoting the direct injection charging to the image-bearing member via the electroconductive fine powder.

As fine particles are present at the contact position between the contact charging member and the image-bearing member, the fine particles exhibit a lubricating effect (i.e., friction-reducing effect), so that it becomes possible to provide such a relative surface speed difference between the contact charging member and the image-bearing member without causing a remarkable increase in torque acting between these members or a remarkable abrasion of these members.

It is possible to provide such a relative speed difference, e.g., by rotating a contact charging member while providing a surface speed difference between the contact charging member and the image-bearing member.

It is preferred that the charging member and the image-bearing member are moved in mutually opposite directions at the contact part. This is preferred in order to enhance the effect of temporarily damming and leveling the transfer-residual toner particles on the image-bearing member brought to the contact charging member. This is for example accomplished by driving the contact charging member in rotation in a direction and also driving the image-bearing member in rotation so as to move the surfaces of these members in mutually opposite directions. As a result, the transfer-residual toner particles on the image-bearing member are once released from the image-bearing member to advantageously effect the direct injection charging and suppress the obstruction of the latent image formation.

It is possible to provide a relative surface speed difference by moving the charging member and the image-bearing member in the same direction. However, as the charging performance in the direct injection charging depends on a moving speed ratio between the image-bearing member and the contact charging member, a larger moving speed is required in the same direction movement in order to obtain an identical relative movement speed difference than in the opposite direction movement. This is disadvantageous.

It is possible to use a relative (movement) speed ratio as determined by the following formula (3) as a measure of such a relative speed difference:

$$\text{Relative speed ratio } (\%) = |[(Vc-Vp)/Vp]\times 100| \quad (3),$$

wherein Vp denotes a moving speed of the image-bearing member, Vc denotes a moving speed of the charging member of which the sign is taken positive when the charging member surface moves in the same direction as the image-bearing member surface at the contact position.

The relative (movement) speed ratio is generally in the range of 10–500%.

The contact charging means may include: a charging roller, a charging blade, a charging brush, etc. The charging means using such a contact charging member is advantageous in that it does not require a high voltage but can suppress the occurrence of ozone.

The charging roller or charging blade as a contact charging member may preferably comprise an electroconductive rubber, which may be surface-coated with a release film comprising, e.g., nylon resin, PVdF (polyvinylidene fluoride), PVdC (polyvinylidene chloride) or fluorine-containing acrylic resin.

More specifically, such a charging roller may be prepared by forming a medium resistivity layer of rubber or foam material on a core metal. It is possible to form thereon a release coating layer as described above.

The charging roller may preferably have a surface provided with minute cells or unevennesses so as to stably retain the fine particles. The cells may preferably have concavities providing an average cell diameter corresponding to spheres of 5–300 $\mu$m and also a void percentage at the surface of 15–90%.

If the average cell diameter is below 5 $\mu$m or the void percentage is above 90%, the ability of retaining the fine particles at the roller member surface is lowered and the amount of the fine particles present at the contact nip is decreased, so that the primary charging performance is liable to be lowered. Further, the frictional force with the image-bearing member is liable to be increased to resulting in an increased surface abrasion of the image-bearing member. On the other hand, if the average cell diameter exceeds 300 $\mu$m or the void percentage is below 15%, the contact uniformity between the charging roller member and the image-bearing member is lowered to result in lower uniformity of primary charging performance, a lower charging or image defects in halftone image due to charging irregularity.

The charging roller may be formed of foamed or non-foamed elastic material. A conductive elastic material may be provided by dispersing a conducive substance, such as carbon black or a metal oxide, for resistivity adjustment in an elastomer, such as ethylene-propylene-diene rubber (EPDM), urethane rubber, butadiene-acrylonitrile rubber (NBR), silicone rubber or isoprene rubber. It is also possible to use a foam product of such an elastic conductive material. It is also possible to effect a resistivity adjustment by using an ionically conductive material alone or together with a conductor substance as described above.

The charging roller member may preferably have an Asker C hardness of at most 50 deg., more preferably 25–50 deg., because too low a hardness results in an inferior contact with the image-bearing member because of an unstable shape and abrasion or damage of the surface layer due to the electroconductive fine powder present at the contact part between the charging member and the image-bearing member, thus being difficult to provide a stable chargeability of the image-bearing member. On the other hand, too high a hardness makes it difficult to ensure a contact part with the image-bearing member and results in a poor microscopic contact with the image-bearing member surface, thus making it difficult to attain a stable chargeability of the image-bearing member. The values of Asker C hardness described herein are based on values measured by using a spring-type hardness meter ("Asker C", made by Kobunshi Keiki K.K.) under a load of 500 g.

In addition to the elasticity for attaining a sufficient contact with the image-bearing member, it is important for the elastic conductive roller to function as an electrode having a sufficiently low resistance for charging the moving image-bearing member. On the other hand, in case where the image-bearing member has a surface defect, such as a pinhole, it is necessary to prevent the leakage of voltage. In order to have sufficient charging performance and leakage resistance, the elastic conductive roller may preferably have a resistivity of $10^3$–$10^8$ ohm.cm, more preferably $10^4$–$10^7$ ohm.cm. The resistivity values of a charging roller described herein are based on values measured by pressing the roller against a 30 mm-dia. cylindrical aluminum drum under a total load of 1 kg and applying 100 volts between the core metal of the roller and the aluminum drum.

The charging roller is disposed under a prescribed pressure against the image-bearing member while resisting the elasticity thereof to provide a charging contact part (or portion) between the elastic conductive roller and the image-bearing member. The width of the contact part is not particularly restricted but may preferably be at least 1 mm, more preferably at least 2 mm, so as to stably provide an intimate contact between the elastic conductive roller and the image-bearing member.

The contact charging member used in the charging step of the present invention may also be in the form of a brush comprising conductive fiber so as to be supplied with a voltage to charge the image-bearing member. The charging brush may comprise ordinary fibrous material containing a conductor dispersed therein for resistivity adjustment. For example, it is possible to use fiber of nylon, acrylic resin, rayon, polycarbonate or polyester. Examples of the conductor may include fine powder of electroconductive metals, such as nickel, iron, aluminum, gold and silver; electroconductive metal oxides, such as iron oxide, zinc oxide, tin oxide, antimony oxide and titanium oxide; and carbon black. Such conductors can have been surface-treated for hydrophobization or resistivity adjustment, as desired. These conductors may appropriately be selected in view of dispersibility with the fiber material and productivity.

Commercially available examples of the charging brush materials may include: electroconductive rayon fiber "REC-B", "REC-C", "REC-M1" and "REC-M10" (available from Unitika K.K.), "SA-7" (Toray K.K.), "THUNDERRON" (Nippon Sanmo K.K.), "BELTRON" (Kanebo K.K.), "KURACARBO" (carbon-dispersed rayon, Kuraray K.K.) and "ROABAL" (Mitsubishi Rayon K.K.), "REC-B", "REC-C", "REC-M1" and "REC-M10" are particularly preferred in view of environmental stability.

The charging brush as a contact charging member may include a fixed-type one and a rotatable roll-form one. A roll-form charging brush may be formed by winding a tape to which conductive fiber pile is planted about a core metal in a spiral form. The conductive fiber may have a thickness of 1–20 denier (fiber diameter of ca. 10–500 $\mu$m) and a brush fiber length of 1–15 mm arranged in a density of $10^4$–$3\times10^5$ fibers per inch ($1.5\times10^7$–$4.5\times10^8$ fibers per $m^2$).

The charging brush may preferably have as high a density as possible. It is also preferred to use a thread or fiber composed of several to several hundred fine filaments, e.g., threads of 300 denier/50 filaments, etc., each thread composed of a bundle of 50 filaments of 300 denier. In the present invention, however, the charging points in the direct injection charging are principally determined by the density of electroconductive fine powder present at the contact part and in its vicinity between the charging member and the image-bearing member, so that the latitude of selection of charging member materials has been broadened, and a lower brush density is allowed than in the case of using a charging brush member alone.

Next, a description will be made regarding the amount of fine particles at the contact position between the image-bearing member and the contact charging members.

If the amount is too small, the lubricating effect of the fine particles cannot be sufficiently attained but results in a large friction between the image-bearing member and the contact charging member, so that it becomes difficult to drive the contact charging member in rotation with a speed difference relative to the image-bearing member. As a result, the drive torque increases, and if the contact charging member is forcibly driven, the surfaces of the contact charging member and the image-bearing member are liable to be abraded. Further, as the effect of increasing the contact opportunity owing to the fine particles is not attained, it becomes difficult to attain a sufficient chargeability of the image bearing member. On the other hand, if the fine particles are present in an excessively large amount, the falling of the fine particles from the contact charging member is increased, thus being liable to cause adverse effects, such as obstruction of latent image formation as by interception of imagewise exposure light.

In view of the above, the amount of the electroconductive fine powder at the contact position between the image-bearing member and the contact charging member is preferably at least $10^2$ particles/$mm^2$. Below $10^2$ particles/$mm^2$, it becomes difficult to attain sufficient lubrication effect and opportunity of contact, and some lowering in chargeability can occur in case of an increased amount of transfer residual toner.

The appropriate range of amount of the fine particles on the image-bearing member in the charging step, is also determined depending on a density of the electroconductive fine powder affecting the uniform charging on the image-bearing member. It is necessary that the image-bearing member has to be charged more uniformly than at least a recording resolution. However, in view of a human eye's visual characteristic, at spatial frequencies exceeding 10 cycles/mm, the number of discriminatable gradation levels approaches infinitely to 1, that is, the discrimination of density irregularity becomes impossible. As a positive utilization of this characteristic, in the case of attachment of the fine particles on the image-bearing member, it is effective to dispose the fine particles at a density of at least 10 cycles/mm and effect the direct injection charging. Even if charging failure is caused at sites with no fine particles, an image density irregularity caused thereby occurs at a spatial frequency exceeding the human visual sensitivity, so that no practical problem is encountered on the resultant images.

As to whether a charging failure is recognized as density irregularity in the resultant images, when the application density of the fine particles is changed, only a small amount (e.g., 10 particles/$mm^2$) of fine particles can exhibit a recognized effect of suppressing density irregularity, but this is insufficient from a viewpoint as to whether the density irregularity is tolerable to human eyes. However, an application amount of $10^2$ or more particles/$mm^2$ results in a remarkably preferable effect by objective evaluation of the image.

In the charging step based on the direct injection charging mechanism as basically different from the one based on the discharge charging mechanism, the charging is effected through a positive contact between the contact charging member and the image-bearing member, but even if the fine particles are applied in an excessively large density, there always remain sites of no contact. This however results in practically no problem by applying the fine particles while positively utilizing the above-mentioned visual characteristic of human eyes.

However, the application of the direct injection charging scheme for uniform charging of the image-bearing member in a developing-cleaning image forming method causes a lowering in charging performance due to attachment and mixing with the charging member of the transfer residual toner. For suppressing the attachment and mixing with the charging member of the transfer residual toner and overcoming the charging obstruction thereby to well effect the direct injection charging, it is preferred that the fine particles are present at a density of $10^2$ particles/$mm^2$ or higher at the contact position between the image-bearing member and the contact charging member.

The upper limit of the amount of the fine particles present on the image-bearing member is determined by the formation of a densest mono-particle layer of the electroconductive fine powder. In excess of the amount, the effect of the fine particles is not increased, but an excessive amount of the fine particles liable to be present on the image-bearing member after the charging step, thus being liable to cause difficulties, such as interruption or scattering of imagewise exposure light. Thus, a preferable upper limit of the fine particles may be determined as an amount giving a densest mono-particle layer of the fine particles on the image-bearing member while it may depend on the particle size of the fine particles and the retentivity of the fine particles powder by the contact charging member.

More specifically, if the fine particles are is present on the image-bearing member at a density in excess of $5\times10^5$ particles/$mm^2$, the amount of the fine particles falling off the image-bearing member is increased, and the exposure light quantity is liable to be insufficient regardless of the light transmissivity of the fine particles. If the amount is suppressed to be $5\times10^5$ particles/$mm^2$ or below, the amount of falling particles soiling the apparatus is suppressed and the exposure light obstruction can be alleviated. As an experimental result of image formation in the presence of fine particles in the range of $10^2$–$5\times10^5$ particles/$mm^2$ to measure the amounts of fine particles falling on the image-bearing member no difficulty in image forming operation was encountered. Thus, a preferable upper limit of the fine particles present on the image-bearing member is judged to be $5\times10^5$ particles/$mm^2$.

The amounts of the fine particles at the charging contact part and on the image-bearing member in the latent image forming step described herein are based on values measured in the following manner. Regarding the amount of the fine particles at the contact part, it is desirable to directly measure the value at the contacting surfaces on the contact charging member and the image-bearing member. However, in the case of opposite surface moving directions of the contact charging member and the image-bearing member, most fine particles present on the image-bearing member prior to the contact with the contact charging member are peeled off by the charging member contacting the image-bearing member while moving in the reverse direction, so that the amount of the fine particles present on the contact charging member just before reaching the contact part is taken herein as the amount of fine particles at the contact part.

More specifically, in the state of no charging bias voltage application, the rotation of the image-bearing member and the charging roller is stopped, and the surfaces of the image-bearing member and the charging are photographed by a video microscope ("OVM 1000N", made by Olympus K.K.) and a digital still recorder ("SR-310", made by Deltis K.K.). For the photographing, the charging roller is abutted against a slide glass under an identical condition as against the image-bearing member, and the contact surface is photographed at 10 parts or more through the slide glass and an objective lens having a magnification of 1000 of the video microscope. The digital images thus obtained are processed into binary data with a certain threshold for regional separation of individual particles, and the number of regions retaining particle fractions are counted by an appropriate image processing software. Also the fine particles on the image-bearing member are similarly photographed through the video microscope and the amount thereof is counted through similar processing.

The amounts of fine particles on the image-bearing member at a point of after transfer and before charging and a point of after charging and before developing are counted in similar manners as above through photographing and image processing.

In the charging step of the image forming method according to the present invention, a contact charging member is caused to contact an image-bearing member, and the contact charging member is supplied with a prescribed charging bias voltage to charge the image-bearing member surface to a prescribed voltage of a prescribed polarity. The charging bias voltage applied to the contact charging member may be a DC voltage alone for exhibiting a good charging performance or also a superposition of a DC voltage and an AC voltage (alternating voltage) as shown in FIG. 1.

The AC voltage may preferably have a peak voltage of below 2×Vth (Vth: discharge initiation voltage at the time of DC voltage application). If this condition is not satisfied, the potential on the image-bearing member is liable to be unstable. The AC voltage applied in superposition with a DC voltage may more preferably have a peak voltage below Vth so as to charge the image-bearing member without being substantially accompanied with a discharge phenomenon.

The AC voltage may have an appropriate voltage, such as a sine wave, a rectangular wave, a triangular wave, etc. Further, the AC voltage may comprise a pulse wave formed by periodically turning on and off a DC voltage supply. Thus, the AC voltage may have periodically changing voltages.

As preferred conditions for driving a charging roller as a contact charging means, the roller may be abutted at a pressure of 4.9–490 N/m (5–500 g/cm) and supplied with a DC voltage alone or in superposition with an AC voltage. The DC/AC-superposed voltage, for example, may preferably comprise an AC voltage of 0.5–5 kV (Vpp) and a frequency of 50 Hz to 5 kHz, and a DC voltage of ±0.2–±5 kV.

Next, the image-bearing member will be described. The image-bearing member may for example be a photosensitive member. In the present invention, the image-bearing member may preferably have a surfacemost layer exhibiting a volume resistivity of $1\times10^{9}$–$1\times10^{14}$ ohm.cm, more preferably $1\times10^{10}$–$1\times10^{14}$ ohm.cm so as to provide a good chargeability of the image-bearing member. In the charging scheme based on direct charge injection, better charge transfer can be effected by lowering the resistivity of the member-to-be-charged. For this purpose, it is preferred that the surfacemost layer has a volume-resistivity of at most $1\times10^{14}$ ohm.cm. On the other hand, for the image-bearing member to retain an electrostatic image for a certain period, it is preferred that the surfacemost layer has a volume resistivity of at least $1\times10^{9}$ ohm.cm.

It is further preferred that the image-bearing member is an electrophotographic photosensitive member and the photosensitive member has a surfacemost layer exhibiting a volume resistivity of $1\times10^{9}$–$1\times10^{14}$ ohm.cm so the image-bearing member can be provided with a sufficient chargeability even in an apparatus operated at a high process speed.

The volume resistivity value of the surfacemost layer of the image-bearing member described herein are based on values measured in the following manner. A layer of a composition identical to that of the surfacemost layer is formed on a gold layer vapor-deposited on a polyethylene terephthalate (PET) film, and the volume resistivity of the layer is measured by a volume resistivity meter ("4140B pA", available from Hewlett-Packard Co.) by applying 100 volts across the film in an environment of 23° C. and 65% RH.

It is also preferred that the image-bearing member is a photosensitive drum or a photosensitive belt comprising a layer of photoconductive insulating material, such as amorphous selenium, CdS, $Zn_2O$, amorphous silicon or an organic photoconductor. It is particularly preferred to use a photosensitive member having an amorphous silicon photosensitive layer or an organic photosensitive layer.

The organic photosensitive layer may be a single photosensitive layer containing a charge-generating substance and a charge-transporting substance, or a function separation-type laminate photosensitive layer including a charge transport layer and a charge generation layer. A laminate photosensitive layer comprising a charge generation layer and a charge transport layer laminated in this order on an electroconductive support is a preferred example.

By adjusting the volume resistivity of the surfacemost layer of the image-bearing member to $1\times10^{9}$–$1\times10^{14}$ ohm.cm, it is possible to further stably effect the uniform charging of the image-bearing member.

Accordingly, it is also preferred to dispose a charge injection layer on the surface of an electrophotographic photosensitive member. The charge injection layer may preferably comprise a resin with electroconductive fine particles dispersed therein.

Such a charge injection layer may for example be provided in any of the following forms.

(i) A charge injection layer is disposed on an inorganic photosensitive layer of, e.g., selenium or amorphous silicon, or a single organic photosensitive layer. (ii) A charge transport layer as a surface by comprising a charge-transporting substance and a resin in the function-separation-type organic photosensitive member is also caused to have the function of a charge injection layer. For example, a charge transport layer is formed from a resin, a charge-transporting substance and electroconductive particles dispersed therein, or a charge transport layer is also provided with a function of a charge injection layer by selection of the charge-transporting substance or the state of presence of the charge-transporting substance. (iii) A function separation-type organic photosensitive member is provided with a charge injection layer as a surfacemost layer. In any of the above forms, it is important that the surfacemost layer has a volume-resistivity in a preferred range as describe below. It is also possible to disperse the above-mentioned lubricating particles in the charge-injection layer.

The charge injection layer may for example be formed as an inorganic material layer, such as a metal deposition film, or an electroconductive powder-disposed resin layer comprising electroconductive fine particles dispersed in a binder resin. The deposition film is formed by vapor deposition. The electroconductive powder-dispersed resin layer may be formed by appropriate coating methods, such as dipping, spray coating, roller coating or beam coating.

Such a charge injection layer may also be formed from a mixture or a copolymer of an insulating binder resin and a photoconductive resin having an ionic conductivity, or a photoconductive resin having a medium resistivity as mentioned above.

It is particularly preferred to provide the image-bearing member with a resin layer containing at least electroconductive fine particles of metal oxide (metal oxide conductor particles) dispersed therein as a surfacemost charge injection layer. By disposing such a charge injection layer as a surfacemost layer on an electrophotographic photosensitive member, the photosensitive member is caused to have a lower surface resistivity allowing charge transfer at a better efficiency, and function as a result of lower surface resistivity, it is possible to suppress the blurring or flowing of a latent image caused by diffusion of latent image charge while the image-bearing member retains a latent image thereon.

In the oxide conductor particle-dispersed resin layer as the surfacemost layer of the image-bearing member, it is necessary that the oxide conductor particles have a particle size smaller than the exposure light wavelength incident thereto so as to avoid the scattering of incident light by the dispersed particles. Accordingly, the oxide conductor particles may preferably have a particle size of at most 0.5 $\mu$m. The oxide conductor particles may preferably be contained in 2–90 wt. %, more preferably 5–70 wt. %, of the total weight of the surfacemost layer. Below the above range, it becomes difficult to obtain a desired resistivity. In excess of the above range, the charge injection layer is caused to have a lower film strength and thus is liable to be easily abraded to provide a shorter life. Further, the resistivity is liable to be excessively low, so that image defect is liable to occur due to flow of latent image potential.

The charge injection layer may preferably have a thickness of 0.1–10 $\mu$m, more preferably at most 5 $\mu$m so as to retain a sharpness of latent image contour. In view of the durability, a thickness of at least 1 $\mu$m is preferred.

The charge injection layer can comprise a binder resin identical to that of a lower layer (e.g., charge transport layer). In this case, however, the lower layer can be disturbed during the formation by application of the charge injection layer, so that the application method should be selected so as not to cause the difficulty.

In the present invention, the image-bearing member surface may preferably have a releasability as represented by a contact angle with water of at least 85 deg., more preferably 90 deg. or higher. More specifically, such a surfacemost layer may be provided, e.g., in the following manner:

(1) The surfacemost layer is formed from a resin having a low surface energy.

(2) An additive showing water-repellency or lipophilicity is added to the surfacemost layer.

(3) A material having high releasability in a powdery form is dispersed in the surfacemost layer. For (1), a resin having a fluorine-containing resin or a silicone group may be used. For (2), a surfactant may be used as the additive. For (3), it may be possible to use a material, a fluorine-containing compound inclusive of polytetrafluoroethylene, polyvinylidene fluoride or fluorinated carbon, silicone resin or polyolefin resin.

According to these measures, it is possible to provide an image-bearing member surface exhibiting a contact angle with water of at least 85 deg., preferably 90 deg. or higher, so as to further improve the toner transferability and the durability of the photosensitive member. Among the above, it is particularly preferred to disperse polytetrafluoroethylene fine particles in the surfacemost layer.

Such a surfacemost layer containing lubricating or releasing powder may be provided as an additional layer on the surface of a photosensitive member or by incorporating such lubricant powder into a surfacemost resinous layer of an organic photosensitive member. The releasing or lubricating powder may be added to a surfacemost layer of the image-bearing member in a proportion of 1–60 wt. %, more preferably 2–50 wt. %. Below 1 wt. %, the effects of improving the toner transferability and the durability of the photosensitive member may be insufficient. In excess of 60 wt. %, the surfacemost layer may have a lower film strength, and the incident light quantity to the photosensitive member can be lowered.

Figure 8:
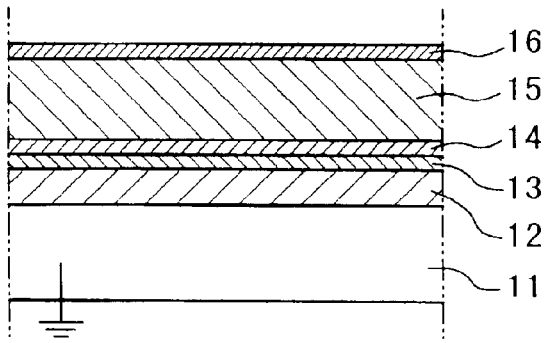

FIG. 8 is a schematic sectional view of a photosensitive member provided with a charge injection layer. More specifically, the photosensitive member includes an ordinary organic photosensitive drum structure comprising an electroconductive substrate (aluminum drum substrate) 11, and an electroconductive layer 12, a positive charge injection prevention layer 13, a charge generation 14 and a charge transport layer 15 disposed successively by coating on the electroconductive substrate 1, and further includes a charge generation layer 16 formed by coating thereon for improving the chargeability by charge injection.

The charge injection layer 16 formed as the surfacemost layer of the image-bearing member may have a volume resistivity in the range of $1\times10^{9}$–$1\times10^{14}$ ohm.cm. A similar effect can be obtained without such a charge injection layer 16 if the charge transport layer 15 forming the surfacemost layer has a volume resistivity in the above-described range. For example, an amorphous silicon photosensitive member having a surface layer volume resistivity of ca. $10^{13}$ ohm.cm exhibits good chargeability by charge injection. The charge injection layer 16 may contain electro-conductive particles.

A preferred organization of such a photosensitive member is described below.

The electroconductive substrate may comprise: a metal, such as aluminum or stainless steel; a plastic material coated with a layer of aluminum alloy or indium tin oxide; paper or plastic material impregnated with electroconductive particles; or a plastic material comprising an electroconductive polymer, in the form of a cylinder, a film or a sheet.

Such an electroconductive support may be coated with an undercoating layer for the purpose of, e.g., improved adhesion of a photosensitive layer thereon, improved coatability, protection of the substrate, coating of defects of the substrate, improved charge injection from the substrate, or protection of the photosensitive layer from electrical breakage. The undercoating layer may be formed of a material such as polyvinyl alcohol, poly-N-vinylimidazole, polyethylene oxide, ethyl cellulose, methyl cellulose, nitro cellulose, ethylene-acrylic acid copolymer, polyvinyl butyral, phanolic resin, casein, polyamide, copolymer nylon, glue, gelatin, polyurethane or aluminum oxide. The undercoating layer may have a thickness of ordinarily 0.1–10 μm, more preferably 0.1–3 μm.

A charge generation layer may be formed by applying a paint formed by dispersing a charge-generating substance, such as azo pigment, phthalocyanine pigment, indigo pigment, perylene pigment, polycyclic quinone, squalylium dye, pyrylium salt, thiopyrylium salt, triphenylmethane dye, or an inorganic substance such as selenium or amorphous silicon, or by vapor deposition of such a charge-generating substance. Among these, a phthalocyanine pigment is particularly preferred in order to provide a photosensitive member with a photosensitivity adapted to the present invention. Examples of the binder resin may include: polycarbonate resin, polyester resin, polyvinyl butyral resin, polystyrene resin, acrylic resin, methacrylic resin, phenolic resin, silicone resin, epoxy resin or vinyl acetate resin. The binder resin may occupy at most 80 wt. %, preferably 0–40 wt. %, of the charge generation layer. The charge generation layer may preferably have a thickness of at most 5 μm, particularly 0.05–2 μm.

The charge transport layer has a function of receiving charge carriers from the charge generation layer and transporting the carriers under an electric field. The charge transport layer may be formed by dissolving or dispersing a charge-transporting substance in a solvent, optionally together with a binder resin, and applying the resulting coating liquid. The thickness may generally be in the range of 5–40 μm. Examples of the charge-transporting substance may include: polycyclic aromatic compounds including structures of biphenylene, anthracene, peryrene and anthracene; nitrogen-containing cyclic compounds, such as indole, carbazole, oxadiazole and pyrazolile; hydrazone compounds; styryl compounds; polymers having a group derived from the foregoing aromatic compounds in their main chains or side chains; selenium; selenium-tellurium; amorphous silicon.

Examples of the binder dispersing or dissolved together with such charge-transporting substances may include: polycarbonate resin, polyester resin, polymethacrylate resin, polystyrene resin, acrylic resin, polyamide resin; and organic photoconductive polymers, such as poly-N-vinylcarbazole and polyvinylanthracene.

It is possible to use an electroconductive fine powder dispersion layer and/or a layer showing a contact angle of at least 85 deg. as mentioned above, as a surfacemost layer. Instead thereof, a protective layer may be disposed as a surface layer, comprising, e.g., a resin, such as polyester, polycarbonate, acrylic resin, epoxy resin, or phenolic resin, or a cured product of such a resin with a curing agent. These resins may be used singly or in combination of two or more species.

Such a protective layer may preferably contain electroconductive fine particles dispersed therein. The electroconductive fine particles may comprise a metal or a metal oxide. Preferred examples thereof may include: fine particles of zinc oxide, titanium oxide, tin oxide, antimony oxide, indium oxide, bismuth oxide, tin oxide-coated titanium oxide, tin-coated indium oxide, and antimony-coated tin oxide or zirconium oxide. These materials may be used singly or in combination of two or more species.

In the case where the electroconductive particles and/or lubricating particles are dispersed in the protective layer, it is necessary that the dispersed particles have a particle size smaller than the exposure light wavelength incident to the protective layer so as to avoid the scattering of incident light by the dispersed particles. Accordingly, the electroconductive and/or lubricating particles may preferably have a particle size of at most 0.5 μm. These particles may preferably be contained in 2–90 wt. %, more preferably 5–70 wt. %, of the total weight of the surfacemost layer. Below 2 wt. %, it becomes difficult to obtain a desired resistivity. The protective layer may preferably have a thickness of 0.1–10 μm, more preferably 1–7 μm.

The image forming method according to the present invention is particularly effective in the case where a contact transfer step is applied to a photosensitive member having a surface layer comprising a organic compound wherein the photosensitive member is liable to exhibit a stronger affinity with the binder resin of the toner particles than the other types of photosensitive member having an inorganic surface material, thus being liable to show a lower transferability.

The photosensitive member having organizations as mentioned above may also be used inclusive of various fine particles included in the surfacemost layer thereof in combination with such a contact transfer step.

The image forming method including such a contact transfer step may be particularly advantageously applicable to an image forming apparatus including a small-dia. photosensitive member having a diameter of at most 50 mm as an electrostatic latent image-bearing member. More specifically, as no independent cleaning step is included after the transfer step and before the charging step, the latitude of arrangement of the charging, exposure, developing and transfer means is increased and is combined with use of such a small dia.-photosensitive member to realize a reduction in entire size and space for installment of an image forming apparatus. This is also effective for an image forming apparatus including a belt-form photosensitive member having a curvature radius at an abutting position of at most 25 mm.

In the present invention, it is preferred that the latent image forming step of writing image data onto a charged surface of an image-bearing member is a step of subjecting the charged surface of the image-bearing member to imagewise exposure for writing the image data, and the latent image-forming means is an imagewise exposure means. The imagewise exposure means for electrostatic latent image formation is not restricted to a laser scanning exposure means for forming digital latent image formation, but may also be an ordinary analog imagewise exposure means or those using other types of light emission devices, such as LED, or a combination of a light emission device such as a fluorescent lamp and a liquid crystal shutter, etc. Thus, any imagewise exposure means capable of forming electrostatic latent images corresponding to image data can be used.

The image-bearing member can also be an electrostatic recording dielectric member. In this case, the dielectric surface as an image-bearing surface may be primarily uniformly charged to a prescribed potential of a prescribed polarity and then subjected to selective charge removal by charge removal means, such as a charge-removal stylus head or an electron gun, to write in objective electrostatic latent image.

Next, the developing step will be described. In the developing step of the image forming method according to the present invention, the above-mentioned toner of the present invention is used to develop an electrostatic latent image formed on the image-bearing member. First, a toner-carrying member used for the development will be described.

The toner-carrying member may preferably assume a form (generally called a "developing slave") which comprises an electroconductive cylinder, by itself or as a support, of a metal or alloy, such as aluminum or stainless steel. Such an electroconductive cylinder can also be formed of a resin composition having sufficient mechanical strength and electroconductivity, or may be surfaced with an electroconductive rubber. Instead of a cylindrical shape as mentioned above, it is also possible to use a toner-carrying member in the form of are endless belt.

In the developing step, it is preferred to form a toner layer at a coating rate of 5–50 g/m$^2$ on the toner-carrying member. If the coating rate is below 5 g/m$^2$ on the toner-carrying member, it is difficult to obtain a sufficient image density and a toner layer irregularity is liable to be formed due to an excessive toner charge. If the toner coating rate exceeds 50 g/m$^2$, toner scattering is liable to occur.

The toner-carrying member used in the present invention may preferably have a surface roughness (in terms of JIS center line-average surface roughness (Ra)) in the range of 0.2–3.5 $\mu$m. If Ra is below 0.2 $\mu$m, the toner on the toner-carrying member is liable to be charged excessively to have an insufficient developing performance. If Ra exceeds 3.5 $\mu$m, the toner coating layer on the toner-carrying member is liable to be accompanied with irregularities, thus resulting images with density irregularity. Ra is further preferably in the range of 0.5–3.0 $\mu$m.

More specifically, the surface roughness (Ra) values described herein are based on values measured as center line-average roughness values by using a surface roughness meter ("Surfcorder SE-3OH", available from K.K. Kosaka Kenkyusho) according to JIS B-0601. More specifically, based on a surface roughness curve obtained for a sample surface, a length of a is taken along a center line of the roughness curve. The roughness curve is represented by a function Y=f(x) while setting the X-axis on the center line and a roughness scale (y) on the Y-axis along the length x portion. A center line-average roughness Ra of the roughness curve is determined by the following formula (4):

$$Ra=(1/a)\cdot\int_0^a|f(x)|dx \quad (4).$$

As the toner of the present invention has a high chargeability, it is desirable to control the total charge thereof for use in actual development, so that the toner-carrying member used in the present invention may preferably be surfaced with a resin layer containing electroconductive fine particles and/or lubricating particles dispersed therein.

The electroconductive fine particles dispersed in the coating resin layer of the toner-carrying member may preferably exhibit a resistivity of at most 0.5 ohm.cm as measured under a pressure of 14.7 MPa (120 kg/cm$^2$).

The electroconductive fine particles may preferably comprise carbon fine particles, crystalline graphite particles or a mixture of these, and may preferably have a particle size of 0.005–10 $\mu$m.

Examples of the resin constituting the surface layer of the developer-carrying member may include: thermoplastic resin, such as styrene resin, vinyl resin polyethersulfone resin, polycarbonate resin, polyphenylene oxide resin, polyamide resin, fluorine-containing resin, cellulose resin, and acrylic resin; thermosetting resins, such as epoxy resin, polyester resin, alkyd resin, phenolic resin, urea resin, silicone resin and polyimide resin; and thermosetting resins.

Among the above, it is preferred to use a resin showing a releasability, such as silicone resin or fluorine-containing resin; or a resin having excellent mechanical properties, such as polyethersulfone, polycarbonate, polyphenylene oxide, polyamide, phenolic resin, polyester, polyurethane resin or styrene resin. Phenolic resin is particularly preferred.

The electroconductive fine particles may preferably be used in 10–200 wt. parts per 100 wt. parts of the resin. In the case of using a mixture of carbon particles and graphite particles, the carbon particles may preferably be used in 10 to 500 wt. parts per 10 wt. parts of the graphite particles. The coating layer containing the electroconductive fine particles of the toner-carrying member may preferably have a volume resistivity of $10^{-6}$ to $10^{6}$ ohm.cm, more preferably $10^{-1}$ to $10^{6}$ ohm.cm.

In the developing step of the image forming method according to the present invention, by moving to the toner-carrying member for carrying and conveying the toner to the developing region with a surface speed difference relative to the image-bearing member at the developing region, it becomes possible to sufficiently supply the toner particles and the fine particles from the toner-carrying member to the image-bearing member, thereby providing good images.

The surface moving direction of the toner-carrying member may be identical to or reverse to that of the image-bearing member at the developing region. In the case of identical surface-moving direction, the surface-moving speeds of the toner-carrying member and the image-bearing member may preferably be set to provide a speed ratio of at least 1.05 according to the following equation.

Speed ratio (times)=Toner-carrying member surface speed/image-bearing member-surface speed.

If the speed ratio is below 1.05, the image quality can be lowered in some cases. At a higher speed ratio, the amount of toner supplied to the developing region is increased, and the frequency of attachment to and removed from the image-bearing member of the toner is increased to provide a toner image faithful to a latent image through a repetition of toner removal from an unnecessary part and toner attachment to a necessary part of the latent image. More specifically, the speed ratio is preferably in the range of 1.05 to 3.0 times. At a speed ratio in excess of 3.0, the toner deterioration is liable to be promoted in continuous image formation.

In the developing region, the toner-carrying member and the photosensitive member are disposed opposite to each other with a certain gap therebetween, so as to achieve a non-contact developing step. In order to obtain fog-free high-quality images, it is preferred to apply the toner in a layer thickness, which is smaller than the closest gap between the toner-carrying member and the photosensitive member, on the toner-carrying member and effect the development under application of an alternating voltage. The small toner layer thickness on the toner-carrying member may be achieved by the action of the toner layer thickness-regulating member. Thus, the development is effected in a state of no contact between the toner layer on the toner-carrying member and the photosensitive member (image-bearing member) in the developing region. As a result, it is possible to obviate development fog caused by injection of the developing bias voltage to the image-bearing member even if electroconductive fine particles having a low resistivity is added into the toner. The toner layer thickness-regulating member may preferably be an elastic member abutted against the toner-carrying member via the toner so as to uniform charge the toner.

More specifically, it is preferred that the toner-carrying member is disposed with a spacing of 100–1000 μm from the image-bearing member. A spacing of 120–500 μm is further preferred.

If the spacing is below 100 μm, the developing performance with the toner is liable to be fluctuated depending on a fluctuation of the spacing, so that it becomes difficult to mass-produce image-forming apparatus satisfying stable image qualities. If the spacing exceeds 1000 μm, the followability of toner onto the latent image on the image-bearing member is lowered, thus being liable to cause image quality lowering, such as lower resolution and lower image density.

In the present invention, it is preferred to operate the developing step under application of an alternating electric field (AC electric field) between the toner-carrying member and the image-bearing member. The alternating developing bias voltage may be a superposition of a DC voltage with an alternating voltage (AC voltage).

The alternating bias voltage may have a waveform which may be a sine wave, a rectangular wave, a triangular wave, etc., as appropriately be selected. It is also possible to use pulse voltages formed by periodically turning on and off a DC power supply. Thus, it is possible to use an alternating voltage waveform having periodically changing voltage values.

It is preferred to form an AC electric field at a peak-to-peak intensity of $3\times10^6$–$10\times10^6$ V/m and a frequency of 100 to 5000 Hz between the toner-carrying member and the image-bearing member by applying a developing bias voltage.

If the AC electric field strength is below $3\times10^6$ V/m, the performance of recovery of transfer-residual toner is lowered, thus being liable to result in foggy images. Further, because of a lower developing ability, images having a lower density are liable to be formed. On the other hand, if the AC electric field exceeds $1\times10^7$ V/m, too large a developing ability is liable to result in a lower resolution because of collapsion of thin lines and image quality deterioration due to increased fog, a lowering in chargeability of the image-bearing member and image defects due to leakage of the developing bias voltage to the image-bearing member. If the frequency of the AC electric field is below 100 Hz, the frequency of toner attachment onto and toner removal from the latent image is lowered and the recovery of transfer-residual toner is liable to be lowered, thus being liable to result in a lower developing performance. If the frequency exceeds 5000 Hz, the amount of toner following the electric field change is lowered, thus being liable to result in a lowering in transfer-residual toner recovery and a lowering in developing performance.

By applying an AC bias developing field, it becomes possible to obviate charge injection to the image-bearing member at the developing region even in case of a high potential difference between the toner-carrying member and the image-bearing member, whereby the fine particles added to the toner can be easily transferred to the image-bearing member, thus providing a good charging performance in the charging step.

Now, a contact transfer step preferably adopted in the image forming method of the present invention will be described.

The transfer step of the present invention can be a step of once transferring the toner image formed in the developing step to an intermediate transfer member and then re-transferring the toner image onto a recording medium, such as paper. Thus, the transfer(-receiving) material receiving the transfer of the toner image from the image-bearing member can be an intermediate transfer member, such as a transfer drum.

In the present invention, it is preferred to adopt a contact transfer step wherein a toner image on the image-bearing member is transferred onto a transfer(-receiving) material while abutting a transfer(-promoting) member against the image-bearing member via the transfer material, and the abutting pressure of the transfer member may preferably be a linear pressure of at least 2.9 N/m (3 g/cm), more preferably at least 19.6 N/m (20 g/cm). If the abutting pressure is below 2.9 N/m, difficulties, such as deviation in conveyance of the transfer material and transfer failure, are liable to occur.

Figure 4:
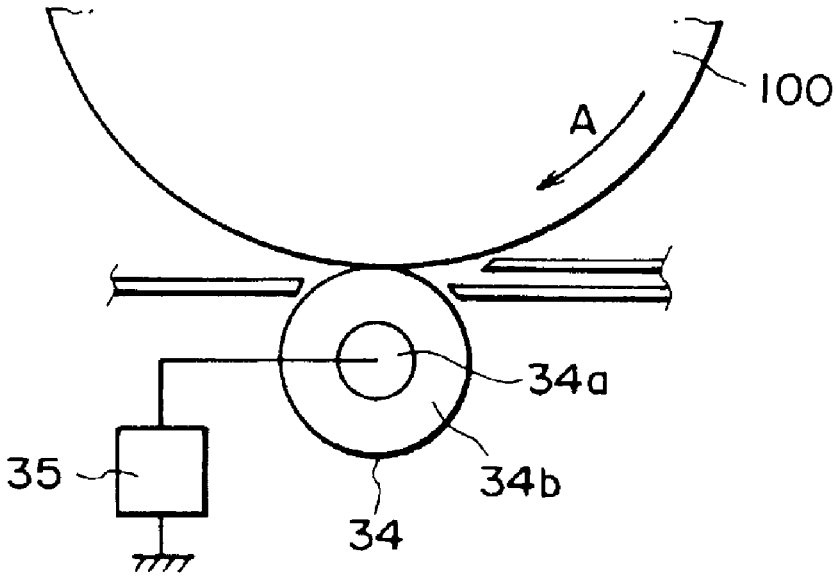
FIG. 4 illustrates an organization of a contact transfer member used in an image forming method of the invention.

The transfer member used in the contact transfer step may preferably be a transfer roller as illustrated in FIG. 4 or a transfer belt. Referring to FIG. 4, a transfer roller 34 may comprise a core metal 34*a* and a conductive elastic layer 34*b* coating the core metal 34*a* and is abutted against a photosensitive member 100 so as to be rotated following the rotation of the photosensitive member 100 rotated in an indicated arrow A direction. The conductive elastic layer 34*b* may comprise an elastic material, such as polyurethane rubber or ethylene-propylene-diene rubber (EPDM), and an electroconductivity-imparting agent, such as carbon black, dispersed in the elastic material so as to provide a medium level of electrical resistivity (volume resistivity) of $1\times10^6$–$1\times10^{10}$ ohm.cm. The conductive elastic layer may be formed as a solid or foam rubber layer. The transfer roller 34 is supplied with a transfer bias voltage from a transfer bias voltage supply 35.

Next, a developing and cleaning image forming method (cleanerless image forming system) as an embodiment of the present invention, will be described with reference to FIG. 5.

Figure 5:
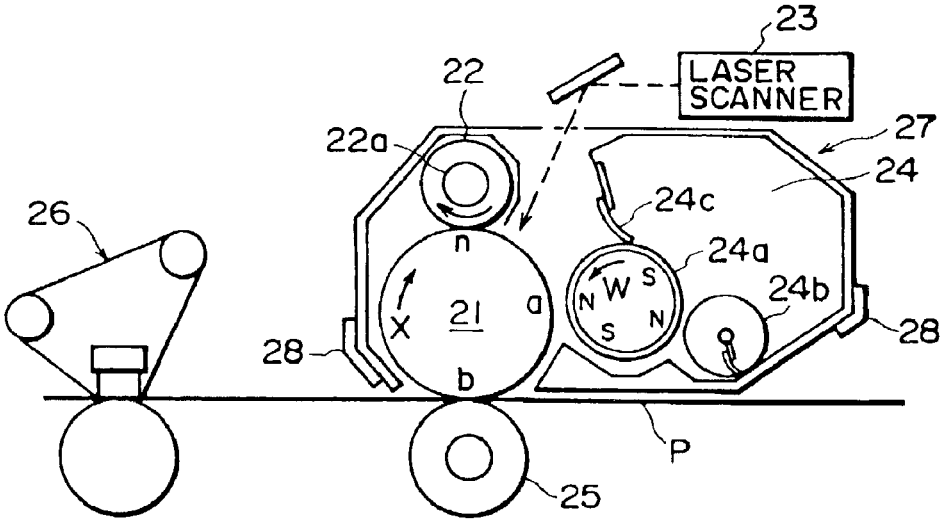

FIG. 5 roughly illustrates an organization of such a cleanerless image forming apparatus.

The image forming apparatus shown in FIG. 5 is a laser beam printer (recording apparatus) according to a transfer-type electrophotographic process and including a developing-cleaning system (cleanerless system). The apparatus includes a process-cartridge from which a cleaning unit having a cleaning member, such as a cleaning blade, has been removed. The apparatus uses a mono-component magnetic toner and a non-contact developing system wherein a toner-carrying member is disposed so that a toner layer carried thereon is in no contact with a photosensitive member for development.

Referring to FIG. 5, the image forming apparatus includes a rotating drum-type OPC photosensitive member 21 (Photosensitive member B prepared above) (as an image-bearing member), which is driven for rotation in an indicated arrow X direction (clockwise) at a prescribed peripheral speed (process speed).

A charging roller 22 (as a contact charging member) is abutted against the photosensitive member 21 at a prescribed pressing force in resistance to its elasticity. Between the photosensitive member 21 and the charging roller 22, a contact nip n is formed as a charging section. The charging roller 22 is rotated in an opposite direction (with respect to the surface movement direction of the photosensitive member 21) at the charging section n. Prior to the operation, the above-mentioned fine particles are applied on the charging roller 22 surface at a uniform density.

The charging roller 22 has a core metal 22*a* to which a prescribed DC voltage is applied from a charging bias voltage supply. As a result, the photosensitive member 21 surface is uniformly charged at a potential almost equal to the voltage applied to the charging roller 22.

The apparatus also includes a laser beam scanner 23 as an exposure means. The laser beam scanner outputs laser light so as to scanningly expose the uniformly charged surface of the photosensitive member 21, thereby forming an electrostatic latent image corresponding to the objective image data on the rotating photosensitive member 21.

The apparatus further includes a developing device 24, which is a non-contact-type reversal development apparatus.

The developing device 24 further included a non-magnetic developing sleeve 24*a* (as a developer-carrying member) and a developer-stirring member 24*b* for supplying the toner to the developing sleeve 24*a*. In the developing region a, the developing sleeve 24*a* is rotated in an indicated arrow W direction at a prescribed peripheral speed. A toner is applied as a thin coating layer on the developing sleeve 24*a* by means of an elastic blade 24*c* while also be charged thereby.

The toner applied as a coating on the developing sleeve 24*a* is conveyed along with the rotation of the sleeve 24*a* to the developing section a where the photosensitive member 21 and the sleeve 24*a* are opposite to each other. The sleeve 24*a* is further supplied with a developing bias voltage from a developing bias voltage supply (not shown) to effect mono-component jumping development between the developing sleeve 24*a* and the photosensitive member 21.

The apparatus further includes a medium-resistivity transfer roller 25 (as a contact transfer means), which is abutted at a prescribed linear pressure against the photosensitive member 21 to form a transfer nip b. To the transfer nip b, a transfer material P as a recording medium is supplied from a paper supply section (not shown), and a prescribed transfer bias voltage is applied to the transfer roller 25 from a voltage supply, whereby toner images on the photosensitive member 21 are successively transferred onto the surface of the transfer material P supplied to the transfer nip b.

By using transfer roller 25 having a prescribed resistivity and supplied with a DC voltage to perform the transfer. Thus, the transfer material P is introduced to the transfer nip b, and the toner images on the photosensitive member 21 surface are successively transferred onto the transfer material P under the action of an electrostatic force and a pressing force.

A fixing device 26 of, e.g., the heat fixing type is also included. The transfer material P having received a toner image from the photosensitive member 1 at the transfer nip b is separated from the photosensitive member 1 surface and introduced into the fixing device 26, where the toner image is fixed to provide an image product (print or copy) to be discharged out of the apparatus.

In the image forming apparatus, the cleaning unit has been removed, transfer-residual toner particles remaining on the photosensitive member 1 surface after the transfer of the toner image onto the transfer material P are not removed by such a cleaning means but, along with the rotation of the photosensitive member 21, sent via the charging section n to reach the developing section a, where they are subjected to a developing-cleaning operation to be recovered.

In the image forming apparatus shows in FIG. 5, three process units, i.e., the photosensitive member 21, the charging roller 22 and the developing device 24 are inclusively supported to form a process-cartridge 27, which is detachably mountable to a main assembly of the image forming apparatus via a guide and support member 28. A process-cartridge may be composed of other combinations of devices.

EXAMPLES

Hereinbelow, the present invention will be described more specifically based on Examples, which should not be however construed to restrict the scope of the present invention in any way. In the following description, "part(s)" used for describing compositions are by weight.

(A-1) Production of Fine Particles (1) Fine Particles A-1

Aqueous solutions of tin chloride ($SnCl_4.5H_2O$) and tungstic acid ($H_2WO_4$) were blended to provide a mixture solution having a mol ratio (W/Sn) of 0.05 between tungsten (W) and tin (Sn). Into an aqueous dispersion of 200 parts of titanium oxide particles (base particles) in 2000 parts of water under stirring, the above-prepared mixture solution was added dropwise in a ratio giving a tin:titanium oxide weight ratio of 2.2:1, and the resultant precipitate was filtered out, dried and calcined at 600° C. in an electric furnace of nitrogen atmosphere. The calcined product was disintegrated and classified to provide Fine particles A-1 having a volume-average particle size (Dv)=0.8 $\mu$m, Sn/B (wt. ratio)=2.0, W/Sn (mol ratio)=0.045, and a volume resistivity (Rv)=$9\times10^3$ ohm.cm.

(2) Fine Particles A-2

Fine particles A-2 were prepared in the same manner as Fine particles A-1 except for using a mixture aqueous solution of tin chloride ($SnCl_4.5H_2O$) and tungstic acid ($H_2WO_4$) having a W/Sn mol ratio of 0.015 and changing the rate of the mixture aqueous solution to the titanium oxide and calcining condition. Fine particles A-2 thus obtained exhibited Dv=0.9 $\mu$m, Rv=$3\times10^6$ ohm.cm, Sn/B (wt.)=0.01 and W/Sn (mol)=0.01.

(3) Fine Particles A-3

Fine particles A-3 were prepared in the same manner as Fine particles A-1 except for using a mixture aqueous solution of tin chloride ($SnCl_4.5H_2O$) and tungstic acid ($H_2WO_4$) having a W/Sn mol ratio of 0.10 and changing the rate of the mixture aqueous solution to the titanium oxide and calcining condition. Fine particles A-3 thus obtained exhibited Dv=0.8 $\mu$m, Rv=$1\times10^4$ ohm.cm, Sn/B (wt.)=1.6 and W/Sn (mol)=0.10.

(4) Fine Particles A-4

Fine particles A-4 were prepared in the same manner as Fine particles A-1 except for using spherical silica instead of the titanium oxide, using a mixture aqueous solution of tin chloride ($SnCl_4.5H_2O$) and tungstic acid ($H_2WO_4$) having a W/Sn mol ratio of 0.10 and changing the rate of the mixture aqueous solution to the spherical silica and calcining condition. Fine particles A-4 thus obtained exhibited Dv=2.1 $\mu$m, Rv=$3\times10^4$ ohm.cm, Sn/B (wt.)=0.8 and W/Sn (mol)=0.10.

(5) Fine Particles A-5

Fine particles A-5 were prepared in the same manner as Fine particles A-1 except for using titanium oxide of a different particle size, using a mixture aqueous solution of tin chloride ($SnCl_4.5H_2O$) and tungstic acid ($H_2WO_4$) having a W/Sn mol ratio of 0.075 and changing the rate of the mixture aqueous solution to the titanium oxide and calcining condition. Fine particles A-5 thus obtained exhibited Dv=0.4 $\mu$m, Rv=$2\times10^4$ ohm.cm, Sn/B (wt.)=1.8 and W/Sn (mol)=0.075.

(A-2) Production of Toner Particles (1) Toner Particles A-1

100 parts of polyesters resin (Tg=63° C., molecular weights: Mp=7800, Mn=3500 and Mw=61000), 5 parts of carbon black, 2 parts of monoazo metal complex (negative charge control agent), and 35 parts of low-molecular weight ethylene-propylene copolymer (Tabs (heat-absorption main peak temperature)=84° C., Tevo (heat-evolution main peak temperature)=86° C.) were blended by a HENSCHEL MIXER and melt-kneaded through a twin-screw extruder set at 135° C. After being cooled, the melt-kneaded product was crushed by a hammer mill, pulverized by a mechanical pulverizer and classified by a pneumatic classifier to obtain Toner particles A-1 (non-magnetic) having a weight-average particle size (D4) of 6.8 μm.

(2) Toner Particles A-2

Toner particles A-2 (non-magnetic) of D4=7.9 μm were prepared in the same manner as Toner particles A-1 except for using styrene-butyl acrylate copolymer (Tg=59° C., molecular weight: Mp=18,000, Mn=13,000, Mw=$3.15\times10^5$) instead of the polyester resin.

(3) Toner particles A-3

Toner particles A-3 (magnetic) of D4=7.1 μm were prepared in a similar manner as Toner particles A-1 except for changing the toner ingredients to 100 parts of styrene-butyl acrylate-monobutyl maleate copolymer (Tg=63° C., molecular weights: Mp=15500, Mn=6800 and Mw=$2.4\times10^5$), 90 parts of magnetic iron oxide (average particle size (Dav)=0.22 μm, $\sigma_s$=83.8 $m^2$/kg), 2.5 parts of monoazo metal complex (negative charge control agent), and 3 parts of low-molecular weight ethylene-propylene copolymer.

Example A-1

(1) Toner A-1

100 parts of Toner particles A-1, 1.5 parts of Fine particles A-1, and 1.2 parts of hydrophobic silica fine powder treated with dimethylsilicone oil were blended by a HENSCHEL MIXER to prepare Toner A-1, which exhibited a surface-attached fine particle ratio of 5.0 particles per 1 toner particle, and a fine particle (Dv)/toner particle (D4) diameter ratio of 0.09.

(2) Carrier A-1

Carrier A-1 was prepared by coating 100 parts of ferrite particles of 45 μm with 0.8 part of acrylic resin.

(3) Two-component Developer A-1

Two-component developer A-1 was prepared by blending Developer carrier A-1 and Toner A-1 in a weight ratio of 100:7.

The thus obtained Developer A-1 was evaluated in the following manner.

Evaluation Method

Image formation was performed by using a digital copying machine having an a-Si (amorphous silicon) photosensitive member ("GP405", made by Canon K.K.) after remodeling of changing the monocomponent jumping developing device to a two-component developing device, using a developing sleeve prepared by blasting a SUS sleeve with glass beads to provide a surface roughness Ra=1.0 μm. The development was performed by applying a developing bias voltage comprising a DC voltage of 300 volts superposed with an AC voltage of 1 kvpp and 2 kHz to the developing sleeve, while rotating the developing sleeve in a direction identical to that of the photosensitive member and at a surface-moving speed ratio of 150% with respect to the photosensitive member in the developing region.

For evaluation of the image forming performance, a continuous image formation on 20,000 sheets was performed by using a test chart having an image areal percentage of 6% in an environment of 23° C./60% RH. The evaluation was performed with respect to image fog, thin line reproducibility and effect on wearing of the photosensitive member after the continuous image formation.

Image fog was evaluated by measuring the reflectances of blank white paper and a white background portion of the white paper after the printing by using a reflectance meter ("REFLECTMETER", made by Tokyo Denshoku K.K.) to take a difference therebetween as a fog (%). Based on the measured fog (%) value, the evaluation was performed according to the following standard.

A: fog (%)<0.5%

B: 0.5%≦fog (%)<1.0%

C: 1.0%≦fog (%)<2.0%

D: fog (%)≧2.0%

Thin-line reproducibility (Thin line) was evaluated according to the following standard.

A: Good thin-line reproducibility.

B: Slight degree of thinning or overlapping of thin lines was observed but at a level of practically no problem.

C: Thinning or overlapping of thin lines observed partly.

D: Conspicuous thinning or overlapping of thin lines.

Photosensitive member wearing (Wearing) was evaluated based on image density change and image fog attributable to the wearing of the photosensitive member according to the following standard.

A: No image deterioration attributable to wearing.

B: Slight image density lowering occurred but at a level of practically no problem.

C: Image density change and image fog occurred partly.

D: Conspicuous image density change and image fog.

The results of evaluation are inclusively shown in Table 1 appearing hereinafter together with those of the following Examples and Comparative Examples. As shown in Table 1, high quality images were obtained in this Example 1 in all respects of the above evaluation.

Example A-2

Toner A-2 and then Two-component Developer A-2 were prepared and evaluated in the same manner as in Example A-1 except for using Toner particles A-2 and Fine particles A-2 and changing the addition amount of the fine particles to 1.0 part.

Toner A-2 exhibited a surface-attached fine particle ratio of 2.2 particles/toner particle and a fine particle (Dv)/toner particle (D4) diameter ratio of 0.07.

Example A-3

Toner A-3 was prepared in the same manner as Toner A-1 in Example A-1 except for using Toner particles A-3 and Fine particles A-3 and changing the amount of the fine particles to 3.0 parts. Toner A-3 exhibited a surface-attached fine particle ratio of 10.5 particles/toner particle, and a fine particle/toner particle diameter ratio of 0.08.

Toner A-3 was evaluated in the same manner as in Example A-1 except for using a mono-component developing device including a blasted SUS developing sleeve of Ra=0.6 μm instead of the two-component developing device.

Example A-4

Toner A-4 was prepared in the same manner as Toner A-1 in Example A-1 except for using Toner particles A-3 and Fine particles A-4 and changing the amount of the fine particles to 1.0 part. Toner A-4 exhibited a surface-attached fine particle ratio of 1.1 particles/toner particle, and a fine particle/toner particle diameter ratio of 0.21.

Toner A-4 instead of Toner A-3 was evaluated in the same manner as in Example A-3.

Example A-5

The image forming apparatus after the evaluation in Example A-1 was moved to an environment of 30° C./80% RH, left standing for 24 hours in the environment and then subjected to image formation and evaluation with respect to the same items as in Example A-1.

As a result, good images free from image fog and excellent thin-line reproducibility were obtained from the initial stage to confirm a good chargeability rise at the standup stage. Good image qualities were retained throughout the continuous image formation, and identical image qualities as in Example A-1 were retained also in the final stage.

The image forming apparatus was further moved to an environment of 15° C./10% RH, left standing for 24 hours in the environment and subjected to image formation and evaluation with respect to the same items in Example A-1.

As a result, from the initial stage of the continuous image formation, good triboelectric chargeabilities free from excessive charge or irregular charge were confirmed from the initial stage. Good image qualities were retained throughout the continuous image formation, and identical image qualities as in Example A-1 were retained at the final stage.

Further, no image quality lowering attributable to wearing of the developing sleeve was recognized.

Comparative Example A-1

A mixture aqueous solution of antimony chloride and tin chloride containing antimony (Sb) and tin in a mol ratio (Sb/Sn) of 0.02 was co-precipitated on silica particles dispersed in the aqueous solution and calcined to prepare silica particles coated with a conductive Sb-doped tin oxide layer ($Rv=5\times10^2$ ohm.cm, Dv =1.5 μm, Sn/B=1.0, W/Sn=0). Comparative Toner A-1 was prepared by using the coated silica particles instead of Fine particles A-1 and evaluated otherwise in the same manner as in Example A-1.

Comparative Example A-2

A mixture of $SnO_2$-coated barium sulfate particles and $SnF_2$ was calcined to prepare electroconductive particles coated with a fluorine-doped $SnO_2$ layer ($Rv=3\times10^4$ ohm.cm, Dv=1.1 μm, Sn/B=2.5, W/Sn=0). Comparative Toner A-2 was prepared by using the coated barium sulfate particles instead of Fine particles A-1 and evaluated otherwise in the same manner as in Example A-1.

Comparative Example A-3

Comparative Toner A-3 was prepared by using ZnO-coated titanium oxide particles (Dv=5.5 μm, Zn/B=1.9) instead of Fine particles A-1 and evaluated otherwise in the same manner as in Example A-1.

The results of evaluation of the above-mentioned Examples and Comparative Examples are inclusively shown in Table 1 below.

TABLE 1

| Example | Image fog | Thin-line reproducibility | Wearing |
|---|---|---|---|
| A-1 | A | A | A |
| A-2 | A | A | A |
| A-3 | A | A | A |
| A-4 | A | A | A |
| Comp. A-1 | D | B | C |

TABLE 1-continued

| Example | Image fog | Thin-line reproducibility | Wearing |
|---|---|---|---|
| Comp. A-2 | D | B | C |
| Comp. A-3 | D | C | D |

Production of Tungsten-containing Tin Compound-coated Fine Particles (Fine Particles B-1)

Aqueous solutions of tin chloride ($SnCl_4.5H_2O$) and tungsten acid ($H_2WO_4$) were blended to provide a mixture aqueous solution containing tungsten (W) and tin (Sn) in a mol ratio (W/Sn) of 0.05. Into an aqueous dispersion of 200 parts of titanium oxide particles (base particles) in 2000 parts of water at 90° C. under stirring, the above-prepared mixture aqueous solution was added dropwise so as to provide a tin (Sn)/titanium oxide (B) weight ratio of 0.6, followed by addition of hydrochloride to cause co-precipitation. The co-precipitation product was filtered out, dried and calcined at 600° C. in an electric furnace of nitrogen atmosphere. The calcined product was disintegrated and classified to provide Fine particles B-1 (Dv=0.8 μm, Sn/B (wt.)=0.59, W/Sn (mol)=0.045, $Rv=9\times10^3$ ohm.cm).

The properties of Fine particles B-1 are inclusively shown in Table 2 together with those of fine particles prepared in the following Production Examples.

(Fine Particles B-2)

Fine particles B-2 were prepared in the same manner as Fine particles B-1 except for changing the W/Sn ratio and the calcining condition. Fine particles B-2 thus obtained exhibited Dv=0.8 μm, $Rv=1\times10^4$ ohm.cm, Sn/B (wt.)=0.59 and W/Sn (mol)=0.92.

(Fine Particles B-3)

Fine particles B-3 were prepared in the same manner as Fine particles B-1 except for using spherical silica particles instead of the titanium oxide particles and changing the amount of the mixture aqueous solution of tin chloride ($SnCl_4.5H_2O$) and tungstic acid ($H_2WO_4$). Fine particles B-3 thus obtained exhibited Dv=7.9 μm, $Rv=1\times10^4$ ohm.cm, Sn/B (wt.)=0.52 and W/Sn (mol)=0.093.

(Fine Particles B-4)

Fine particles B-4 were prepared in the same manner as Fine particles B-1 except for changing the W/Sn ratio and using titanium oxide particles of a different particle size. Fine particles B-4 thus obtained exhibited Dv=0.03 μm, $Rv=2\times10^5$ ohm.cm, Sn/B (wt.)=0.58 and W/Sn (mol)=0.069.

(Fine Particles B-5)

Fine particles B-5 were prepared in the same manner as Fine particles B-1 except for changing the W/Sn ratio, using spherical silica particles instead of the titanium oxide particles and reducing the amount of the mixture aqueous solution to ca. 1/20 of that for production of Fine particles B-1. Fine particles B-5 thus obtained exhibited Dv=0.3 μm, $Rv=4\times10^8$ ohm.cm, Sn/B (wt.)=0.04 and W/Sn (mol)=0.092.

(Fine Particles B-6)

Fine particles B-6 were prepared in the same manner as Fine particles B-1 except for using a mixture aqueous solution of tin chloride and antimony trichloride instead of the tungstic acid. Fine particles B-6 thus obtained exhibited Dv=1.2 μm, $Rv=6\times10^6$ ohm.cm, Sn/B (wt.)=0.68 and Sb/Sn (mol)=5.9.

(Fine particles B-7)

Fine particles B-7 were prepared in the same manner as Fine particles B-1 except for using a mixture aqueous solution of tin chloride, tungstic acid and antimony trichloride having a W/Sn mol ratio of 0.0007 and an Sb/Sn mol ratio of 0.07. Fine particles B-7 thus obtained exhibited Dv=0.6 μm, $Rv=9\times10^7$ ohm.cm, Sn/B (wt.)=0.90 and W/Sn (mol)=0.0005.

(Fine particles B-8)

Fine particles B-8 were prepared in the same manner as Fine particles B-1 except for using a mixture aqueous solution of tin chloride and tungstic acid having a W/Sn (mol) ratio of 0.0015. Fine particles B-8 thus obtained exhibited Dv=0.7 μm, Rv=$1\times10^9$ ohm.cm, Sn/B (wt.)=0.70 and W/Sn (mol)=0.001.

(Fine particles B-9)

Fine particles B-9 were prepared in the same manner as Fine particles B-1 except for using a mixture aqueous solution of tin chloride and tungstic acid having a W/Sn (mol) ratio of 0.29 and changing the calcining condition. Fine particles B-9 thus obtained exhibited Dv=1.2 μm, Rv=$3\times10^8$ ohm.cm, Sn/B (wt.)=0.60 and W/Sn (mol)=0.26.

(Fine particles B-10)

Fine particles B-10 were prepared in the same manner as Fine particles B-1 except for using a mixture aqueous solution of tin chloride and tungstic acid having a W/Sn (mol) ratio of 0.35 and changing the calcining condition. Fine particles B-10 thus obtained exhibited Dv=1.5 μm, Rv=$1\times10^9$ ohm.cm, Sn/B (wt.)=0.48 and W/Sn (mol)=0.32.

(Fine particles B-1)

Fine particles B-1 were prepared in the same manner as Fine particles B-1 except for using a mixture aqueous solution of tin chloride and tungstic acid having a W/Sn (mol) ratio of 0.10 using spherical silica particles instead of the titanium oxide particles and reducing the amount of the mixture aqueous solution to ca. 1/40. Fine particles B-1 thus obtained exhibited Dv=1.5 μm, Rv=$3\times10^9$ ohm.cm, Sn/B (wt.)=0.02 and W/Sn (mol)=0.092.

With respect to each of the above-prepared Fine particles B-1 to B-5 and B-7 to B-11, the fine particles after the ESCA analysis for W/Sn calculation were subjected to argon ion etching for different periods of time. As a result, the W/Sn (mol) ratio was almost constant at different etching periods. Further, with continuation of the argon ion etching, the W and Sn were decreased at equal rates compared with the titanium or silicon element, and it was confirmed that the W and Sn elements were principally present at the surfaces of the base particles.

The properties of the above-prepared Fine particles B-1 to B-11 are summarized in the following Table 2.

TABLE 2

Properties of Fine particles

| Fine particles | Sn/B ratio (wt.) | W/Sn ratio (mol) | Dv (μm) | % of ≧5 μm *1 | Rv (ohm · cm) | Transmittance (%) *2 |
|---|---|---|---|---|---|---|
| B-1 | 0.59 | 0.045 | 0.8 | 0 | $9\times10^3$ | 35 |
| B-2 | 0.59 | 0.092 | 0.8 | 0 | $1\times10^4$ | 35 |
| B-3 | 0.52 | 0.093 | 7.9 | 61 | $1\times10^4$ | 20 |
| B-4 | 0.58 | 0.069 | 0.03 | 0 | $2\times10^5$ | 45 |
| B-5 | 0.04 | 0.092 | 0.3 | 0 | $4\times10^8$ | 40 |
| B-6 | 0.68 | 0.092 | 1.2 | 3 | $6\times10^8$ | 35 |
| B-7 | 0.90 | 0.0005 | 0.6 | 0 | $9\times10^7$ | 35 |
| B-8 | 0.70 | 0.001 | 0.7 | 0 | $1\times10^9$ | 35 |
| B-9 | 0.60 | 0.26 | 1.2 | 2 | $3\times10^8$ | 35 |
| B-10 | 0.48 | 0.32 | 1.5 | 3 | $1\times10^9$ | 30 |
| B-11 | 0.02 | 0.092 | 0.3 | 0 | $3\times10^9$ | 40 |

*1: % by number of particles having a diameter of 5 μm or larger.

*2: Transmittance (%) of exposure laser light through a mono-particle layer of fine particles.

Toner Production Examples (Toner B-1)

| | |
|---|---|
| Styrene/n-butyl acrylate (80/20 by mol) copolymer | 20 parts |
| Negative charge control agent (Monoazo dye compound of Formula (1) below) | 4 parts |
| Magnetite | 80 parts |
| Low-molecular weight polyethylene | 5 parts |

(Formula (1)

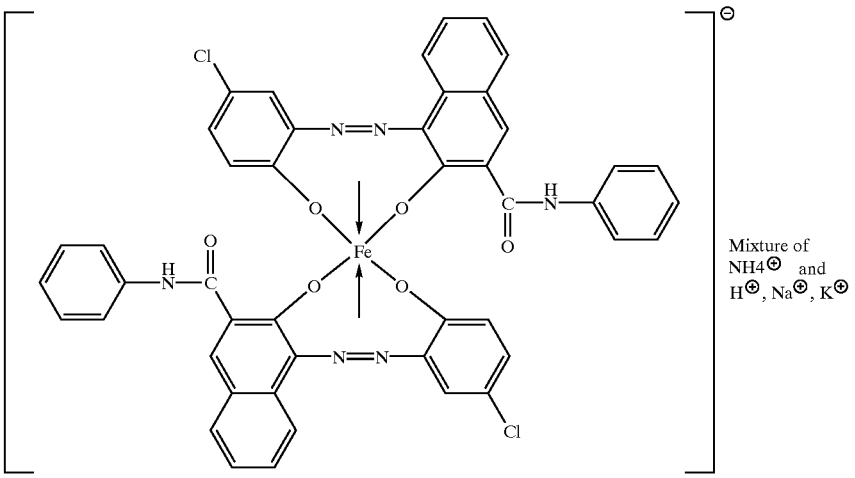

The above ingredients were blended by a blender and melt-kneaded by a twin-screw extruder heated at 110° C. After being cooled, the melt-kneaded product was coarsely crushed by a hammer mill, finely pulverized by a jet mill and pneumatically classified to obtain toner particles of D4=7.3 μm. Then, 100 parts of the toner particles were blended with 1.2 parts of silica fine powder successively treated with hexamethyldisilazane and silicone oil to have a BET specific surface area (SBET) of 120 $m^2/g$ and 2.0 parts of Fine particles B-1 by a HENSCHEL MIXER, thereby obtaining Toner B-1. Some properties of Toner B-1 are inclusively shown in Table 3 together with Toners obtained in the following Production Examples.

(Toners B-2 to B-7)

Toners B-2 to B-7 were prepared in the same manner as Toner B-1 except for using Fine particles B-2 to B-5, B-8 and B-9, respectively, instead of Fine particles B-1.

(Toner B-8)

Toner particles of D4=7.3 μm were prepared in the same manner as in the production of Toner B-1. Then, a mixture of 100 parts of the toner particles and 2.0 parts of Fine particles B-1 was subjected to a surface modification by an impact-type surface-treatment apparatus ("HYBRIDIZER") made by Nara Kikai K.K.). Then, the treated product was blended with 1.2 parts of the same hydrophobized silica fine powder as used in the production of Toner B-1 by a HENSCHEL MIXER to obtain Toner B-8.

(Toner B-9)

Toner particles of D4=2.9 μm were prepared in a similar manner as in the production of Toner B-1 except for changing the conditions for the pulverization and pneumatic classification. Then, 100 parts of the toner particles were blended with 2.5 parts of the hydrophobic silica fine powder and 2.0 parts of Fine particles B-1 respectively used in the production of Toner B-1 by a HENSCHEL MIXER to obtain Toner B-9.

(Toner B-10)

Toner particles of D4=10.2 μm were prepared in a similar manner as in the production of Toner B-1 except for changing the conditions for the pulverization and pneumatic classification. Then, 100 parts of the toner particles were blended with 2.5 parts of the hydrophobic silica fine powder and 0.9 part of Fine particles B-1 respectively used in the production of Toner B-1 by a HENSCHEL MIXER to obtain Toner B-10.

(Toner B-11)

Into a ferrous sulfate aqueous solution, a caustic soda solution was blended to form an aqueous solution containing ferrous oxide, into which air was blown to prepare a slurry liquid containing seed crystals.

In the slurry liquid, the ferrous iron content was adjusted to be 0.9 to 1.05 equivalents of the alkali, and air was further blown thereinto to proceed with the oxidation. After the oxidation, the resultant magnetic iron oxide particles were washed and recovered in a wet state by filtration. The wet magnetic iron oxide particles without drying were re-dispersed in another aqueous medium, and under a sufficient stirring, a silane coupling agent ($n\text{-}C_{10}H_{21}Si(OCH_3)_3$) was added thereto to effect a coupling treatment. The resultant hydrophobized iron oxide particles were washed, filtered out and dried in ordinary manners to obtain a surface-treated magnetic material.

Then, into 710 parts of deionized water, 450 parts of 0.1 mol/l-$Na_3PO_4$ aqueous solution was added, and after warming at 60° C., 67 parts of 1.0 mol/l-$CaCl_2$ aqueous solution was gradually added to form an aqueous medium containing $Ca_3(PO_4)_2$.

Separately, the following ingredients were uniformly dispersed and mixed by an attritor (made by Mitsui Miike Kakoki K.K.) to form a monomer composition.

| | |
|---|---|
| Styrene | 80 part(s) |
| n-Butyl acrylate | 20 part(s) |
| Polyester resin | 5 part(s) |
| Negative charge control agent (Monoazo dye Fe compound of Formula (1) contained in Toner B-1) | 1 part(s) |
| Surface-treated magnetic material (prepared above) | 80 part(s) |

The above-monomer composition was warmed at 60° C., 5 parts of the low-molecular weight polyethylene used in Toner B-1 was added and dispersed therein, and 3 parts of 2,2'-azobis(2,4-dimethyl-valeronitrile) (polymerization initiator) to form a polymerizable monomer mixture.

Into the above-prepared aqueous medium containing $Ca_3(PO_4)_2$, the polymerizable monomer mixture was charged and dispersed under stirring by a high-speed stirrer ("TK-HOMOMIXER", made by Tokushu Kika Kogyo K.K.) at 10000 rpm for 20 min. at 60° C. in an $N_2$ atmosphere, thereby forming droplets of the monomer mixture in the aqueous medium. Thereafter, the stirrer was changed to paddle stirring blades and the stirring was continued to effect 6 hours of reaction at 60° C., followed by further 4 hours of stirring at an elevated temperature of 80° C. After the reaction, the system was subjected to 2 hours of distillation at 80° C., followed by cooling, and addition of hydrochloric acid to dissolve $Ca_3(PO_4)_2$. The resultant polymerizate was filtered out, washed with water and dried to recover toner particles of D4=6.8 μm.

Then, 100 wt. parts of the toner particles were blended with 1.2 parts of the hydrophobic silica fine powder and 2.0 parts of Fine particles B-1, respectively, used in the production of Toner B-1, by a HENSCHEL MIXER to obtain Toner B-11.

(Toners B-2 to B-14)

Toner particles of D4=7.3 μm were prepared in the same manner as in the production of Toner B-1.

Toners B-12 to B-14 were prepared by blending 180 parts of the toner particles with 2.0 parts of Fine particles B-1, respectively, and with 1.2 parts of hydrophobic silica fine powder (SBET (after treatment)=200 $m^2/g$) surface-treated with hexamethyldisilazane (for Toner B-12), 1.2 parts of hydrophobic titanium oxide fine powder (SBET (after treatment)=100 $m^2/g$) surface-treated with isobutyltrimethoxysilane (for Toner B-13) or 1.2 parts of hydrophobic alumina fine powder (SBET (after treatment)=150 $m^2/g$) surface-treated with iso-butyltrimethoxysilane (for Toner B-14), respectively, by a HENSCHEL MIXER (made by Mitsui Miike Kakoki K.K.).

Comparative Toner B-1

Comparative Toner B-1 was prepared in the same manner as Toner B-1 except for omitting Fine particles B-1.

Comparative Toners B-2 to B-5

Comparative Toners B-2 to B-5 were prepared in the same manner as Toner B-1 except for using Fine particles B-6, B-7, B-10 and B-11, respectively, instead of Fine particles B-1.

Some properties of above prepared Toners and Comparative Toners are inclusively shown in Table 3.

Incidentally, Toners B-1 to B-14 and Comparative Toners B-1 to B-5 all exhibited magnetizations at a magnetic field of 79.6 kA/m in a range to 26 to 30 $Am^2/kg$.

TABLE 3

| Properties of Toners | | | | | |
|---|---|---|---|---|---|
| | | | Fine particles | | |
| Toner | D4 (μm) | Cav. (–) | Name/ amount | Isolated (%) | Inorganic fine powder/amount |
| 1 | 7.3 | 0.921 | B-1/2 parts | 81 | silica(treated with HMDS + silicone oil)/1.2 parts |
| 2 | 7.3 | 0.921 | B-2/2 parts | 78 | silica(treated with HMDS + silicone oil)/1.2 parts |
| 3 | 7.3 | 0.921 | B-3/2 parts | 96 | silica(treated with HMDS + silicone oil)/1.2 parts |
| 4 | 7.3 | 0.921 | B-4/2 parts | 10 | silica(treated with HMDS + silicone oil)/1.2 parts |
| 5 | 7.3 | 0.921 | B-5/2 parts | 56 | silica(treated with HMDS + silicone oil)/1.2 parts |
| 6 | 7.3 | 0.921 | B-8/2 parts | 79 | silica(treated with HMDS + silicone oil)/1.2 parts |
| 7 | 7.3 | 0.921 | B-9/2 parts | 84 | silica(treated with HMDS + silicone oil)/1.2 parts |
| 8 | 7.3 | 0.936 | B-1/2 parts | 8 | silica(treated with HMDS + silicone oil)/1.2 parts |
| 9 | 2.9 | 0.933 | B-1/2 parts | 31 | silica(treated with HMDS + silicone oil)/2.5 parts |
| 10 | 10.2 | 0.919 | B-1/2 parts | 86 | silica(treated with HMDS + silicone oil)/0.9 parts |
| 11 | 6.8 | 0.971 | B-1/2 parts | 83 | silica(treated with HMDS + silicone oil)/1.2 parts |
| 12 | 7.3 | 0.921 | B-1/2 parts | 82 | silica(treated with HMDS/1.2 parts |
| 13 | 7.3 | 0.921 | B-1/2 parts | 73 | titania(treated with HMDS/1.2 parts |
| 14 | 7.3 | 0.921 | B-1/2 parts | 75 | alumina(treated with HMDS)/ 1.2 parts |
| Comparative 1 | 7.3 | 0.921 | none | — | silica(treated with HMDS + silicone oil)/1.2 parts |
| Comparative 2 | 7.3 | 0.921 | B-6/2 parts | 85 | silica(treated with HMDS + silicone oil)/1.2 parts |
| Comparative 3 | 7.3 | 0.921 | B-7/2 parts | 68 | silica(treated with HMDS + silicone oil)/1.2 parts |
| Comparative 4 | 7.3 | 0.921 | B-10/2 parts | 87 | silica(treated with HMDS + silicone oil)/1.2 parts |
| Comparative 5 | 7.3 | 0.921 | B-11/2 parts | 59 | silica(treated with HMDS + silicone oil)/1.2 parts |

Production of Photosensitive Members

<Photosensitive Member 1>

Figure 3:
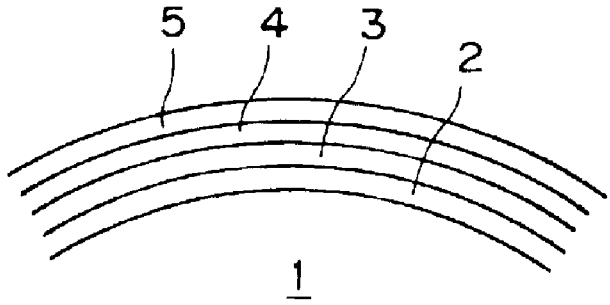
FIGS. 3 and 8 respectively illustrate a laminar structure of an image-bearing member used in an image forming method of the invention.

Photosensitive member 1 (negatively chargeable OPC photosensitive member) having a laminar structure as shown in FIG. 3 was prepared by successively forming the following layers by dipping on a 30 mm-dia. aluminum cylinder support 1.

(1) First layer 2 was a 15 μm-thick electroconductive coating layer (electroconductive) layer, principally comprising phenolic resin with powder of tin oxide and titanium oxide dispersed therein.

(2) Second layer 3 was a 0.6 μm-thick undercoating layer comprising principally modified nylon and copolymer nylon.

(3) Third layer 4 was a 0.6 μm-thick charge generation layer comprising principally an azo pigment having an absorption peak in a long-wavelength region dispersed within butyral resin.

(4) Fourth layer 5 was a 25 μm-thick charge transport layer comprising principally a hole-transporting triphenylamine compound dissolved in polycarbonate resin (having a molecular weight of $2\times10^4$ according to the Ostwald viscosity method) in a weight ratio of 8:10 and further containing 10 wt. % based on total solid of polytetrafluoroethylene powder (volume-average particle size (Dv)=0.2 μm) dispersed therein. The layer surface exhibited a contact angle with pure water of 95 deg. as measured by a contact angle meter ("CA-X", available from Kyowa Kaimen Kagaku K.K.). Further, the surfacemost layer exhibited a volume resistivity of $2\times10^{15}$ ohm.cm.

<Photosensitive Member 2>

Photosensitive member 2 (a negatively chargeable photosensitive member using an organic photoconductor ("OPC photosensitive member")) having a sectional structure as shown in FIG. 8, was prepared in the following manner.

A 30 mm-dia. aluminum cylinder was used as a substrate 11 on which the following first to fifth functional layers 12–16 were successively formed in this order respectively by dipping (except for the charge injection layers 16).

(1) First layers 12 was an electroconductive layer, a ca. 20 μm-thick conductor particle-dispersed resin layer (formed of phenolic resin with tin oxide and titanium oxide powder dispersed therein), for smoothening defects, etc., on the aluminum drum and for preventing the occurrence of moire due to reflection of exposure laser beam.

(2) Second layers 13 was a positive charge injection-preventing layer for preventing a positive charge injected from the Al substrate 11 from dissipating the negative charge imparted by charging the photosensitive member surface and was formed as a ca. 1 μm-thick medium resistivity layer of ca. $10^6$ ohm.cm formed of methoxymethylated nylon.

(3) Third layer 14 was a charge generation layer, a ca. 0.3 μm-thick resinous layer containing a disazo pigment dispersed in butyral resin, for generating positive and negative charge pairs on receiving exposure laser light.

(4) Fourth layer 15 was a ca. 25 μm-thick charge transport layer formed by dispersing a hydrazone compound in a polycarbonate resin. This is a p-type semiconductor layer, so that the negative charge imparted to the surface of the photosensitive member cannot be moved through the layer but only the positive charge generated in the charge generation layer is transported to the photosensitive member surface.

(5) Fifth layer 16 was a charge injection layer containing electroconductive tin oxide ultrafine powder and ca. 0.25 μm-dia. tetrafluoroethylene resin particles dispersed in a photocurable acrylic resin. More specifically, a liquid composition containing low-resistivity antimony-doped tin oxide particles of ca. 0.3 μm in diameter in 100 wt. parts, tetrafluoroethylene resin particles in 20 wt. parts and a dispersing agent in 1.2 wt. parts, respectively, per 100 wt. parts of the resin dispersed in the resin, was applied by spray coating, followed by drying and photocuring, to form a ca. 2.5 μm-thick charge injection layer 16.

The surfacemost layer of the thus-prepared photosensitive member exhibited a volume resistivity of $5\times10^{12}$ ohm.cm and a contact angle with water of 102 deg.

<Photosensitive Member 3>

Photosensitive member 3 was prepared in the same manner as Photosensitive member 2 except that Fifth layer 16 was prepared while omitting the tetrafluoroethylene resin particles and the dispersing agent. The surfacemost layer of Photosensitive member 3 exhibited a volume resistivity of $2\times10^{12}$ ohm.cm and a contact angle with water of 78 deg.

<Photosensitive Member 4>

Photosensitive member 4 was prepared in the same manner as Photosensitive member 2 except that Fifth layer 16 was prepared by dispersing 300 parts of antimony-doped tin oxide particles of ca. 0.03 μm in 100 parts of photocured acrylic resin. The surfacemost layer of Photosensitive member 4 exhibited a volume resistivity of $2\times10^7$ ohm.cm and a contact angle with water of 88 deg.

<Photosensitive Member 5>

Photosensitive member 5 was prepared in the same manner as Photosensitive member 2 except that Fifth layer 16 (charge injection layer) was not formed, and Fourth layer 15 was caused to form the surfacemost layer. The surfacemost layer of Photosensitive member 5 exhibited a volume resistivity of $1\times10^{15}$ ohm.cm and a contact angle with water of 73 deg.

Each of the above-prepared photosensitive members was finally surface-pierced with a needle to peel off a very minute region of the surface layer film for evaluation related with a surface defect described hereinafter.

Production of Charging Members (Charging Member 1)

Charging member 1 (charging roller) was prepared in the following manner.

A SUS (stainless steel)-made roller of 6 mm in diameter and 264 mm in length was used as a core metal and coated with a medium resistivity roller-form foam urethane layer formed from a composition of urethane resin, carbon black (as electroconductive particles), a vulcanizing agent and a foaming agent, followed by cutting and polishing for shape and surface adjustment to obtain a charging roller having a flexible foam urethane coating layer of 12 mm in outer diameter and 234 mm in length. The thus-obtained Charging roller A exhibited a resistivity of $10_5$ ohm.cm and an Asker C hardness of 30 deg. with respect to the foam urethane layer. As a result of observation through a transmission electron microscope, the charging roller surface exhibited an average cell diameter of ca. 100 μm and a void percentage of 60%.

(Charging Member 2)

About a SUS roller of 6 mm in diameter and 264 mm in length as a core metal, a tape of piled electroconductive nylon fiber was spirally wound to prepare a charging brush roller (Charging member 2). The electroconductive nylon fiber was formed from nylon in which carbon black was dispersed for resistivity adjustment and comprised yarns of 6 denier (composed of 50 filament of 30 denier). The nylon yarns in a length of 3 mm were planted at a density of $10_5$ yarns/in$^2$ to provide a brush roller.

Example B-1

An image forming apparatus having an organization generally as illustrated in FIG. 1 and obtained by remodeling a commercially available laser beam printer ("LBP-1760", made by Canon K.K.) was used.

As a photosensitive member 100 (image-bearing member), Photosensitive member 1 (organic photoconductive (OPC) drum) prepared above was used. The photosensitive member 100 was uniformly charged to a dark part potential (Vd) of −700 volts by applying a charging bias voltage comprising a superposition of a DC voltage of −700 volts and an AC voltage of 2.0 kVpp from a charging roller 117 coated with electroconductive carbon-dispersed nylon abutted against the photosensitive member 100. The charged photosensitive member was then exposed at an image part to imagewise laser light 123 from a laser scanner 121 so as to provide a light-part potential ($V_L$) of −150 volts.

A developing sleeve 102 (toner-carrying member) was formed of a surface-blasted 16 mm-dia. aluminum cylinder coated with a ca. 7 μm-thick resin layer of the following composition exhibiting a roughness (JIS center line-average roughness Ra) of 1.0 μm. The developing sleeve 102 was equipped with a developing magnetic pole of 85 mT (850 Gauss) and a silicone rubber blade of 1.0 mm in thickness and 1.0 mm in free length as a toner layer thickness-regulating member. The developing sleeve 102 was disposed with a gap of 290 μm from the photosensitive member 100.

| | |
|---|---|
| Phenolic resin | 100 wt.parts |
| Graphite (Dv = ca. 7 μm) | 90 wt.parts |
| Carbon black | 10 wt.parts |

Then, a developing bias voltage of DC −500 volts superposed with an AC voltage of peak-to-peak 1600 volts and frequency of 2000 Hz was applied, and the developing sleeve was rotated at a peripheral speed of 103 mm/sec which was 1.1 times the photosensitive member peripheral speed (94 mm/sec) moved in identical directions.

A transfer roller 114 used was one identical to a roller 34 as shown in FIG. 4. More specifically, the transfer roller 34 had a core metal 34*a* and an electroconductive elastic layer 34*b* formed thereon comprising conductive carbon-dispersed ethylene-propylene rubber. The conductive elastic layer 34*b* exhibited a volume resistivity of $1\times10^8$ ohm.cm and a surface rubber hardness of 24 deg. The transfer roller 34 having a diameter of 20 mm was abutted against a photosensitive member 33 (photosensitive member 100 in FIG. 1) at a pressure of 59 N/m (60 g/cm) and rotated at an identical speed as that (94 mm/sec) of the photosensitive member 33 rotating in an indicated arrow A direction while being supplied with a transfer bias voltage of DC 1.5 kV.

A fixing device 126 was an oil-less heat-pressing type device for heating via a film (of "LBP-1760", unlike a roller-type one as illustrated). The pressure roller was one having a surface layer of fluorine-containing resin and a diameter of 30 mm. The fixing device was operated at a fixing temperature of 200° C. and a nip width set to 6 mm.

In this particular example (Example B-1), Toner B-1 (magnetic toner) was evaluated with respect to initial stage image forming performances in an environment of 25° C./80% RH on a transfer paper of 90 g/m$^2$. As a result, Toner B-1 exhibited a high transferability to provide good images free from fog at non-image part.

Toner B-1 was further subjected to a continuous image forming test for reproducing an image pattern comprising lateral lines at an image areal percentage of 5% in an environment of 23° C./5% RH.

The inclusion of fine particles in a toner can affect the charging performance of a charging roller. More specifically, a portion of fine particles in the toner can slip by the cleaner to reach the charging roller, whereby the amount of fine particles attached to the charging roller is increased during the continuous image formation. Along with the increased amount of fine particles, the charge leakage in the charging step is liable to occur. As mentioned before, the surface of a tested photosensitive member (Photosensitive member 1 in this example) was pierced by a needle to form a surface defect, and the occurrence state of charge leakage resulting in image defects was checked. A larger number of defect-free sheets of image formation indicates a better durability to such charge leakage. Further, a charging performance in the continuous image formation was also evaluated with respect to image defect (density irregularity attributable to fluctuation in latent image potential) in halftone images by observation with eyes.

The initial stage performances were evaluated with respect to the following items and also with respect to the quality of OHP sheet image formed on an OHP transparent film.

(Transfer Rate)

A transfer residual toner after transfer of a solid black image was peeled off with a polyester adhesive tape and applied on a transfer paper to measure a Macbeth density identified as "C". The same polyester adhesive tape was applied on a yet-unfixed solid black toner image on a transfer paper to measure a Macbeth density identified as "D". The same polyester adhesive tape was applied on a blank transfer paper to measure a Macbeth density identified as "E". Then, a transfer rate (%) was calculated according to the following formula. An image of practically no problem is attained at a transfer rate of 90% or higher.

$$\text{Transfer rate } (\%)=(D-C)/(D-E)\times 100.$$

(Resolution)

Resolution in the initial stage was evaluated by reproducibility of 100 discrete dots of 600 dpi which are generally difficult to reproduce because of the liability of closure of an electrostatic latent image electric field. The evaluation was performed according to the following standard.

A: 5 or less lacks in 100 dots.

B: 6–10 lacks in 100 dots.

C: 11–20 lacks in 100 dots.

D: More than 20 lacks in 100 dots.

(Fog)

Fog value (%) was measured as a difference between a reflectance of a blank paper and a reflectance of a non-image portion of a printed product respectively measured by using a reflection densitometer ("REFLECTMETER MODEL TC-6DC", made by Tokyo Denshoku K.K.).

(Image Density (ID))

A reflection image density on a 20th-sheet of image formation was measured by using a Macbeth densitometer ("RD918", made by Macbeth Co.).

The results of the above evaluation are inclusively shown in Table 4 together with those of Examples and Comparative Examples described hereinafter.

Examples B-2 to B-14

Evaluation was performed in the same manner as in Example B-1 except for using Toners B-2 to B-14 instead of Toner B-1. The results are also shown in Table 4. Some noticeable results are commented as follows.

Example B-3

Toner B-3 resulted in some opacity at non-image portion on an OHP sheet.

Example B-6

In the continuous image formation, slight image defects attributable to charge leakage occurred after ca. 300 sheets and the charging performance became somewhat nonstable after 1600 sheets.

Examples B-8 and B-9

Toner B-8 containing fine particles of somewhat high resistivity resulted in slightly non-stable charging performance. Toner B-9 of D4<3.0 $\mu$m resulted in a somewhat increased transfer residual toner and somewhat non-stable charging performance after ca. 1800 sheets.

Example B-10

Toner B-10 of D4>10 $\mu$m resulted in a somewhat lower resolution.

Comparative Examples B-1 to B-5

Evaluation was performed in the same manner as in Example B-1 except for using Comparative Toners B-1 to B-5, respectively. The results are also shown in Table 4. Some noticeable results are commented below.

Comparative Example B-1

Density irregularity occurred in halftone images from ca. 400 sheets and became worse on continuation of image formation, so that the image formation was terminated at the time of 800 sheets. Image defects attributable to charge leakage were not observed.

Comparative Example B-2

Image defects attributable to charge leakage were observed from ca. 600 sheets, so that the image formation was terminated thereafter. No particular problem was observed with respect to the charging performance.

Comparative Example B-3

Image defects attributable to charge leakage were observed from ca. 800 sheets, so that the image formation was terminated thereafter. No particular problem was observed with respect to the charging performance.

Comparative Example B-4

Density irregularity occurred from ca. 1100 sheets and image defect attributable to charge leakage occurred from ca. 1200 sheets, so that the image formation was terminated thereafter.

Comparative Example B-5

Density irregularity occurred in halftone images from ca. 500 sheets and became worse on continuation of image formation, so that the image formation was terminated at the time of 1000 sheets. Image defects attributable to charge leakage were not observed.

Comparative Example B-6

Image defects attributable to charge leakage were observed from ca. 300 sheets, so that the image formation was terminated thereafter. No particular problem was observed with respect to the charging performance up to 300 sheets. Some opacity was recognized at non-image portion on an OHP sheet.

TABLE 4

| | | Image forming performances | | | | | |
|---|---|---|---|---|---|---|---|
| | | Initial stage image forming performances in 25° C./80% | | | | Continuous image formation in 25° C./5% | |
| Example | Toner | I.D. | Fog. | Transfer rate | Resolution | Leakage defects | Charging performance ** |
| B-1 | B-1 | 1.48 | 0.8 | 89% | B | OK up to 2000 sheets | good up to 2000 sheets |
| B-2 | B-2 | 1.47 | 0.7 | 88 | B | ↑ | ↑ |
| B-3 | B-3 | 1.41 | 1.4 | 81 | C | ↑ | S.D.I.after 1400 sheets |
| B-4 | B-4 | 1.39 | 1.3 | 83 | B | ↑ | S.D.I.after 1100 sheets |
| B-5 | B-5 | 1.45 | 0.9 | 85 | B | ↑ | good up to 2000 sheets |
| B-6 | B-6 | 1.46 | 1.1 | 86 | B | slight after ca. 1300 sheets | S.D.I.after 1600 sheets |
| B-7 | B-7 | 1.44 | 0.9 | 82 | B | OK up to 2000 sheets | good up to 2000 sheets |
| B-8 | B-8 | 1.38 | 1.5 | 82 | B | ↑ | S.D.I.after 1000 sheets |
| B-9 | B-9 | 1.37 | 1.8 | 79 | A | ↑ | S.D.I.after 1800 sheets |
| B-10 | B-10 | 1.42 | 0.6 | 90 | C | ↑ | good up to 2000 sheets |
| B-11 | B-11 | 1.53 | 0.4 | 95 | A | ↑ | ↑ |
| B-12 | B-12 | 1.42 | 1.1 | 84 | B | ↑ | ↑ |
| B-13 | B-13 | 1.41 | 1.2 | 83 | B | ↑ | ↑ |
| B-14 | B-14 | 1.40 | 1.3 | 82 | B | ↑ | ↑ |
| Comp. B-1 | Comp. B-1 | 1.34 | 1.5 | 79 | C | OK up to 800 sheets | D.I.after 400 sheets |
| Comp. B-2 | Comp. B-2 | 1.42 | 1.1 | 84 | B | occurred after 600 sheets | good up to 600 sheets |
| Comp. B-3 | Comp. B-3 | 1.44 | 1.0 | 85 | B | occurred after 1200 sheets | good up to 800 sheets |
| Comp. B-4 | Comp. B-4 | 1.41 | 1.4 | 80 | B | OK up to 1000 sheets | D.I.after 1100 sheets |
| Comp. B-5 | Comp. B-5 | 1.47 | 1.7 | 82 | B | OK up to 1000 sheets | D.I.after 500 sheets |

** S.D.I.: Slight density irregulaity in halftone images
D.I.: Density irregulaity Example B-15

The toner according to the present invention is also applicable to a cleanerless mode image forming method (including a developing-cleaning step).

Toner B-1 prepared above was subjected to image formation in an image forming apparatus having an organization as illustrated in FIG. 5 and including Photosensitive member 2 prepared above as an OPC photosensitive member 21.

The image forming apparatus shown in FIG. 5 5 is a laser beam printer (recording apparatus) according to a transfer-type electrophotographic process and including a developing-cleaning system (cleanerless system). The apparatus includes a process-cartridge from which a cleaning unit having a cleaning member, such as a cleaning blade, has been removed. The apparatus uses a mono-component magnetic toner and a non-contact developing system wherein a toner-carrying member is disposed so that a toner layer carried thereon is in no contact with a photosensitive member for development.

(1) Overall Organization of an Image Forming Apparatus

Referring to FIG. 5, the image forming apparatus includes a rotating drum-type OPC photosensitive member 21 (Photosensitive member 2 prepared above) (as an image-bearing member), which is driven for rotation in an indicated arrow X direction (clockwise) at a peripheral speed (process speed) of 94 mm/sec.

A charging roller 22 (Charging member 1 prepared above) (as a contact charging member) is abutted against the photosensitive member 21 at a prescribed pressing force in resistance to its elasticity. Between the photosensitive member 21 and the charging roller 22, a contact nip n is formed as a charging section. In this example, the charging roller 22 is rotated to exhibit a peripheral speed ratio of 100% (corr. to a relative movement speed ratio of 200%) in an opposite direction (with respect to the surface movement direction of the photosensitive member 21) at the charging section n. Prior to the actual operation, Electroconductive fine powder 1 is applied on the charging roller 22 surface at a uniform density of ca. $1\times10^4$ particles/mm$^2$.

The charging roller 22 has a core metal 22*a* to which a DC voltage of −650 volts is applied from a charging bias voltage supply. As a result, the photosensitive member 1 surface is uniformly charged at a potential (−630 volts) almost equal to the voltage applied to the charging roller 22 in this Example. This is described later again.

The apparatus also includes a laser beam scanner 23 (exposure means) including a laser diode, a polygonal mirror, etc. The laser beam scanner outputs laser light (wavelength=740 nm) with intensity modified corresponding to a time-serial electrical digital image signal, so as to scanningly expose the uniformly charged surface of the photosensitive member 21. By the scanning exposure, an electrostatic latent image corresponding to the objective image data is formed on the rotating photosensitive member 21.

The apparatus further includes a developing device 24, by which the electrostatic latent image on the photosensitive member 21 surface is developed to form a toner image thereon. The developing device 24 is a non-contact-type reversal development apparatus and included, in this Example, a negatively chargeable mono-component insulating developer (Toner B-1 ). As mentioned above, Toner B-1 contained Fine particles B-1 externally added thereto.

The developing device 24 further included a non-magnetic developing sleeve 24*a* (as a toner-carrying member) of a surface-blasted 16 mm-dia. aluminum cylinder coated with a ca. 7 μm-thick resin layer of the following composition exhibiting a roughness (JIS center line-average roughness Ra) of 1.0 μm. The developing sleeve 24*a* was equipped with a developing magnetic pole 90 mT (900 Gauss) and a urethane elastic blade 24*c* of 1.0 mm in thickness and 1.5 mm in free length as a toner layer thickness-regulating member abutted at a linear pressure of 29.4 N/m (30 g/cm) against the sleeve 24*a*. The developing sleeve 24*a* was disposed with a gap of 290 μm from the photosensitive member 21.

| | |
|---|---|
| Phenolic resin | 100 parts |
| Graphite (Dv = ca. 7 μm) | 90 parts |
| Carbon black | 10 parts |

In the developing region a, the developing sleeve 24*a* is rotated in an indicated arrow W direction to show a peripheral speed ratio of 120% of the surface moving speed of the photosensitive member 21 moving in an identical direction.

Toner B-1 is applied as a thin coating layer on the developing sleeve 24*a* by means of an elastic blade 24*c* while also be charged thereby. In the actual operation, Toner B-1 was applied at a rate of 15 g/m$^2$ on the developing sleeve 24*a*.

Toner B-1 applied as a coating on the developing sleeve 24*a* is conveyed along with the rotation of the sleeve 24*a* to the developing section a where the photosensitive member 21 and the sleeve 24*a* are opposite to each other. The sleeve 24*a* is further supplied with a developing bias voltage from a developing bias voltage supply. In operation, the developing bias voltage was a superposition of DC voltage of −420 volts and a rectangular AC voltage of a frequency of 1600 Hz and a peak-to-peak voltage of 1500 volts (providing an electric field strength of $5\times10^6$ volts/m) to effect mono-component jumping development between the developing sleeve 24*a* and the photosensitive member 21.

The apparatus further includes a medium-resistivity transfer roller 25 (as a contact transfer means), which is abutted at a linear pressure of 98 N/m (100 g/cm) against the photosensitive member 21 to form a transfer nip b. To the transfer nip b, a transfer material P as a recording medium is supplied from a paper supply section (not shown), and a prescribed transfer bias voltage is applied to the transfer roller 25 from a voltage supply, whereby toner images on the photosensitive member 21 are successively transferred onto the surface of the transfer material P supplied to the transfer nip b.

In this Example, the transfer roller 25 had a resistivity of $5\times10^8$ ohm.cm and supplied with a DC voltage of +3000 volts to perform the transfer. Thus, the transfer material P introduced to the transfer nip b is nipped and conveyed through the transfer nip b, and on its surface, the toner images on the photosensitive member 21 surface are successively transferred under the action of an electrostatic force and a pressing force.

A fixing device 26 of, e.g., the heat fixing type is also included. The transfer material P having received a toner image from the photosensitive member 1 at the transfer nip b is separated from the photosensitive member 1 surface and introduced into the fixing device 26, where the toner image is fixed to provide an image product (print or copy) to be discharged out of the apparatus.

(2) Evaluation

In this Example, 120 g of Toner B-1 (containing Fine particles B-1) was charged in a toner cartridge and subjected to a print-out test on 2000 sheets operated in an intermittent mode for printing an image pattern having only lateral lines at a print areal ratio of 2% until the charged toner was reduced in amount. A4-size paper of 75 g/m$^2$ was used as the transfer(-receiving) material. As a result, no problem such as lowering in developing performance was observed in the continual intermittent print-out test.

After the print-out test, a part on the charging roller 22 abutted against the photosensitive member 21 was inspected by application and peeling of an adhesive tape, whereby the charging roller 2 was almost completely coated with Fine particles B-1 at a density of ca. $3\times10^4$ particles/mm$^2$ while a slight amount of transfer-residual toner was recognized. Further, as a result of observation through a scanning microscope of a part on the photosensitive member 21 abutted against the charging roller 22, the surface was covered with a tight layer of Fine particles B-1 of very fine particle size and no sticking of transfer-residual toner was observed.

Further, presumably because Fine particles B-1 having a sufficiently low resistivity of $9\times10^3$ ohm.cm were present at the contact part n between the photosensitive member 21 and the charging roller 22, image defects attributable to charging failure was not observed from the initial stage until completion of the print-out test, thus showing good direct injection charging performance. Further, due to the use of Fine particles B-1 coated with a tungsten-containing tin oxide particles, no image defects attributable to charge leakage were observed.

Further, Photosensitive member 2 having the surfacemost layer exhibiting a volume resistivity of $5\times10^{12}$ ohm.cm, character images were formed with a sharp contour exhibiting the maintenance of an electrostatic latent image and a sufficient chargeability even after the print-out test on 2000 sheets. The photosensitive member exhibited a potential of −580 volts in response to direct charging at an applied voltage of −650 volts after the intermittent printing-out on 2000 sheets, thus showing only a slight lowering in chargeability of −50 volts and no lowering in image quality due to lower chargeability.

Further, presumably partly owing to the use of Photosensitive member 2 having a surface showing a contact angle with water of 102 deg., the transfer efficiency was very excellent at both the initial stage and after the intermittent print-out on 2000 sheets. However, even after taking such a smaller amount of transfer-residual toner particles remaining on the photosensitive member after the transfer step after the intermittent printing-out on 2000 sheets into consideration, it is understandable that the recovery of the transfer-residual toner in the developing step was well effected judging from the fact that only a slight amount of transfer-residual toner was recognized on the charging roller 22 after the intermittent printing-out on 2000 sheets and the resultant images were accompanied with little fog at the non-image portion. Further, the scars on the photosensitive member after the intermittent printing-out on 2000 sheets were slight and the image defects appearing in the resultant images attributable to the scars were suppressed to a practically acceptable level.

As for the evaluation, the image-forming performances were evaluated in the same manner as in Example B-1 but at the initial stage and also after the intermittent test. The occurrence of image defects attributable to charge leakage during the printing test was also checked. Further, the charging performance and the density of fine particles at the contact position were evaluated in the following manner.

(1) Charging Performance (Charge Drop ΔV)

At the initial stage and after the print out test, the surface potential on the uniformly changed photosensitive member was measured and a difference ΔV therebetween was taken as a charge drop ΔV, so that a larger charge drop ΔV indicates a larger degree of lowering in charging ability.

(2) Density of Fine Particles

The density of fine particles present at the contact position between the photosensitive member and the contact charging member was measured according to the above-described manner. A density in the range of $1\times10^2$ to $5\times10^5$ particles/$mm^2$ is generally preferred.

The results of the above evaluation are inclusively shown in Table 5 together with those of Examples and Comparative Examples described hereinafter.

Examples B-16 to B-19

The evaluation was performed in the same manner as in Example B-15 except for using Photosensitive members 1, and 3 to 5, respectively, instead of Photosensitive member 2.

Example B-17 using Photosensitive member 3 resulted in a somewhat lower transfer rate, but the resultant images were almost free from problem.

Example B-18 using Photosensitive member B-4 resulted in images of which the sharpness of contour was somewhat lower than that in Example B-15, but resulted in generally good performances in other respects.

Example B-19 using Photosensitive member B-5 exhibited a somewhat lower chargeability of −620 volts from the initial stage in response to a charging bias voltage of −650 volts and the charged potential was lowered −560 volts after the printing test on 2000 sheets.

Example B-20

Figure 6:
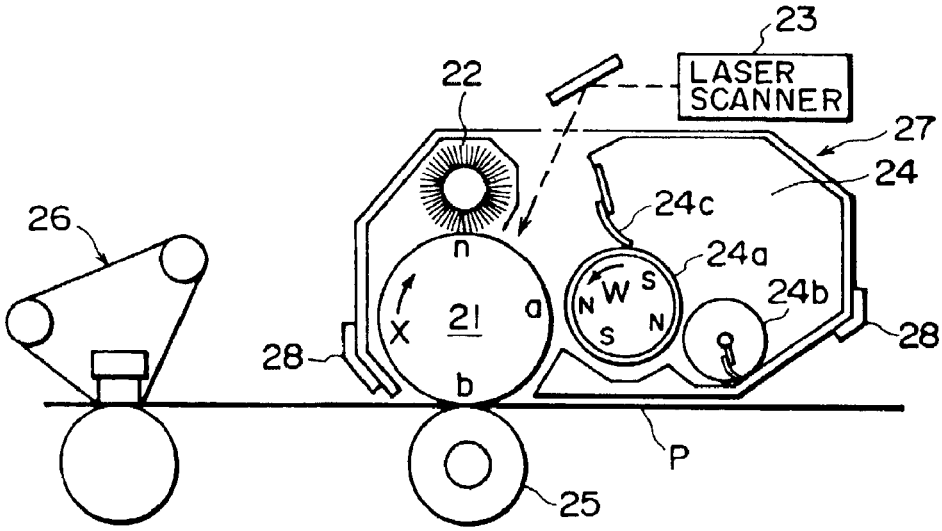
Figure 7:
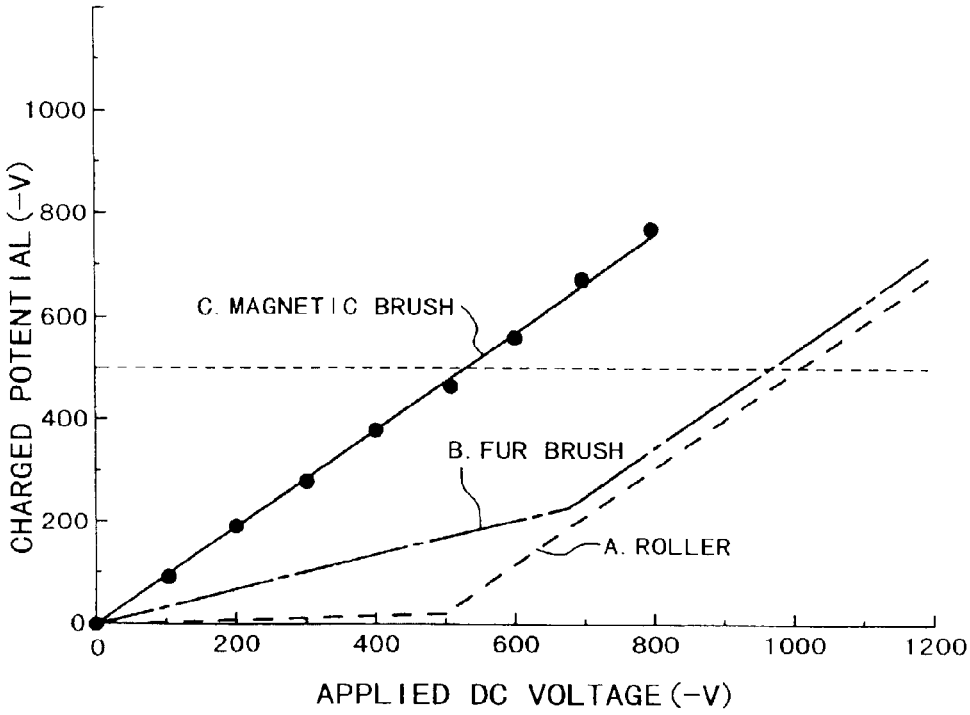
FIG. 7 is a graph showing charging performances of several contact charging members.

The evaluation was performed in the same manner as in Example B-16 except for using Charging member 2 (charging brush (22) as illustrated in FIG. 6) instead of Charging member 1 (charging roller).

Compared with Example B-16, the charging uniformity was somewhat lowered presumably because of a somewhat lower density of fine particles present at the charging nip n, but images of practically no problem could be obtained.

Examples B-21 to B-33

The evaluation was performed in the same manner as in Example B-16 except for using Toners B-2 to B-14, respectively, instead of Toner B-1.

Comparative Examples B-6 and B-7

The evaluation was performed in the same manner as in Example B-16 except for using Comparative Toners B-2 and B-3, respectively, instead of Toner B-1. In both cases, images defects attributable to charge leakage occurred from an early stage of the intermittent printing test.

Comparative Examples B-8 and B-9

The evaluation was performed in the same manner as in Example B-16 except for using Comparative Toners B-4 and B-5, respectively, instead of Toner B-1. In both cases, charging failure occurred from an early stage of the intermittent printing test, so that the image formation test was terminated thereafter.

The results of the above Examples and Comparative Examples are inclusively shown in Table 5 below.

TABLE 5

| | | | | Image forming performances | | | | | | | | |
|---|---|---|---|---|---|---|---|---|---|---|---|---|
| | | | | | | | After 2000 sheets | | | | | |
| | | | | Initial stage | | | | | | Charge | | |
| Example | Photosensitive member | Charging member | Toner | I.D. | Fog | Transfer rate | I.D. | Fog | Transfer rate | down ΔV | Fine particles (/$m^2$) | Leakage defect |
| B-15 | 2 | 1 | 1 | 1.51 | 1.1 | 89% | 1.50 | 1.4 | 87% | −50 | $3\times10^4$ | Not occurred |
| B-16 | 1 | 1 | ↑ | 1.51 | 1.7 | 89 | 1.50 | 2.1 | 87 | −60 | $3\times10^4$ | Not occurred |
| B-17 | 3 | 1 | ↑ | 1.46 | 1.3 | 81 | 1.44 | 1.5 | 79 | −40 | $1\times10^4$ | Not occurred |
| B-18 | 4 | 1 | ↑ | 1.47 | 1.0 | 86 | 1.46 | 1.1 | 84 | −30 | $2\times10^4$ | Not occurred |
| B-19 | 5 | 1 | ↑ | 1.51 | 2.1 | 81 | 1.50 | 2.5 | 78 | −60 | $4\times10^4$ | Not occurred |
| B-20 | 1 | 2 | ↑ | 1.53 | 1.7 | 88 | 1.52 | 2.7 | 86 | −70 | $3\times10^2$ | Not occurred |
| B-21 | 1 | 1 | 2 | 1.50 | 1.6 | 88 | 1.49 | 1.9 | 86 | −60 | $4\times10^4$ | Not occurred |
| B-22 | 1 | 1 | 3 | 1.44 | 2.3 | 80 | 1.41 | 2.8 | 78 | −70 | $6\times10^4$ | Not occurred |
| B-23 | 1 | 1 | 4 | 1.41 | 2.3 | 81 | 1.38 | 2.9 | 79 | −80 | 110 | Not occurred |
| B-24 | 1 | 1 | 5 | 1.50 | 1.8 | 86 | 1.49 | 2.0 | 84 | −60 | $3\times10^4$ | Not occurred |
| B-25 | 1 | 1 | 6 | 1.46 | 2.1 | 82 | 1.45 | 2.9 | 80 | −80 | $4\times10^4$ | Slight (1100)* |
| B-26 | 1 | 1 | 7 | 1.49 | 1.7 | 87 | 1.47 | 1.9 | 85 | −60 | $3\times10^4$ | Not occurred |
| B-27 | 1 | 1 | 8 | 1.40 | 2.0 | 80 | 1.39 | 3.1 | 79 | −90 | 90 | Not occurred |
| B-28 | 1 | 1 | 9 | 1.54 | 2.2 | 79 | 1.50 | 2.8 | 77 | −70 | $2\times10^4$ | Not occurred |
| B-29 | 1 | 1 | 10 | 1.47 | 1.5 | 90 | 1.46 | 1.6 | 88 | −50 | $6\times10^4$ | Not occurred |
| B-30 | 1 | 1 | 11 | 1.55 | 1.2 | 94 | 1.54 | 1.3 | 93 | −40 | $5\times10^4$ | Not occurred |
| B-31 | 1 | 1 | 12 | 1.47 | 2.3 | 80 | 1.45 | 2.7 | 78 | −80 | $3\times10^4$ | Not occurred |

TABLE 5-continued

| | | | | Image forming performances | | | | | | | | |
|---|---|---|---|---|---|---|---|---|---|---|---|---|
| | | | | | | | After 2000 sheets | | | | | |
| | | | | Initial stage | | | | | Charge | | | |
| Example | Photosensitive member | Charging member | Toner | I.D. | Fog | Transfer rate | I.D. | Fog | Transfer rate | down ΔV | Fine particles (/m$^2$) | Leakage defect |
| B-32 | 1 | 1 | 13 | 1.47 | 2.4 | 79 | 1.44 | 2.8 | 77 | −80 | $3 \times 10^4$ | Not occurred |
| B-33 | 1 | 1 | 14 | 1.46 | 2.4 | 78 | 1.44 | 2.8 | 77 | −80 | $2 \times 10^4$ | Not occurred |
| Comp. B-6 | 1 | 1 | Comp. B-2 | 1.47 | 2.2 | 84 | | | Not evaluated | | | Occurred after 300 sheets |
| Comp. B-7 | 1 | 1 | Comp. B-3 | 1.48 | 2.1 | 84 | | | Not evaluated | | | Occurred after 400 sheets |
| Comp. B-8 | 1 | 1 | Comp. B-4 | 1.46 | 2.3 | 79 | | | C.F. (≧500 sheets)** | | | Not occurred |
| Comp. B-9 | 1 | 1 | Comp. B-5 | 1.50 | 2.9 | 81 | | | C.F. (≧200 sheets)** | | | Not occurred |

*Slight (≧1100): Slightly occurred after ca. 1100 sheets.
**C.F. (≧500 sheets): Not evaluated because of interruption after 500 sheets due to charging failure.
C.F. (≧200 sheets): Not evaluated because of interruption after 200 sheets due to charging failure.

(C-1) Production of Tin Oxide Fine Particles (1) Fine Particles C-1

Aqueous solutions of tin chloride ($SnCl_4.5H_2O$) and tungstic acid ($H_2WO_4$) were blended so as to provide a W/Sn (mol) ratio of 0.04 and heated at 90° C. while maintaining the pH at 6.5–7.5. Then, hydrochloric acid was added thereto to form a co-precipitate, which was recovered by filtration and dried.

The dried product was calcined at 600° C. in an electric furnace of nitrogen atmosphere, disintegrated and calcined to obtain Fine particles C-1 (tungsten-containing tin oxide fine particles) of Dv=1.0 μm, which also exhibited W/Sn (mol)=0.036 and Rv=$1\times10^4$ ohm.cm.

(2) Fine Particles C-2

Fine particles C-2 of Dv=1.5 μm, W/Sn (mol)=0.073 and R=$1\times10^6$ ohm.cm were prepared in the same manner as Fine particles C-1 except for changing the W/Sn ratio of the mixture aqueous solution to 0.08, effecting the calcination in the atmospheric environment and changing the disintegration and classification conditions.

(3) Fine particles C-3

Fine particles C-3 of Dv=0.5 μm, W/Sn (mol)=0.008 and R=$7\times10^5$ ohm.cm were prepared in the same manner as Fine particles C-1 except for changing the W/Sn ratio of the mixture aqueous solution to 0.01, and changing the disintegration and classification conditions.

(4) Fine Particles C-4

Fine particles C-4 of Dv=0.3 μm were prepared in the same manner as Fine particles C-1 except for changing the classification conditions.

(C-2) Production of Toner particles (1) Toner particles C-1

100 parts of polyester resin (Tg=62° C., molecular weights: Mp=7600, Mn=3300 and Mw=60000), 5 parts of carbon black, 2.5 parts of monoazo metal complex (negative charge control agent), and 3 parts of low-molecular weight ethylene-propylene copolymer (Tabs (heat-absorption main peak temperature)=84° C., Tevo (heat-evolution main peak temperature)=86° C.) were blended by a HENSCHEL MIXER and melt-kneaded through a twin-screw extruder set at 130° C. After being cooled, the melt-kneaded product was crushed by a hammer mill, pulverized by a mechanical pulverizer and classified by a pneumatic classifier to obtain Toner particles C-1 (non-magnetic) having a weight-average particle size (D4) of 6.5 μm.

(2) Toner Particles C-2

Toner particles C-2 (magnetic) of D4=6.5 μm were prepared in a similar manner as Toner particles C-1 except for changing the toner ingredients to 100 parts of styrene-butyl acrylate-monobutyl maleate copolymer (Tg=60° C., molecular weights: Mp=12000, Mn=6300 and Mw=$2.21\times10^5$), 100 parts of magnetic iron oxide (average particle size (Dav)=0.22 μm, $\sigma_s$=83.8 m$^2$/kg), 2 parts of monoazo metal complex (negative charge control agent) and 3 parts of low-molecular weight ethylene propylene copolymer (Tabs=85° C., Tevo=86° C.).

(3) Toner particles C-3

Toner particles C-3 (non-magnetic) of D4=7.9 μm were prepared in the same manner as Toner particles C-1 except for using styrene-butyl acrylate copolymer (Tg=58° C., molecular weight: Mp=16,800, Mn=10,100, Mw=$3.03\times10^5$) instead of the polyester resin.

Example C-1

(1) Toner C-1

100 parts of Toner particles C-1, 1.5 parts of Fine particles A-1, and 1.2 parts of hydrophobic silica fine powder treated with dimethylsilicone oil were blended by a HENSCHEL MIXER to prepare Toner C-1, which exhibited a surface-attached fine particle ratio of 3.5 particles per 1 toner particle, and a fine particle (Dv)/toner particle (D4) diameter ratio of 0.11.

(2) Carrier C-1

Carrier C-1 was prepared by coating 100 parts of ferrite particles of 45 μm with 0.7 part of acrylic resin.

(3) Two-component developer C-1

Two-component developer C-1 was prepared by blending Developer carrier C-1 and Toner C-1 in a weight ratio of 100:7.

The thus obtained Developer C-1 was evaluated in the following manner.

Evaluation Method

Image formation was performed by using a digital copying machine having a laser beam exposure means ("GP55", made by Canon K.K.) after remodeling. The digital copying machine ("GP55") was one of a reversal development-type operated at a process speed of 150 mm/s and initially included an OPC photosensitive member, a corona charger, a mono-component jumping developing device, a corona transfer device and a blade-type cleaning device. The charger, transfer device and the developing device were remodelled.

More specifically, the corona charger was taken out and replaced with a contact charging roller so as to be rotatable following the rotation of the photosensitive member. The charging roller was supplied with a charging bias voltage comprising a DC voltage of −700 volts superposed with an AC voltage of 1500 Vpp and 800 Hz.

The corona transfer device was replaced by a contact roller transfer device. One end of the transfer roller was coupled with one end of the photosensitive member via gears, so that the transfer roller was rotatable at an identical peripheral speed in an identical surface direction as the photosensitive member. The transfer was performed under a constant transfer current flow.

The mono-component developing device was replaced by a two-component developing device including a SUS-made developing sleeve blasted with glass beads so as to exhibit a roughness Ra of 1.0 μm. The developing sleeve was driven by an external motor at a peripheral speed ratio of 150%. The developing sleeve was supplied with a developing bias voltage comprising a DC voltage of −500 volts superposed with an AC voltage of 1000 Vpp.

For the evaluation, continuous image formation on 1000 sheets was performed by using a test chart having an image areal percentage of 6% in an environment of 23° C./60% RH. Image quality evaluation was performed with respect to image fog, scattering of fine particles and thin-line reproducibility.

Image fog was evaluated by measuring the reflectances of blank white paper and a white background portion of the white paper after the printing by using a reflectance meter ("REFLECTMETER", made by Tokyo Denshoku K.K.) to take a difference therebetween as a fog (%). Based on the measured fog (%) value, the evaluation was performed according to the following standard.

A: fog (%)<0.5%

B: 0.5%≦fog (%)<1.0%

C: 1.0%≦fog (%)<2.0%

D: fog (%)≦2.0

Scattering of tin oxide fine particles was evaluated according to the following standard.

A: Not observed.

B: Slight scattering occurred to cause slight disturbance of images.

C: Remarkable scattering occurred to deteriorate the image quality.

Thin-line reproducibility (Thin line) was evaluated according to the following standard.

A: Good thin-line reproducibility.

B: Slight degree of thinning or overlapping of thin lines was observed but at a level of practically no problem.

C: Thinning or overlapping of thin lines observed partly.

D: Conspicuous thinning or overlapping of thin lines.

The results of evaluation are inclusively shown in Table 6 appearing hereinafter together with those of the following Examples and Comparative Examples. As shown in Table 6, high quality images were obtained in this Example C-1 in all respects of the above evaluation.

Example C-2

Toner C-2 was prepared in the same manner as Toner C-1 in Example C-1 except for using Toner particles C-2 and Fine particles C-2 and changing the amount of the fine particles to 2.0 parts. Toner C-2 exhibited a surface-attached fine particle ratio of 7.5 particles/toner particle, and a fine particle/toner particle diameter ratio of 0.08.

Toner C-3 was evaluated in the same manner as in Example C-1 except for using a mono-component developing device including a blasted SUS developing sleeve of Ra=0.6 μm instead of the two-component developing device.

Example C-3

Toner C-3 and then Two-component Developer C-3 were prepared and evaluated in the same manner as in Example C-1 except for using Toner particles C-3 and Fine particles C-3 and changing the addition amount of the fine particles to 1.0 part.

Toner C-3 exhibited a surface-attached fine particle ratio of 1.5 particles/toner particle and a fine particle/toner particle diameter ratio of 0.07.

Example C-4

Toner C-4 was prepared in the same manner as Toner C-1 in Example C-1 except for using Toner particles C-2 and Fine particles C-2 and changing the amount of the fine particles to 0.8 part. Toner C-4 exhibited a surface-attached fine particle ratio of 2.1 particles/toner particle, and a fine particle/toner particle diameter ratio of 0.20.

Toner C-4 was evaluated in the same manner as in Example C-1 except for using a mono-component developing device including a blasted SUS developing sleeve of Ra=0.6 μm instead of the two-component developing device and rotating the developing sleeve at a peripheral speed ratio of 170%.

Example C-5

Toner C-5 and then Two-component Developer C-5 were prepared and evaluated in the same manner as in Example C-1 except for using Toner particles C-3 and Fine particles C-3 and changing the addition amount of the fine particles to 0.4 part.

Toner C-5 exhibited a surface-attached fine particle ratio of 1.1 particles/toner particle and a fine particle/toner particle diameter ratio of 0.04.

Example C-6

Toner C-6 was prepared by blending 100 parts of Toner particles C-3, 0.4 part of Fine particles C-3 and 1.5 parts of hydrophobic titanium oxide particles treated with n-butyltrimethoxysilane. Two-component developer C-6 was prepared and evaluated in the same manner as in Example C-5 except for using Toner C-6 instead of Toner C-5. The results of evaluation are shown in Table 6.

Further, identical evaluation was performed in the same manner also in a low humidity environment of 23° C./5% RH. As a result, generally good results were obtained while image fog and thin-line reproducibility were somewhat inferior.

Example C-7

Identical evaluation as in Example C-1 was performed except for changing the environment to 23° C./5% RH. As a result, high image qualities as in Example C-1 were attained.

Comparative Example C-1

Tin chloride and antimony chloride in an Sb/Sn mol ratio of 0.02 were hydrolyzed in hot water to form a co-precipitate, which was then calcined in an electric furnace to obtain antimony-containing tin oxide fine particles. The fine particles exhibited a dark blue color and Rv=$3\times10^3$ ohm.

100 parts of Toner particles C-2 were blended with 1.3 parts of the above-prepared antimony-containing tin oxide fine particles and 1.2 parts of hydrophobic silica fine powder by a HENSCHEL MIXER to obtain Toner C-7, which exhibited a surface-attached fine particle ratio of 5.0 particles/toner particle and a fine particle/toner particle diameter ratio of 0.25.

Toner C-7 was evaluated in the same manner as in Example C-2 using a mono-component jumping developing device.

Comparative Example C-2

100 parts of Toner particles C-1 were blended with 1.1 parts of tungsten-free tin oxide fine particles and 1.2 parts of hydrophobic silica fine powder to obtain Toner C-8, which exhibited a surface-attached fine particle ratio of 2.5 particles/toner particle, and a fine particle/toner particle diameter ratio of 0.18.

Two-component Developer C-8 was prepared from Toner C-8 and evaluated otherwise in the same manner as in Example C-1.

Comparative Example C-3

The tungsten-free tin oxide fine particles used in Comparative Example C-2 were calcined in a hydrogen gas atmosphere to obtain partially reduced tin oxide fine particles, which were black in color and exhibited Rv=$2\times10^5$ ohm.cm.

Two-component Developer C-9 was prepared by using 1.1 parts of the above-prepared tin oxide fine particles otherwise in the same manner as in Comparative Example C-2 and evaluated in the same manner as in Example C-1.

The results of evaluation of the above Examples and Comparative Examples are inclusively shown in Table 6 below.

TABLE 6

| Example | Image fog | Scattering | Thin line |
|---|---|---|---|
| C-1 | A | A | A |
| C-2 | A | A | A |
| C-3 | A | A | A |
| C-4 | A | A | A |
| C-5 | A | A | A |
| C-6 | A | A | A |
| Comp. C-1 | D | C | B |
| Comp. C-2 | D | B | B |
| Comp. C-3 | D | C | B |

Example C-8

Toner C-2 prepared in Example C-2 was evaluated for image formation in an image forming apparatus including a cleanerless system identical to the one used in Example B-15.

In this example, Toner C-2 was evaluated for intermittent-mode printing on 2000 A4-size copying paper sheets in the same manner as in Example B-15. As a result, no problem such as lowering in developing performance was observed in the continual intermittent print-out test.

After the print-out test, a part on the charging roller 22 abutted against the photosensitive member 21 was inspected by application and peeling of an adhesive tape, whereby the charging roller 2 was almost completely coated with Fine particles C-1 (of tungsten-containing tin oxide) at a density of ca. $2.5\times10^4$ particles/mm$^2$ while a slight amount of transfer-residual toner was recognized. Further, as a result of observation through a scanning microscope of a part on the photosensitive member 21 abutted against the charging roller 22, the surface was covered with a tight layer of Fine particles C-1 of very fine particle size and no sticking of transfer-residual toner was observed.

Further, presumably because Fine particles C-1 having a sufficiently low resistivity of $1\times10^4$ ohm.cm were present at the contact part n between the photosensitive member 21 and the charging roller 22, image defects attributable to charging failure was not observed from the initial stage until completion of the print-out test on 2000 sheets, thus showing good direct injection charging performance.

Further, Photosensitive member 2 having the surfacemost layer exhibiting a volume resistivity of $5\times10^{12}$ ohm.cm, character images were formed with a sharp contour exhibiting the maintenance of an electrostatic latent image and a sufficient chargeability even after the print-out test on 2000 sheets. The photosensitive member exhibited a potential of −570 volts in response to direct charging at an applied voltage of −650 volts after the intermittent printing-out on 2000 sheets, thus showing only a slight lowering in chargeability of −60 volts and no lowering in image quality due to lower chargeability.

Further, presumably partly owing to the use of Photosensitive member 2 having a surface showing a contact angle with water of 102 deg., the transfer efficiency was very excellent at both the initial stage and after the intermittent print-out on 2000 sheets. However, even after taking such a smaller amount of transfer-residual toner particles remaining on the photosensitive member after the transfer step after the intermittent printing-out on 2000 sheets into consideration, it is understandable that the recovery of the transfer-residual toner in the developing step was well effected judging from the fact that only a slight amount of transfer-residual toner was recognized on the charging roller 22 after the intermittent printing-out on 2000 sheets and the resultant images were accompanied with little fog at the non-image portion. Further, the scars on the photosensitive member after the intermittent printing-out on 2000 sheets were slight and the image defects appearing in the resultant images attributable to the scars were suppressed to a practically acceptable level.

Example C-9

The toner of the present invention allows good image formation also when used in an image forming apparatus having an a-Si (amorphous silicon) photosensitive member.

Thus, toner C-2 was evaluated in an image forming apparatus including an a-Si photosensitive member prepared in the following manner instead of the OPC photosensitive member otherwise in the same manner as in Example C-8 (i.e., as in Example B-15).

A cylindrical conductor substrate was successively coated with a lower barrier layer, a photoconductor layer and a surface layer, respectively under the following conditions, to form an a-Si photosensitive member.

| | |
|---|---|
| (Lower barrier layer) | |
| Feed: | |
| $SiH_4$ | 100 ml/min (NTP) |
| $H_2$ | 300 ml/min (NTP) |
| $PH_3$ | 800 ppm (based on $SiH_4$) |
| NO | 5 ml/min (NTP) |
| Power: | 150 W (13.56 MHz) |
| Inner pressure: | 80 Pa |
| Substrate temp.: | 280° C. |
| Layer thickness: | 3 μm |
| (Photoconductor layer) | |
| Feed: | |
| $SiH_4$ | 350 ml/min (NTP) |
| $H_2$ | 600 ml/min (NTP) |
| $B_2H_6$ | 0.5 ppm (based on $SiH_4$) |
| Power: | 400 W (13.56 MHz) |
| Inner pressure: | 73 Pa |
| Substrate temp.: | 280° C. |
| Layer thickness: | 20 μm |
| (Surface layer) | |
| Feed: | |
| $CH_4$ | 500 ml/min (NTP) |
| Power: | 1000 W (13.56 MHz) |
| Inner pressure: | 66.7 Pa |
| Substrate temp.: | 200° C. |
| Layer thickness: | 0.5 μm |

Note)
NTP = gas volume under normal temperature and pressure.

In this example, an intermittent print-out test was performed on 2000 A4-size sheets of 75 g/m$^2$. As a result, no problem such as lowering in developing performance was observed in the continual intermittent print-out test.

After the print-out test, a part on the charging roller 22 abutted against the photosensitive member 21 was inspected by application and peeling of an adhesive tape, whereby the charging roller 2 was almost completely coated with Fine particles C-1 (of tungsten-containing tin oxide) at a density of ca. $2.0\times10^4$ particles/mm$^2$ while a slight amount of transfer-residual toner was recognized. Further, as a result of observation through a scanning microscope of a part on the photosensitive member 21 abutted against the charging roller 22, the surface was covered with a tight layer of Fine particles C-1 of very fine particle size and no sticking of transfer-residual toner was observed.

Further, presumably because Fine particles C-1 having a sufficiently low resistivity of $1\times10^4$ ohm.cm were present at the contact part n between the photosensitive member 21 and the charging roller 22, image defects attributable to charging failure was not observed from the initial stage until completion of the print-out test, thus showing good direct injection charging performance.

Further, the transfer efficiency was good from the initial stage to after the end of the intermittent print-out test on 2000 sheets. Further, even after the intermittent print-out test on 2000 sheets, a satisfactory image formation was performed according to a cleanerless mode. After the intermittent state, no scars were observed on the photosensitive member.

What is claimed is:

1. A toner comprising: toner particles comprising at least a binder resin and a colorant, and fine particles; wherein the fine particles comprise base particles, and a tungsten-containing tin compound coating the base particles, the fine particles contain tin (Sn) in a weight ratio (Sn/B) of 0.01 to 2.0 with respect to the base particles (B), and tungsten (W) is contained in a mol ratio (W/Sn) of 0.001 to 0.3 with respect to the tin (Sn).

2. The toner according to claim 1, wherein the fine particles have a resistivity of at most $1\times10^9$ ohm. cm.

3. The toner according to claim 1, wherein the base particles are selected from the group consisting of particles of silicon oxide, titanium oxide, alumina, aluminum silicate, magnesium oxide, barium sulfate and titanate compounds.

4. The toner according to claim 1, wherein the fine particles are present on the toner particle surfaces at a rate of at least 0.3 particles/toner particle.

5. The toner according to claim 1, wherein the toner particles have a weight-average particle size of 3 to 10 μm.

6. The toner according to claim 1, wherein the fine particles have a volume-average particle size of 0.1 to 5 μm.

7. The toner according to claim 6, wherein the fine particles contain at most 3% by number of particles of 5 μm or larger.

8. The toner according to claim 1, wherein the fine particles have a volume-average particle size (S) which provides a ratio (S/T) of at most 0.5 with respect to a weight-average particle size (T) of the toner particles.

9. The toner according to claim 1, wherein the fine particles have a resistivity of $1\times10^2$ to $1\times10^7$ ohm. cm.

10. The toner according to claim 1, wherein the toner contains inorganic fine powder having an average primary particle size of 4 to 80 nm and comprising an inorganic oxide selected from the group consisting of silica, titanium oxide, alumina and complex oxides of these.

11. The toner according to claim 10, wherein the inorganic fine powder has been treated with at least silicone oil.

12. A toner comprising: toner particles comprising at least a binder resin and a colorant, and fine particles having a volume-average particle size of 0.1 to 5 μm; wherein the fine particles comprise tungsten-containing tin oxide fine particles, and tungsten (W) is contained therein in a mol ratio (W/Sn) of 0.001 to 0.3 with respect to the tin (Sn).

13. The toner according to claim 12, wherein the fine particles are present on the toner particle surfaces at a rate of at least 0.3 particles/toner particle.

14. The toner according to claim 12, wherein the toner particles have a weight-average particle size of 3 to 10 μm.

15. The toner according to claim 12, wherein the fine particles contain at most 3% by number of particles of 5 μm or larger.

16. The toner according to claim 12, wherein the fine particles have a volume-average particle size (S) which provides a ratio (S/T) of at most 0.5 with respect to a weight-average particle size (T) of the toner particles.

17. The toner according to claim 12, wherein the fine particles have a resistivity of at most $1\times10^9$ ohm. cm.

18. The toner according to claim 12, wherein the toner contains inorganic fine powder having an average primary particle size of 4 to 80 nm and comprising an inorganic oxide selected from the group consisting of silica, titanium oxide, alumina and complex oxides of these.

19. The toner according to claim 18, wherein the inorganic fine powder has been treated with at least silicone oil.

* * * * *

UNITED STATES PATENT AND TRADEMARK OFFICE

CERTIFICATE OF CORRECTION

PATENT NO. : 6,897,001 B2
DATED : May 24, 2005
INVENTOR(S) : Kiyoshi Mizoe et al.

It is certified that error appears in the above-identified patent and that said Letters Patent is hereby corrected as shown below:

Title page,
Item [75], Inventors, "Kiyoshi Mizoe, Numazu (JP); Tsuyoshi Takiguchi, Shizuoka-ken (JP); Fumihiro Arahira, Shizuoka-ken (JP); Masanori Ito, Tokyo (JP)" should read -- Kiyoshi Mizoe, Numazu-shi (JP); Tsuyoshi Takiguchi, Suntoh-gun (JP); Fumihiro Arahira, Suntoh-gun (JP); Masanori Ito, Tokyo (JP) --.

Column 47,
Line 22, "section a" should read -- section a --.

Column 53,
Line 29, "particles B-1" should read -- particles B-11 --.

Column 56,
Lines 48 and 51, "(SBET" should read -- ($S_{BET}$ --.

Column 58,
Lines 56 and 64, "layers" should read -- layer --.

Column 60,
Line 5, "$10_5$ ohm.com" should read -- $10^5$ ohm.com --; and
Line 19, "of $10_5$" should read -- of $10^5$ --.

Column 65,
Line 47, "section a" should read -- section a --.

Signed and Sealed this

Thirteenth Day of September, 2005

JON W. DUDAS
*Director of the United States Patent and Trademark Office*